US008043773B2

(12) United States Patent
Ikuno et al.

(10) Patent No.: US 8,043,773 B2
(45) Date of Patent: Oct. 25, 2011

(54) IMAGE BEARING MEMBER, IMAGE FORMING APPARATUS AND PROCESS CARTRIDGE

(75) Inventors: Hiroshi Ikuno, Yokohama (JP); Tetsuro Suzuki, Fuji (JP); Hidetoshi Kami, Numazu (JP); Yukio Fujiwara, Numazu (JP); Hiroshi Tamura, Susono (JP)

(73) Assignee: Ricoh Company, Limited, Tokyo (JP)

( * ) Notice: Subject to any disclaimer, the term of this patent is extended or adjusted under 35 U.S.C. 154(b) by 824 days.

(21) Appl. No.: 11/941,355

(22) Filed: Nov. 16, 2007

(65) Prior Publication Data

US 2008/0153021 A1 Jun. 26, 2008

(30) Foreign Application Priority Data

Nov. 16, 2006 (JP) ..... 2006-309952
Oct. 3, 2007 (JP) ..... 2007-259506

(51) Int. Cl.
*G03G 5/047* (2006.01)
*G03G 5/147* (2006.01)

(52) U.S. Cl. ..... 430/58.7; 430/58.05; 430/59.6; 399/159

(58) Field of Classification Search ..... 430/58.7, 430/59.6, 58.05; 399/159
See application file for complete search history.

(56) References Cited

U.S. PATENT DOCUMENTS 4,766,048 A * 8/1988 Hisamura ..... 430/58.05
4,772,525 A 9/1988 Badesha et al.
7,160,658 B2 1/2007 Suzuki et al.
7,175,957 B2 2/2007 Suzuki et al.
7,179,573 B2 2/2007 Suzuki et al.
7,251,437 B2 7/2007 Tamoto et al.
7,279,260 B2 10/2007 Nagai et al.
2004/0248024 A1* 12/2004 Suzuki et al. ..... 430/66
2005/0008957 A1 1/2005 Ikegami et al.
2005/0158641 A1 7/2005 Yanagawa et al.
2005/0175911 A1 8/2005 Tamoto et al.
2005/0181291 A1 8/2005 Kami et al.
2005/0221210 A1 10/2005 Suzuki et al.
2005/0266325 A1 12/2005 Yanagawa et al.
2005/0266328 A1 12/2005 Yanagawa et al.
2005/0282075 A1 12/2005 Ikuno et al.
2005/0287452 A1 12/2005 Tamura et al.

(Continued)

FOREIGN PATENT DOCUMENTS

JP 52-36016 3/1977

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Oblon, Spivak, McClelland, Maier & Neustadt, L.L.P.

(57) ABSTRACT

An image bearing member including an electrostatic substrate, a photosensitive layer located overlying the electrostatic substrate, a surface layer located overlying the photosensitive layer, and the surface layer is a cross-linking resin layer in which particulates having a needle form are dispersed and which is formed by curing a monomer having at least three radical polymerizable functional groups without a charge transport structure and a radical polymerizable compound having a charge transport structure.

10 Claims, 4 Drawing Sheets

U.S. PATENT DOCUMENTS

2008/0305416 A1* 12/2008 Wu et al. ..... 430/58.1

FOREIGN PATENT DOCUMENTS

| | | | |
|---|---|---|---|
| JP | 64-1728 | | 1/1989 |
| JP | 64-9964 | | 1/1989 |
| JP | 64-13061 | | 1/1989 |
| JP | 64-19049 | | 1/1989 |
| JP | 1-241559 | | 9/1989 |
| JP | 4-11627 | | 1/1992 |
| JP | 4-175337 | | 6/1992 |
| JP | 4-183719 | | 6/1992 |
| JP | 4-225014 | | 8/1992 |
| JP | 4-230767 | | 8/1992 |
| JP | 4-320420 | | 11/1992 |
| JP | 5-19497 | | 1/1993 |
| JP | 5-70595 | | 3/1993 |
| JP | 5-60503 | | 9/1993 |
| JP | 5-232727 | | 9/1993 |
| JP | 5-310904 | | 11/1993 |
| JP | 6-45770 | | 6/1994 |
| JP | 6-234836 | | 8/1994 |
| JP | 6-234837 | | 8/1994 |
| JP | 6-234838 | | 8/1994 |
| JP | 6-234839 | | 8/1994 |
| JP | 6-234840 | | 8/1994 |
| JP | 6-234841 | | 8/1994 |
| JP | 6-236050 | | 8/1994 |
| JP | 6-236051 | | 8/1994 |
| JP | 6-239049 | | 8/1994 |
| JP | 6-295077 | | 10/1994 |
| JP | 7-56374 | | 3/1995 |
| JP | 8-176293 | | 7/1996 |
| JP | 8-208820 | | 8/1996 |
| JP | 8-211640 | | 8/1996 |
| JP | 8-253568 | | 10/1996 |
| JP | 8-269183 | | 10/1996 |
| JP | 9-43883 | | 2/1997 |
| JP | 9-62019 | | 3/1997 |
| JP | 9-71642 | | 3/1997 |
| JP | 9-87376 | | 3/1997 |
| JP | 9-104746 | | 4/1997 |
| JP | 9-110974 | | 4/1997 |
| JP | 9-110976 | | 4/1997 |
| JP | 09114121 | A * | 5/1997 |
| JP | 9-157378 | | 6/1997 |
| JP | 9-221544 | | 8/1997 |
| JP | 9-227669 | | 9/1997 |
| JP | 9-235367 | | 9/1997 |
| JP | 9-241369 | | 9/1997 |
| JP | 9-268226 | | 10/1997 |
| JP | 9-272735 | | 10/1997 |
| JP | 9-302084 | | 11/1997 |
| JP | 9-302085 | | 11/1997 |
| JP | 9-328539 | | 12/1997 |
| JP | 10-20536 | | 1/1998 |
| JP | 10-73944 | | 3/1998 |
| JP | 3123733 | | 10/2000 |
| JP | 3164426 | | 3/2001 |
| JP | 2001-166518 | | 6/2001 |
| JP | 2001175016 | A * | 6/2001 |
| JP | 2005-99688 | | 4/2005 |
| JP | 2005-107490 | | 4/2005 |

OTHER PUBLICATIONS

English language machine translation of JP 09-114121 (May 1997).*
English language machine translation of JP 2001-175016 (Jun. 2001).*

* cited by examiner

IMAGE BEARING MEMBER, IMAGE FORMING APPARATUS AND PROCESS CARTRIDGE

BACKGROUND OF THE INVENTION

1. Field of the Invention

The present invention relates to an image bearing member and an image forming method, an image forming apparatus and a process cartridge using the image bearing member.

2. Discussion of the Background

Recently, organic photoconductors (image bearing members) have been used in place of inorganic photoconductors for a photocopier, a facsimile machine, a laser printer and a multifunctional device thereof in light of performances and advantages, such as, optical characteristics, for example, a wide range of optical absorption wavelength and a large amount of absorption of light; electric characteristics, for example, high sensitivity and stable chargeability; a wide selection of materials; ease of manufacturing; inexpensiveness; and toxic-free property.

In addition, demand for the size reduction of an image forming apparatus accelerates the size reduction of an image bearing member. Also, high speed performance and maintenance-free performance have been demanded. Therefore, an image bearing member having high durability has been desired. From this point of view, an organic photoconductor is easy to wear in general because the surface layer thereof is mainly made of a low molecular weight charge transport material and an inert polymer. When such an organic photoconductor is repetitively used in the electrophotography process, the organic photoconductor tends to be abraded under mechanical stress by a developing system or a cleaning system. In addition, in accordance with the size reduction of toner particles for improving the quality of images, the rubber of a cleaning blade is hardened and the contact pressure between an image bearing member and a cleaning blade is increased to improve the cleaning property. This accelerates the abrasion of an image bearing member. Such abrasion of an image bearing member causes deterioration of electric characteristics, for example, the sensitivity and the chargeability, resulting in abnormal images, such as, deterioration of image density and the background fouling. When an image bearing member is locally damaged by abrasion, the damaged portion causes streaks on an image resulting from bad cleaning performance on the image bearing member. Currently, this abrasion or damage is a controlling factor of the lifetime of an image bearing member and once an image bearing member has such abrasion or damage, the image bearing member must be replaced immediately to sustain image quality and performance.

It is desired to reduce the amount of abrasion described above to obtain an organic photoconductor having a high durability. This is an imminent issue to be solved in this field.

As a technology to improve the anti-abrasion property of an image bearing member, for example, (1): unexamined published Japanese patent application No. (hereinafter referred to as JOP) S56-48637 describes a technology in which a curing binder is used for a surface layer; (2): JOP S64-1728 describes a technology in which a polymer charge transport material is used; and (3) JOP H4-281461 describes a technology in which an inorganic filler is dispersed in a surface layer. Among these technologies, with regard to the curing binder of (1), the residual voltage tends to rise due to bad compatibility between the curing binder and a charge transport material and remaining impurities, for example, a polymerization initiator or non-reacted groups, which results in reduction in image density. The anti-abrasion property of an organic photoconductor using the polymer charge transport material of (2) or the dispersed inorganic filler of (3) is improved in some degree but has not reached the level desired for an organic photoconductor.

Furthermore, to improve the anti-abrasion property and anti-damage property of the organic photoconductor described in (1), Japanese Patent No. (hereinafter referred to as JP) 3262488 describes an organic photoconductor containing an acrylate monomer cured compound having multiple functional groups. Although there is a description that the surface layer provided on the photosensitive layer contains the acrylate monomer cured compound, there is no specific description about a charge transport material but just a description that a charge transport material can be contained in the surface layer. In addition, when a charge transport material having a low molecular weight is simply contained, a problem of the compatibility between the cured compound and the charge transport material arises. This problem tends to cause precipitation of a transport material having a low molecular weight and white turbidity phenomenon. Also, the mechanical strength of the organic photoconductor easily deteriorates.

Furthermore, this organic photoconductor is manufactured by reacting the monomer in the state in which a polymer binder is contained so that the curing reaction is not sufficiently conducted. In addition, the compatibility between the cured material and the binder resin is bad and therefore, the phase separation tends to occur during the curing reaction and lead to formation of a rough surface, resulting in bad cleaning performance.

As the anti-abrasion technology for a photosensitive layer in place of these technologies, for example, JP 3194392 describes a charge transport layer manufactured by using a liquid application formed by a monomer having a carbon-carbon double bond, a charge transport material having a carbon-carbon double bond and a binder resin. The binder resin contains a binder resin having a carbon-carbon double bond and a binder resin having no carbon-carbon double bond. That is, the binder resin having a carbon-carbon double bond reacts with the charge transport material but the binder resin having no carbon-carbon double bond does not react with the charge transport material. It is notable that this organic photoconductor has an anti-abrasion property and electric characteristics in a good combination. However, there is a tendency that when the binder non-reactive with the charge transport material is used, the compatibility between the binder resin and the cured material obtained by the reaction between the monomer mentioned above and the charge transport material is bad and therefore, phase separation tends to occur during cross-linking and leads to formation of a rough surface, which results in bad cleaning performance. In addition, as described above, the binder resin prevents curing of the monomer and since the monomers specified in the JP 3194392 have only two functional groups, the density of the cross-linking is not sufficient. Therefore, the anti-abrasion property obtained in this case is still insufficient.

In addition, even when the binder is reactive with the transport material, the number of the functional groups contained in the monomer and the binder resin is not sufficient. Therefore, it is difficult to have a good combination of the combined amount of the charge transport material and the cross-linking density and thus, the electric characteristics and anti-abrasion property are not sufficient.

For example, JOP 2000-66425 describes a photosensitive layer containing a compound cured from a positive hole transport material having at least two chain reaction polymerization functional groups.

However, this photosensitive layer contains the bulky positive hole transport material having at least two chain reaction polymerization functional groups so that the cured compound has distortion and thus the internal stress is strong. Therefore, the surface of the photosensitive layer tends to be rough and cracking easily occurs over time, meaning that the surface does not have a sufficient durability.

As an image bearing member (photoconductor) having a different charging system, for example, JOP 2001-166518 describes an image bearing member having a protective layer containing a compound cured from a positive hole transport material having at least two chain reaction polymerizable functional groups and electroconductive particulates.

However, this image bearing member is charged by infusion charging by a contact type charging device and the electric resistance of the surface layer decreases due to the electroconductive particulates which improves the mechanical strength of the surface layer. When a charger, for example, a commonly used corona charger or a contact type charging roller, is used, the electric resistance of the surface layer tends to fluctuate due to the environmental change (temperature and humidity), ozone emitted from the charger and attachment of $NO_x$ products on the surface layer, which easily causes production of abnormal images, for example, flown images.

In addition, for example, JP 3123733 describes an image bearing member containing particulates having a needle form with an aspect ratio of not less than 1:10 in the surface protective layer to improve the anti-abrasion property and the anti-damage property by a combination of (1) and (3). JOP H10-20536 also describes an image bearing member having a surface layer containing particulates having a needle form in polyurethane resins. However, the resins dispersed in these image bearing members do not have a function of charge transport. Therefore, the electric characteristics thereof are not sufficient in both image bearing members.

Similarly, for example, JOP 2005-99688 describes an image bearing member in which a cross-linking resin layer cured from at least a monomer having at least three radical polymerizable functional groups without a charge transport structure and a radical polymerizable compound having a charge transport structure serves as a surface layer and filler particulates are dispersed in the surface layer. This image bearing member is stable to environmental change and has good electric characteristics and mechanical durability. However, further improvement is demanded with regard to the durability.

In addition, full color electrophotographic apparatuses of late tend to adopt polymerized toner in terms of image quality and environment factors. As these polymerized toners become closer to spherical in shape, the sharpness of images is improved. However, such toners easily slip through the blade in the case in which a cleaning blade is adopted as a cleaning system for retrieving residual toner. This causes production of abnormal images having streaks.

The mechanism of toners close to a sphere (hereinafter referred to as 'spherical toner') slipping through a cleaning blade is considered to be that a spherical toner easily rotates between a cleaning blade and an image bearing member. Therefore, it is relatively difficult to remove such spherical toner particles in comparison with typical toner particles, which do not have a spherical form.

As a method of improving the cleaning property of spherical toner, for example, JOP 2005-107490 describes a method in which the surface energy of an image bearing member is reduced by adding silicone oil and/or fluorine particulates to a cross-linked resin layer functioning as a surface layer cured from at least a monomer having at least three radical polymerizable functional groups without a charge transport structure and a radical polymerizable compound having a charge transport structure. This image bearing member has a good combination on mechanical strength and cleaning property for a spherical toner. However, further improvement is demanded with regard to the durability and cleaning property for a spherical toner.

SUMMARY OF THE INVENTION

Because of these reasons, the present inventors recognize that a need exists for an image bearing member that has a surface layer having a good anti-abrasion property, good electric characteristics and a good cleaning property for a spherical toner, and an image forming method, an image forming apparatus and a process cartridge using the high performance image bearing member having a long life.

Accordingly, an object of the present invention is to provide an image bearing member that has a surface layer having a good anti-abrasion property, good electric characteristics and a good cleaning property for a spherical toner, and an image forming method, an image forming apparatus and a process cartridge using the high performance image bearing member having a long life.

Briefly this object and other objects of the present invention as hereinafter described will become more readily apparent and can be attained, either individually or in combination thereof, by an image bearing member including an electrostatic substrate, a photosensitive layer located overlying the electrostatic substrate, and a surface layer located overlying the photosensitive layer, wherein the surface layer is a cross-linking resin layer in which particulates having a needle form are dispersed and which is formed by curing a monomer having at least three radical polymerizable functional groups without a charge transport structure and a radical polymerizable compound having a charge transport structure.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
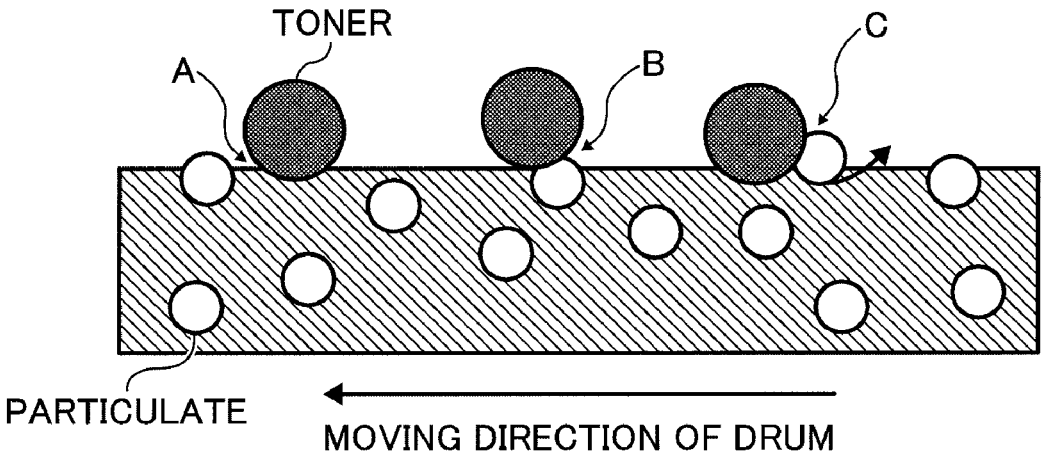
FIG. 1 is a diagram illustrating the mechanism of abrasion of the surface layer containing spherical particulates.

The present invention is detailed below with reference to accompanying drawings.

The image bearing member of the present invention has a photosensitive layer on an electroconductive substrate. Particulates having a needle form are dispersed in the surface layer of the photosensitive layer. The surface layer is a cross-linked resin layer cured from a monomer having at least three radical polymerizable functional groups without a charge transport structure and a radical polymerizable compound having a charge transport structure.

It is preferred that, in the image bearing member mentioned above, the radical polymerizable compound having a charge transport structure has a single functional group.

It is still further preferred that, in the image bearing member mentioned above, the particulates having a needle form is aluminum oxide.

It is still further preferred that, in the image bearing member mentioned above, the radical polymerizable compound having a charge transport structure has a single functional group.

It is still further preferred that, in the image bearing member mentioned above, the functional group of the monomer having at least three radical polymerizable functional groups without a charge transport structure is at least one of an acryloyloxy group and a methacryloyloxy group.

Chemical structure 1

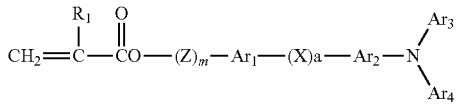

Chemical structure 2

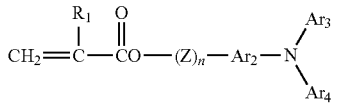

wherein $R_1$ represents hydrogen atom, a halogen atom, a substituted or non-substituted alkyl group, a substituted or non-substituted aralkyl group, an aryl group, cyano group, nitro group or a substituted or non-substituted alkoxy group, or —$COOR_7$ ($R_7$ represents hydrogen atom, a substituted or non-substituted alkyl group, a substituted or non-substituted aralkyl group, or a substituted or non-substituted aryl group); a halogenated carbonyl group or $CONR_8R_9$ ($R_8$ and $R_9$ independently represent hydrogen atom, a halogen atom, a substituted or non-substituted alkyl group, a substituted or non-substituted aralkyl group, or a substituted or non-substituted aryl group); $Ar_1$ and $Ar_2$ independently represent a substituted or unsubstituted arylene group; $Ar_3$ and $Ar_4$ independently represent a substituted or unsubstituted aryl group; X represents a substituted or non-substituted alkylene group, a substituted or non-substituted cycloalkylene group, a substituted or non-substituted alkylene ether divalent group, oxygen atom, sulfur atom, or vinylene group; Z represents a substituted or non-substituted alkylene group, a substituted or non-substituted alkylene ether divalent group or an alkyleneoxy carbonyl divalent group; a represents 0 or 1 and m and n independently represent 0 or an integer of from 1 to 3.

It is still further preferred that, in the image bearing member mentioned above, the radical polymerizable compound having a charge transport structure and a single functional group is at least one of polymerizable compounds represented by the following chemical structure 3:

Chemical structure 3

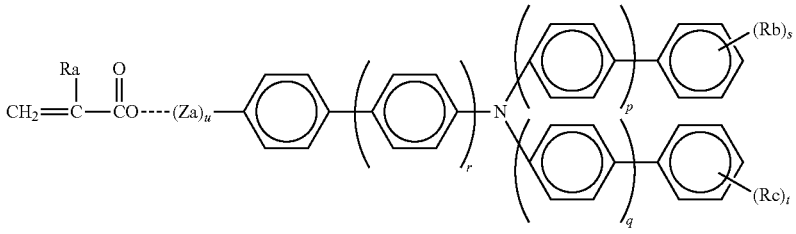

It is still further preferred that, in the image bearing member mentioned above, the functional group of the radical polymerizable compound having a charge transport structure is at least one of an acryloyloxy group and a methacryloyloxy group.

It is still further preferred that, in the image bearing member mentioned above, the structure of the radical polymerizable compound having a charge transport structure is a triaryl amine structure.

It is still further preferred that, in the image bearing member mentioned above, the radical polymerizable compound having a charge transport structure and one functional group is at least one of polymerizable compounds represented by the following chemical structures 1 and 2:

wherein u, r, p, q represent 0 or 1, s and t independently represent 0 or an integer of from 1 to 3, Ra represents hydrogen atom or methyl group, each of Rb and Rc independently represents an alkyl group having 1 to 6 carbon atoms, and Za represents methylene group, ethylene group, —$CH_2CH_2O$—, —$CHCH_3CH_2O$—, or —$C_6H_5CH_2CH_2$—.

It is still further preferred that, in the image bearing member mentioned above, the surface layer is cured by heat or an optical energy irradiation device.

As another aspect of the present invention, an image forming apparatus is provided which includes the image bearing member mentioned above.

As another aspect of the present invention, a process cartridge is provided which includes the image bearing member mentioned above and at least one device selected from the group consisting of a charging device, a developing device, a transfer device, a cleaning device and a discharging device. The process cartridge is detachably attached to the main body of an image forming apparatus.

The image bearing member of the present invention has a good anti-abrasion property and can produce quality images for a long period of time. The reasons are as follows:

The image bearing member of the present invention uses a radical polymerizable monomer having at least three functional groups so that three-dimensional network structure is developed and thus the cross-linked surface layer has an extremely high cross-linking ratio with a high hardness and obtains a high anti-abrasion property. To the contrary, when a monomer having one or two radical polymerizable functional groups is used, the cross-linking bonding is thin in the cross-linked surface layer and thus the anti-abrasion property is not improved. When a polymer material is contained in the cross-linked surface layer, the three-dimensional network structure is not developed. Thus, the cross-linking ratio is reduced and the anti-abrasion property is not sufficient in comparison with the present invention. Furthermore, the compatibility between the polymer material and the cured compound made from the reaction of a radical polymerizable composition (radical polymerizable monomers and radical polymerizable compounds having a charge transport structure) is bad, which causes local phase separation and results in abrasion and surface damage.

In the formation of the cross-linked surface layer of the present invention, a radical polymerizable compound having a charge transport structure in addition to the monomer mentioned above having at least three radical polymerizable functional groups are contained. The radical polymerizable compound having a charge transport structure is taken into the cross-linking during the curing of the monomer mentioned above having at least three radical polymerizable functional groups. By contrast, when a charge transport material having a low molecular weight having no functional group is contained in a cross-linked surface layer, the charge transport material having a low molecular weight tends to precipitate and cause white turbidity due to its low compatibility. The mechanical strength of the cross-linked surface layer deteriorates.

The cross-linked surface layer of the image bearing member of the present invention contains particulates having a needle form. To compare the present invention with background art, the mechanism of the abrasion of a layer containing particulates having a spherical form in an actual machine, which is described in JOP 2005-99688, is described with reference to FIG. 1.

In the area (A) in which no particulate exists, the resin portion is abraded. As the abrasion is advanced, the resin portion starts to disappear and a spherical particulate appears to the surface of an image bearing member. In the area (B) in which a particulate having a spherical form exists, the spherical particulate is not abraded since the spherical particulate relatively hard in comparison with the resin portion. The resin portion around the spherical particulate is abraded. However, the spherical particulate functions as steric obstruction to the resin portion and the speed of abrasion is slow. As the abrasion of the resin portion around the spherical particulate is gradually advanced, the spherical particulate extrudes as illustrated in (C) and is dug out of the layer. That is, a phenomenon that the resin portion is gradually abraded and the spherical particulate extrudes and is detached from the layer is repeated.

Figure 2:
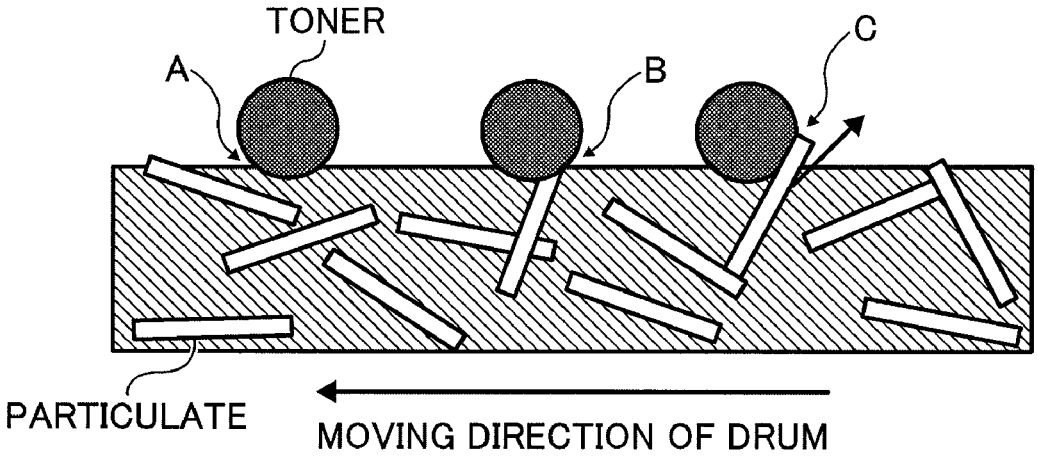
FIG. 2 is a diagram illustrating the mechanism of abrasion of the surface layer containing particulates having a needle form.

By contrast, the mechanism of the abrasion of a layer containing particulates having a needle form in an actual machine is described with reference to FIG. 2.

With regard to the areas (A) and (B), the same is applied as in the case of FIG. 1. In the area (C), the resin portion around the particulate having a needle form is gradually abraded and the particulate having a needle form extrudes and is dug out. In comparison with the case of the spherical particulate illustrated in FIG. 1, the particulate having a needle form is hard to be dug out because of its form so that the mechanical strength of a cross-linked surface layer using particulates having a needle form is improved in comparison with the case of a cross-liking surface layer using a spherical particulate.

Furthermore, this is effective to improve the cleaning property of a spherical toner. Spherical toner slips through a cleaning blade while rotating between the cleaning blade and an image bearing member. In the case of the image bearing member, it is found that particulates having a needle form extruding from the surface of the image bearing member prevent a spherical toner particle from rotating so that the amount of toner slipping through a cleaning blade decreases.

Next, the composition materials of liquid application for the cross-linked surface layer of the image bearing member of the present invention are described.

Monomer Having at Least Three Radical Polymerizable Functional Groups without a Charge Transport Structure The monomer having at least three radical polymerizable functional groups without a charge transport structure for use in the present invention is, for example, a monomer having at least three radical polymerizable functional groups which does not have a positive hole transport structure, such as the positive hole transport structure of triarylamine, hydrazone, pyrazoline or carbazole, or which does not have an electron transport structure, such as the electron transport structure of an electron-attracting aromatic ring having condensed polycyclic quinone, diphenoquinone, cyano group, or nitro group. Any radical polymerizable functional group having a carbon-carbon double bond and capable of undergoing a radical polymerization reaction can be used.

Specific examples of these radical polymerizable functional groups include, but are not limited to, 1-ethylene substituted functional groups, and 1,1-substituted ethylene functional groups as follows:

Specific examples of the 1-substituted ethylene functional group include, but are not limited to, functional groups represented by the following chemical formula (i): $CH_2{=}CH{-}X_1{-}$ Chemical formula (i), in the chemical formula (i), $X_1$ represents a substituted or non-substituted arylene group, for example, phenylene group, or naphthylene group, a substituted or non-substituted alkenylene group, CO group, COO group, $CON(R_{10})$ group ($R_{10}$ represents a hydrogen atom, an alkyl group, for example, methyl group or ethyl group, or an aralkyl group, for example, benzyl group, naphthylmethyl group or phenethyl group, or an aryl group, for example, phenyl group or naphthyl group), or an S group.

Specific examples of these substituent groups include, but are not limited to, vinyl group, styryl group, 2-methyl-1,3-butadienyl group, vinylcarbonyl group, acryloyloxy group, acryloylamide group, and vinylthioether group.

Examples of the 1,1-substituted ethylene functional group include, but are not limited to, functional groups represented by the following chemical formula (ii): $CH_2{=}CH(Y){-}X_2{-}$ Chemical formula (ii)

In the chemical formula (ii), Y represents a substituted or non-substituted alkyl group, a substituted or non-substituted aralkyl group, a substituted or non-substituted aryl group, for example, phenyl group and naphthyl group, a halogen atom, or an alkoxy group, for example, cyano group, nitro group, methoxy group or ethoxy group, $COOR_{11}$ ($R_{11}$ represents a hydrogen atom, a substituted or non-substituted alkyl group, for example, methyl group or ethyl group; a substituted or non-substituted aralkyl group, for example, benzyl group or phenethyl group, or a substituted or non-substituted aryl group, for example, phenyl group or naphthyl group), or $CONR_{12}R_{13}$ ($R_{12}$ and $R_{13}$ independently represent a hydrogen atom, a substituted or non-substituted alkyl group, for example, methyl group or ethyl group, a substituted or non-substituted aralkyl group, for example, benzyl group, naphthylmethyl group or phenethyl group, or a substituted or non-substituted aryl group, for example, phenyl group or naphthyl group). $X_2$ represents the same substituent group as $X_1$, a single bond or an alkylene group. At least either of Y and $X_2$ is an oxycarbonyl group, cyano group, an alkenylene group or an aromatic ring.

Specific examples of these substituent groups include, but are not limited to, α-acryloyloxy chloride group, methacryloyloxy group, α-cyanoethylene group, α-cyanoacryloyloxy group, α-cyanophenylene group, and methacryloylamino group.

Examples of substituent groups that are furthermore substituted in the substituent group of $X_1$, $X_2$, or Y include, but are not limited to, an alkyl group, for example, a halogen atom, nitro group, cyano group, methyl group or ethyl group; an alkoxy group, for example, methoxy group, and ethoxy group; an aryloxy group, for example, phenoxy group; an aryl group, for example, phenyl group and naphthyl group; and an aralkyl group, for example, benzyl group and phenethyl group.

Among these radical polymerizable functional groups, acryloyloxy group, and methacryloyloxy group are particularly effective, and a compound having three or more acryloyloxy groups can be obtained by conducting, for example, an ester reaction or an ester exchange reaction of a compound having 3 or more hydroxyl groups in the molecule, an acrylic acid (salt), an acrylic acid halide, and an acrylic acid ester. A compound having 3 or more methacryloyl groups can also be obtained in the same manner. The radical polymerizable functional groups in the monomer having 3 or more radical polymerizable functional groups may be the same or different from each other.

Specific examples of the monomer having at least three radical polymerizable functional groups without a charge transport structure include, but are not limited to, the following compounds.

Specific examples of the monomer having at least three radical polymerizable functional groups for use in the present invention include, but are not limited to, trimethylolpropane triacrylate (TMPTA), trimethylolpropane trimethacrylate, HPA modified trimethylolpropane triacrylate, trimethylol propane ethylene oxy-modified (Eo-modified) triacrylate, trimethylolpropane propyleneoxy-modified (PO-modified) triacrylate, trimethylolpropane caprolactone-modified triacrylate, trimethylolpropane HPA-modified trimethacrylate, pentaerythritol triacrylate, pentaerythritol tetraacrylate (PETTA), glycerol triacrylate, glycerol epichlorohydrine-modified (ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritol ethoxytetraacrylate, phosphoric acid EO-modified triacrylate, and 2,2,5,5-tetrahydroxymethyl cyclopentanone tetraacrylate. These can be used alone or in combination.

With regard to the monomer having at least three radical polymerizable functional groups without a charge transport structure for use in the present invention, the ratio of molecular weight relative to the number of functional groups (molecular weight/the number of functional group) in the monomer is preferably from 250 or less to form a dense cross-linking bond in the cross-linked surface layer. When the ratio is excessively great, the cross-linked surface layer is soft and thus the abrasion resistance is degraded in some degree. Therefore, it is not suitable to single out a compound having an extremely long modified group for use among the monomers having a modified group, for example, HPA-modified, EO-modified and PO-modified group.

The content of the monomer having at least three radical polymerizable functional groups without a charge transport structure contained in the cross-linked surface layer in the solid content of the liquid composition is adjusted such that the component ratio thereof is from 20 to 80% by weight, and preferably from 30 to 70% by weight based on the total amount of the cross-linked surface layer. When the content of the monomer component is too small, the three dimensional cross-linked bonding density of the cross-linked surface layer tends to be low. Also the abrasion resistance is not significantly improved in comparison with the case where a typical thermoplastic binder resin is used. When the content of the monomer is too great, the content of the charge transport compound tends to decrease, which causes degradation of electric properties. It is difficult to jump to any conclusion but considering a good combination of the abrasion resistance and the electric characteristics, the content of the monomer preferably ranges from 30 to 70% by weight. Radical Polymerizable Compound Having A Charge Transport Structure The radical polymerizable functional compound without a charge transport structure for use in the present invention represents a radical polymerizable functional compound having a radical polymerizable functional group and, for example, a positive hole transport structure, such as triarylamine, hydrazone, pyrazoline, and carbazole, and an electron-transport structure, such as electron-attracting aromatic ring having condensed polycyclic quinone, diphenoquinone, cyano group, and nitro group. Specific examples of the radical polymerizable functional group include the monomers having radical polymerizable functional groups described above. Acryloyloxy groups and methacryloyloxy groups are particularly preferred. As a charge transport structure, triaryl amine structure is highly effective and a compound having one functional group is preferred. Furthermore, when a compound represented by a chemical structure 1 or 2 is used, the electric characteristics, for example, sensitivity and residual voltage, are suitably maintained.

Chemical structure 1

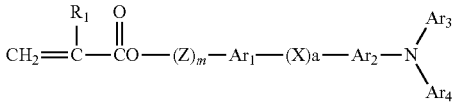

Chemical structure 2

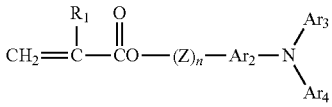

In the chemical structures (1) and (2), $R_1$ represents hydrogen atom, a halogen atom, an alkyl group, an aralkyl group, an aryl group, a cyano group, a nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ each, independently, represent hydrogen atom, a halogen atom, a substituted or non-substituted alkyl group, a substituted or non-substituted aralkyl group or a substituted or non-substituted aryl group, $Ar_1$ and $Ar_2$ each, independently represent a substituted or unsubstituted arylene group, $Ar_3$ and $Ar_4$ each, independently, represent a substituted or unsubstituted aryl group, X represents a substituted or non-substituted alkylene group, a substituted or non-substituted cycloalkylene group, a substituted or non-substituted alkylene ether group, oxygen atom, sulfur atom or vinylene group, Z represents a substituted or non-substituted alkylene group, a substituted or non-substituted alkylene ether divalent group or an alkyleneoxy carbonyl divalent group, a represents 0 or 1 and m and n, each, independently, represent 0 or an integer of from 1 to 3.

In the chemical structures (1) and (2), in the substituent group of $R_1$, specific examples of the alkyl groups include, but are not limited to, methyl group, ethyl group, propyl group, and butyl group; specific examples of the aryl groups include, but are not limited to, phenyl group and naphthyl group; specific examples of the aralkyl groups include, but are not limited to, benzyl group, phenethyl group and naphthylmethyl group; specific examples of the alkoxy group include, but are not limited to, methoxy group, ethoxy group, and propoxy group. These groups can be substituted by a halogen atom; nitro group; cyano group; an alkyl group, for example, methyl group and ethyl group; an alkoxy group, for example, methoxy group and ethoxy group; an aryloxy group, for example, phenoxy group; an aryl group, for example, phenyl group and naphthyl group; or an aralkyl group, for example, benzyl group and phenethyl group.

Among the substituent groups of $R_1$, hydrogen atom, and methyl group are particularly preferred.

Substituted or unsubstituted $Ar_3$ and $Ar_4$ are aryl groups, and specific examples thereof include, but are not limited to, condensed polycyclic hydrocarbon groups, non-condensed cyclic hydrocarbon groups, and heterocyclic groups.

Preferred specific examples of the condensed polycyclic hydrocarbon group include, but are not limited to, groups in which the number of the carbon atoms forming a ring is 18 or less. Specific examples thereof include, but are not limited to, pentanyl group, indenyl group, naphthyl group, azulenyl group, heptalenyl group, biphenylenyl group, as (asym)-indacenyl group, s(sym)-indacenyl group, fluorenyl group, acenaphthylenyl group, pleiadenyl group, acenaphtenyl group, phenalenyl group, phenanthryl group, anthryl group, fluoranthenyl group, acephenantolylenyl group, aceanthrylenyl group, triphenylel group, pyrenyl group, chrysenyl group and naphthacenyl group.

Specific examples of the uncondensed cyclic hydrocarbon groups include, but are not limited to, monovalent groups derived from benzene, diphenyl ether, polyethylene diphenyl ether, diphenyl thioether, diphenyl sulfone, biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene. In addition, monovalent groups derived from polycyclic hydrocarbons such as 9,9-diphenyl fluorene can also be used.

Specific examples of the heterocyclic groups include, but are not limited to, monovalent groups derived from carbazole, dibenzofuran, dibenzothiophene, oxadiazole, thiazole, etc.

The aryl groups represented by $Ar_3$ and $Ar_4$ may preferably have the following substituent groups.

(1) A halogen atom, cyano group, nitro group, etc.

(2) A straight-chain or branched-chain alkyl group having 1 to 12 carbon atoms, more preferably 1 to 8 carbon atoms, and much more preferably 1 to 4 carbon atoms, which may substituted with fluorine atom; hydroxyl group; cyano group; an alkoxy group having 1 to 4 carbon atoms; or a phenyl group substituted with a halogen atom, an alkyl group having 1 to 4 carbon atoms, or an alkoxy group having 1 to 4 carbon atoms. Specific examples of the alkyl groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group.

(3) An alkoxy group (—$OR_2$, wherein $R_2$ represents an alkyl group defined in the paragraph (2)). Specific examples of the alkoxy groups include, but are not limited to, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) An aryloxy group. Specific examples of the aryl groups include, but are not limited to, phenyl group and naphthyl group. The aryloxy group can be substituted with an alkoxy group having 1 to 4 carbon atoms, an alkyl group having 1 to 4 carbon atoms, or a halogen atom. Specific examples of the aryloxy groups include, but are not limited to, phenoxy group, 1-naphthyloxy group, 2-naphthyloxy group, 4-methoxyphenoxy group, and 4-methylphenoxy group.

(5) An alkylmercapto group or an arylmercapto group. Specific examples of these groups include, but are not limited to, methylthio group, ethylthio group, phenylthio group, and p-methylphenylthio group.

(6) A substituent group represented by the following chemical formula:

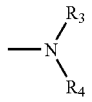

wherein each of $R_3$ and $R_4$ independently represents a hydrogen atom, an alkyl group defined in the paragraph (2), or an aryl group (e.g., phenyl group, biphenyl group, naphthyl group) which can be substituted with an alkoxy group having 1 to 4 carbon atoms, an alkyl group having 1 to 4 carbon atoms, or a halogen atom; and wherein $R_3$ and $R_4$ optionally share bond connectivity to form a ring. Specific examples of the substituent groups mentioned above include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) An alkylenedioxy group and an alkylenedithio group such as methylenedioxy group and methylenedithio group.

(8) A substituted or unsubstituted styryl group, a substituted or unsubstituted β-phenyl styryl group, diphenyl aminophenyl group, dinitrile aminophenyl group, etc.

Specific examples of the arylene groups represented by $Ar_9$ and $Ar_{10}$ include, but are not limited to, divalent groups derived from the aryl groups represented by $Ar_{11}$ and $Ar_{12}$.

X represents a single bond, a substituted or unsubstituted alkylene group, a substituted or unsubstituted cycloalkylene group, a substituted or unsubstituted alkylene ether group, an oxygen atom, a sulfur atom, or a vinylene group.

The substituted or unsubstituted alkylene group is a straight-chained or branched-chain alkylene group having 1 to 12 carbon atoms, preferably 1 to 8 carbon atoms, and more preferably 1 to 4 carbon atoms. These alkylene groups may have a fluorine atom, a hydroxyl group, a cyano group, an alkoxy group having 1 to 4 carbon atoms, a phenyl group, or a phenyl group substituted with a halogen atom, an alkyl group having 1 to 4 carbon atoms, or an alkoxy group having 1 to 4 carbon atoms. Specific examples of the substituted or unsubstituted alkylene groups include, but are not limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group.

The substituted or non-substituted cycloalkylene group is a cyclic alkylene group having 5 to 7 carbon atoms which may have a fluorine atom, a hydroxyl group, an alkyl group having 1 to 4 carbon atoms, or an alkoxy group having 1 to 4 carbon atoms. Specific examples of the substituted or non-substituted cycloalkylene groups include, but are not limited to, cyclohexylidene group, cyclohexylene group, and 3,3-dimethylcyclohexylidene group.

Specific examples of the substituted or non-substituted alkylene ether groups include, but are not limited to, ethyleneoxy group, propyleneoxy group, ethylene glycol, propylene glycol, diethylene glycol, tetraethylene glycol, and tripropylene glycol. The alkylene group of the alkylene ether group may have a substituent group, for example, a hydroxyl group, a methyl group, and an ethyl group.

Specific examples of the vinylene groups include, but are not limited to, the following substituent groups:

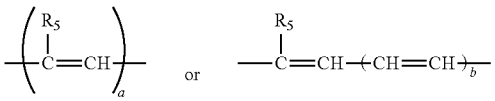

$R_5$ represents a hydrogen atom, an alkyl group (same as defined in the paragraph (2)), or an aryl group (same aryl groups as represented by $Ar_3$ and $Ar_4$); a represents an integer of 1 or 2; and b represents an integer of from 1 to 3.

Z represents a substituted or unsubstituted alkylene group, a substituted or non-substituted alkylene ether group, or an alkyleneoxycarbonyl group.

Examples of the substituted or unsubstituted alkylene group include, but are not limited to, the same alkylene groups as those described in the X.

Examples of the substituted or non-substituted alkylene ether divalent group include, but are not limited to, the same alkylene ether groups as those described in the X.

Examples of the alkyleneoxycarbonyl group include, but are not limited to, caprolactone-modified groups.

As the monomers having a radical polymerizable functional group with a charge transport structure for use in the present invention, compounds represented by the following chemical structure 3 are preferably used.

Chemical structure 3

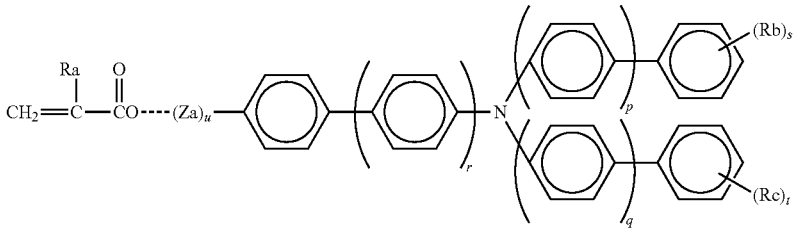

In the chemical structure 3, u, r, p, q each, independently, represent 0 or 1, s and t each, independently, represent 0 or an integer of from 1 to 3, Ra represents hydrogen atom or methyl group, each of Rb and Rc independently represents an alkyl group having 1 to 6 carbon atoms, and Za represents methylene group, ethylene group, —$CH_2CH_2O$—, —$CHCH_3CH_2O$—, or —$C_6H_5CH_2CH_2$—.

The radical polymerizable compound for use in the present invention having a functional group with a charge transport structure represented by the chemical structures 1, 2 and especially 3 is polymerized in such a manner that the double linkage of C and C is open to both ends. Therefore, the radical polymerizable compound is not present at the end but in the chained polymer. In a polymer in which a cross linking chain is formed with a radical polymerizable monomer having at least 3 functional groups, the radical polymerizable compound is present in the main chains of the polymer and in a cross linking chain. There are two kinds of cross linking chains. One is referred to as inter-molecule cross linking, in which the cross linking chain is formed between a polymer and another polymer. The other is referred to as internal cross linking, in which the cross linking chain is formed between a portion in the main chain present in a polymer formed in a folded state and another portion deriving from the monomer which is polymerized at a position remote from that portion in the main chain. Whether the radical polymerizable monomer having at least 3 functional groups is present in a main chain or in a cross linking chain, the preferred triaryl amine structure suspending from the chain portion has at least three aryl groups disposed in the radial directions from the nitrogen atom therein. Such a triaryl amine structure is bulky and does not directly bind with the chain portion but suspends from the chain portion via a carbonyl group, etc. That is, the triaryl amine structure is stereoscopically fixed in the polymer in a flexible state. Therefore, these triaryl amine structures can be adjacent to each other with a moderate space in a polymer. Therefore, the structural distortion in a molecule is slight. In addition, when the structure is used in the surface layer of an image bearing member, it can be deduced that the internal molecular structure can have a structure in which there are relatively few disconnections in the charge transport route.

Radical Polymerizable Compound Having a Functional Group with a Charge Transport Structure
Specific examples of the radical polymerizable compound having a functional group with a charge transport structure include, but are not limited to, the following:
No. 1
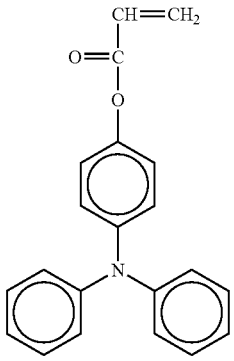
No. 2
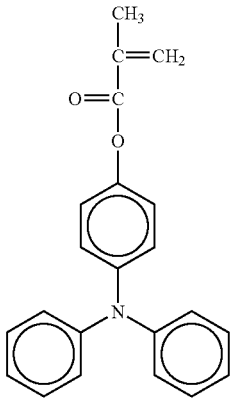
No. 3
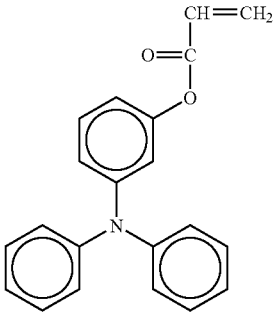
No. 4
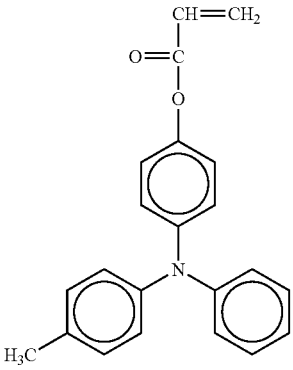
-continued
No. 5
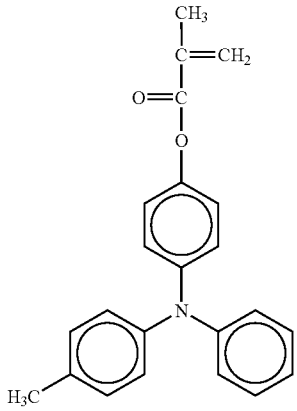
No. 6
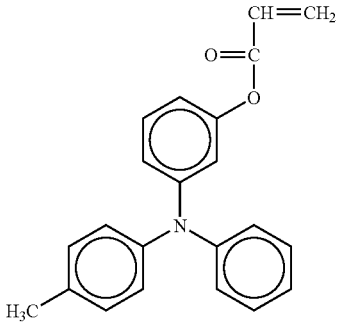
No. 7
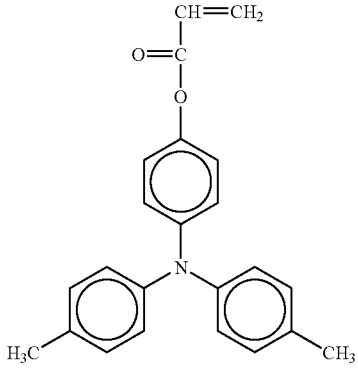
No. 8
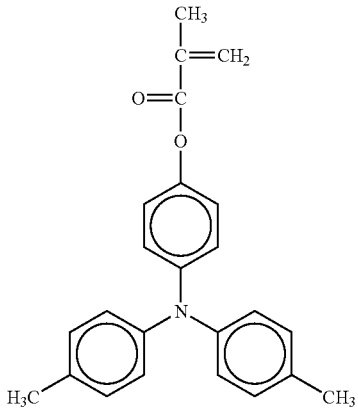

-continued
No. 9
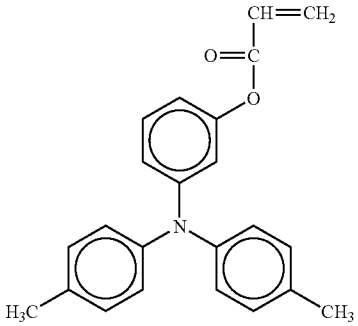
No. 10
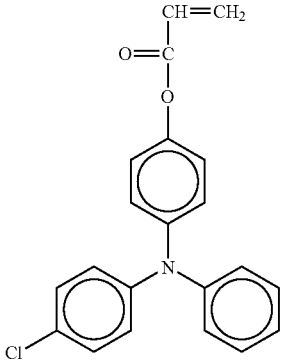
No. 11
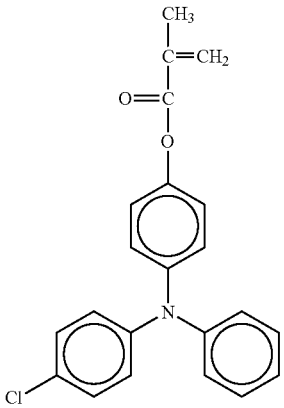
No. 12
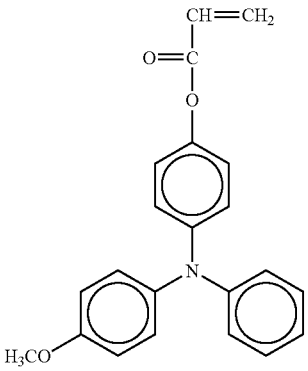
-continued
No. 13
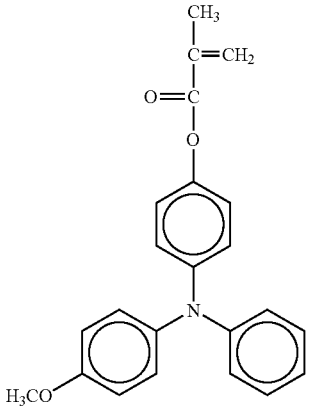
No. 14
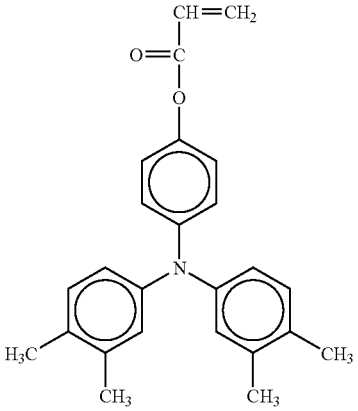
No. 15
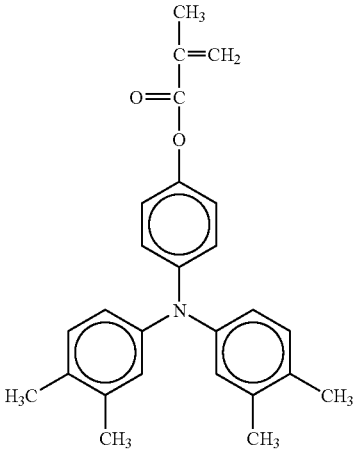
No. 16
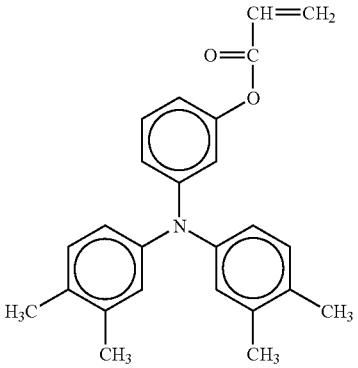

-continued
No. 17
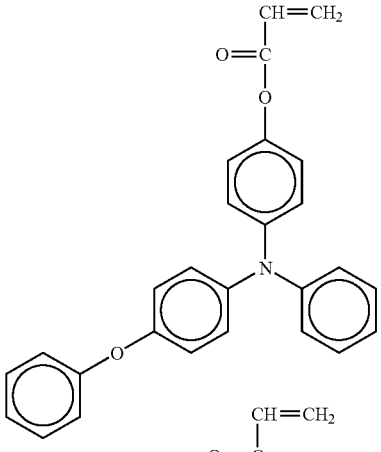
No. 18
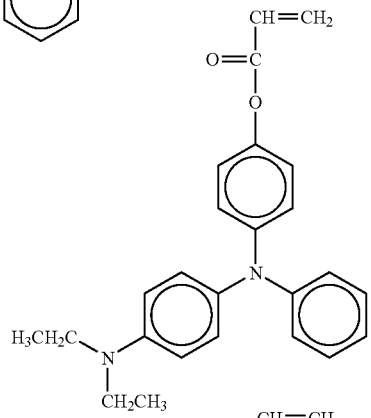
No. 19
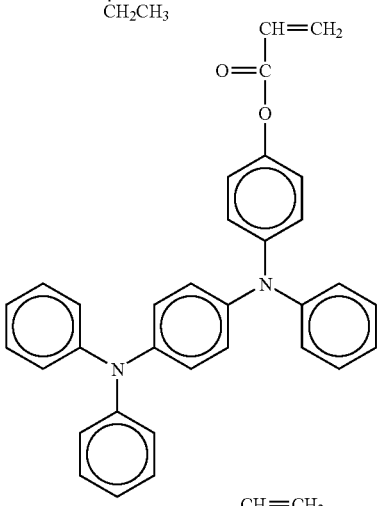
No. 20
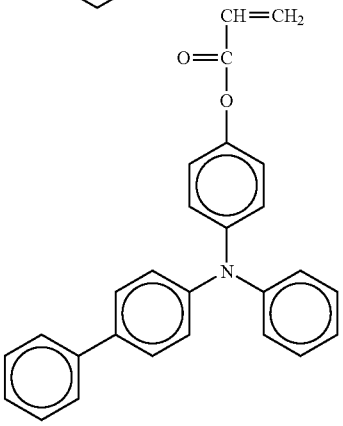
-continued
No. 21
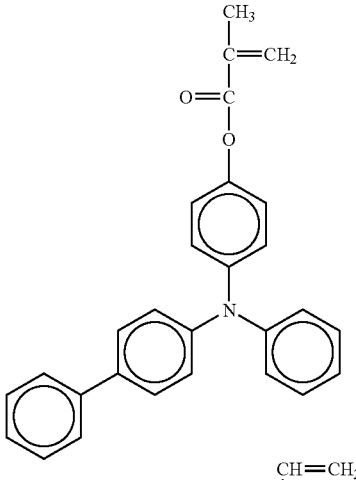
No. 22
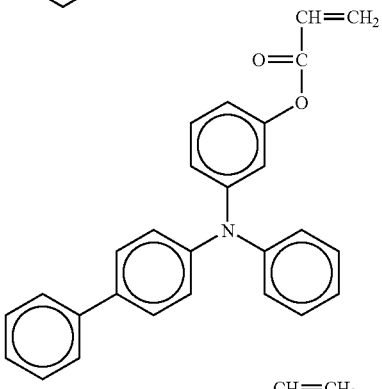
No. 23
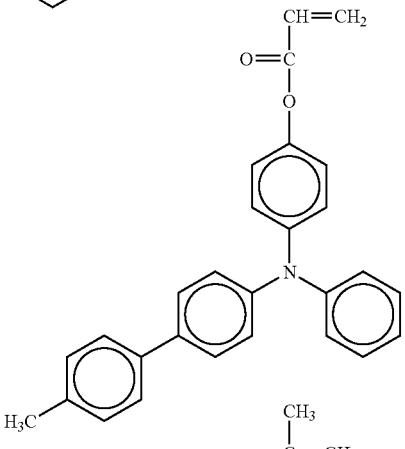
No. 24
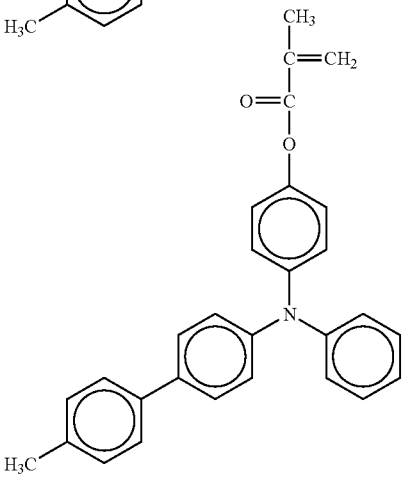

-continued
No. 25
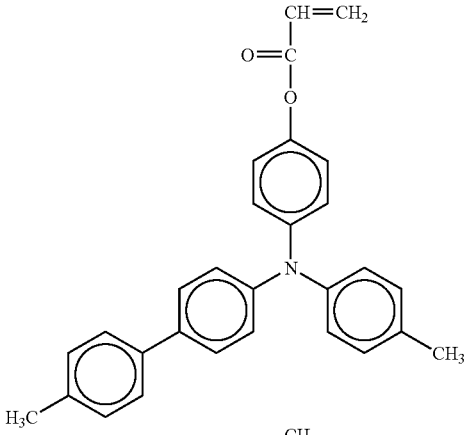
No. 26
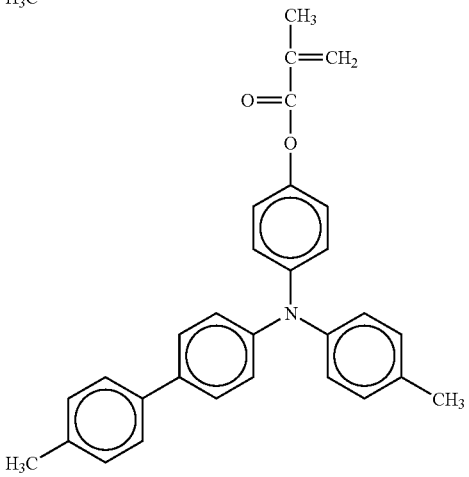
No. 27
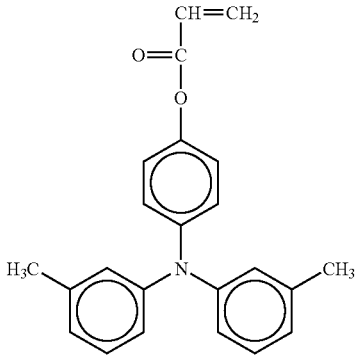
No. 28
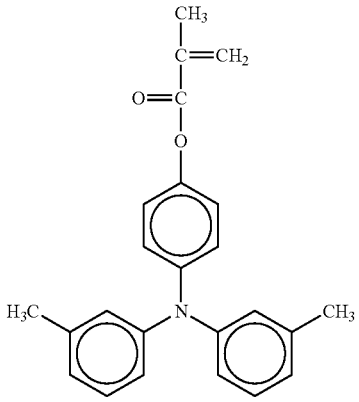
-continued
No. 29
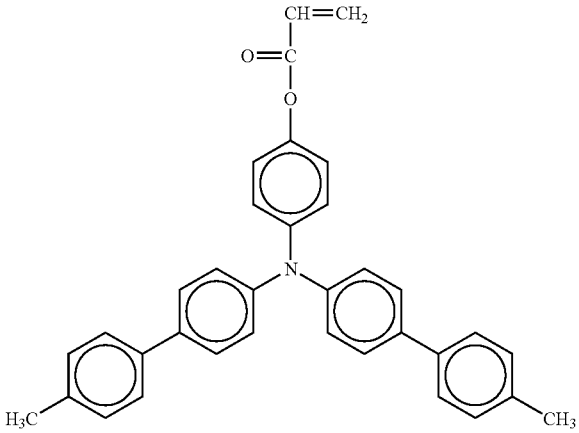
No. 30
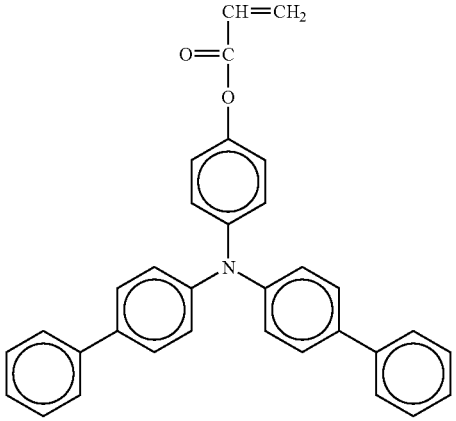
No. 31
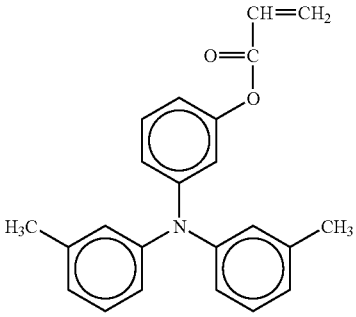
No. 32
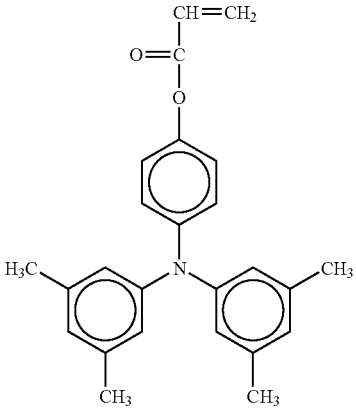

-continued
No. 33
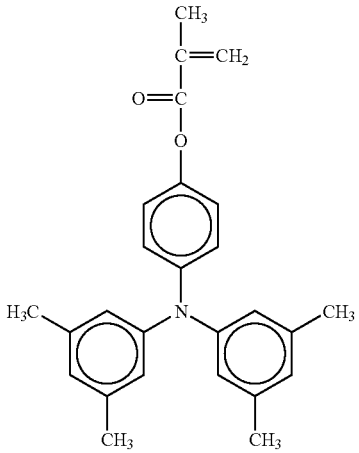
No. 34
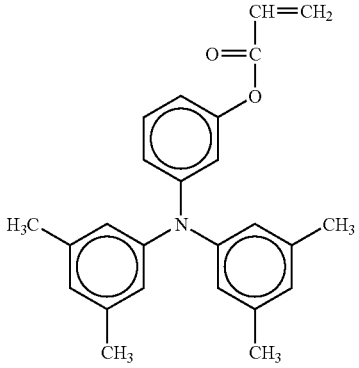
No. 35
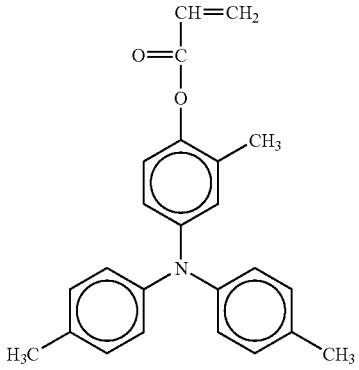
No. 36
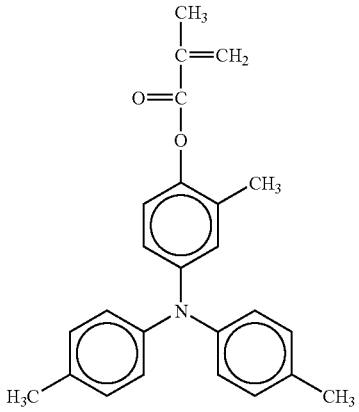
-continued
No. 37
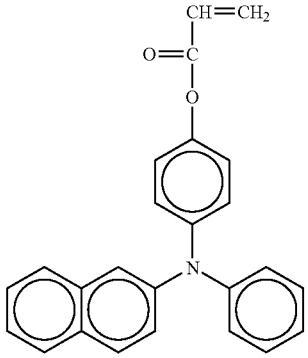
No. 38
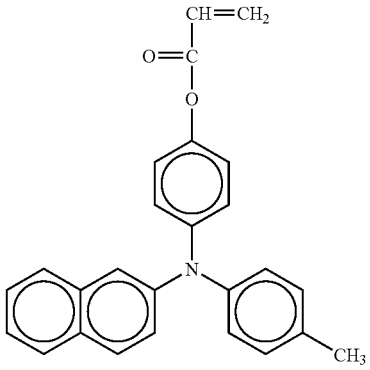
No. 39
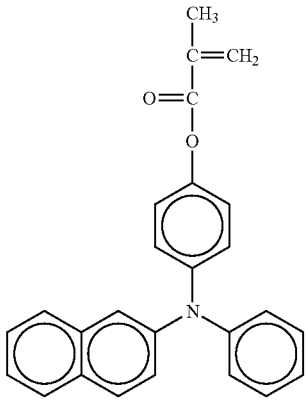
No. 40
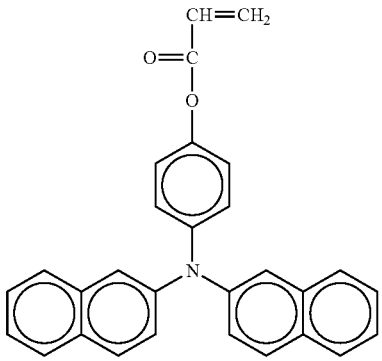

-continued
No. 41
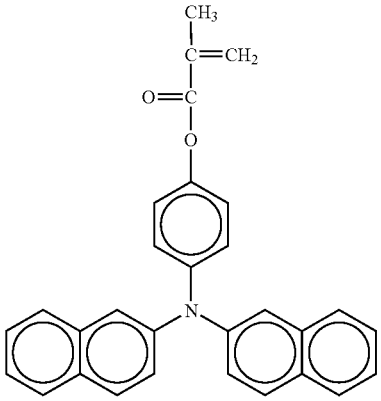
No. 42
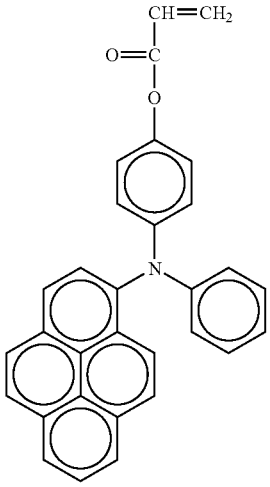
No. 43
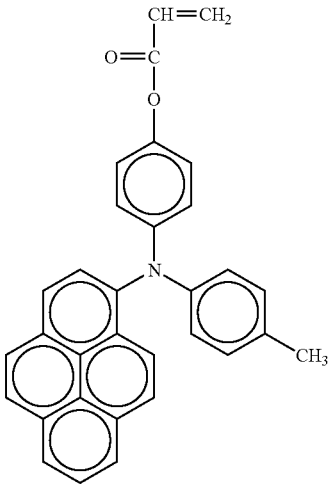
-continued
No. 44
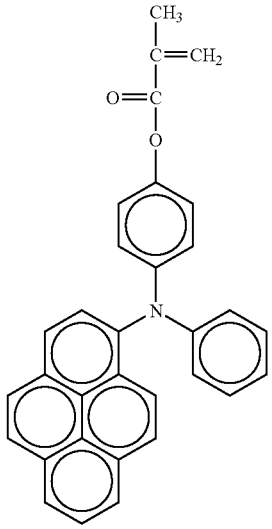
No. 45
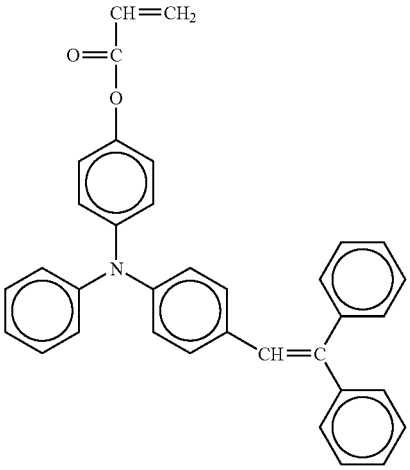
No. 46
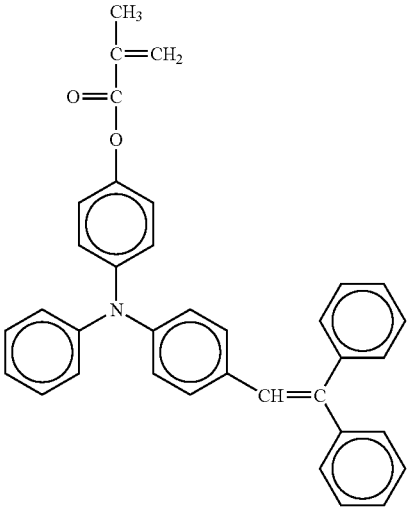

-continued
No. 47
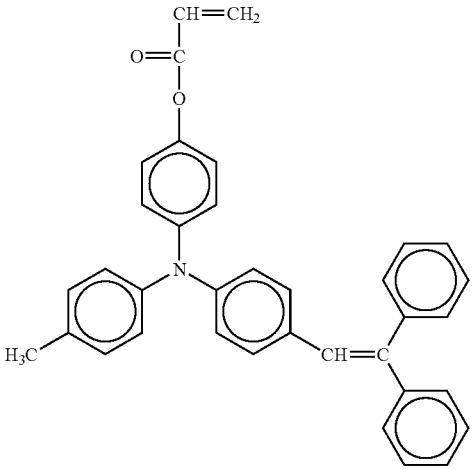
No. 48
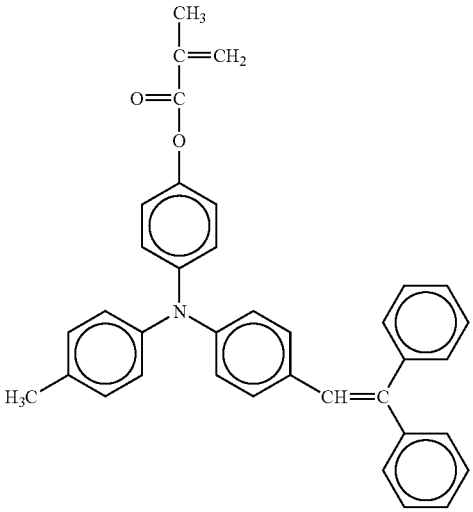
No. 49
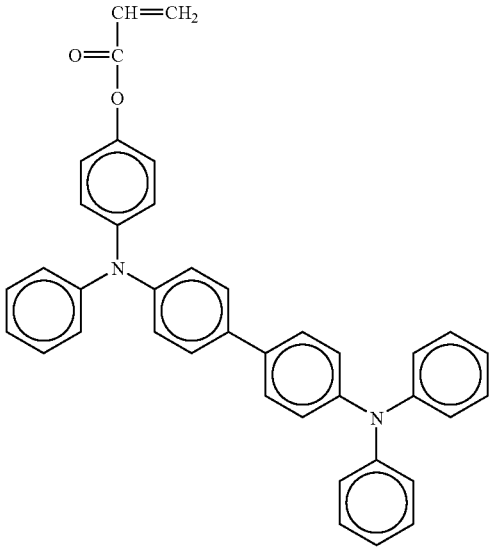
-continued
No. 50
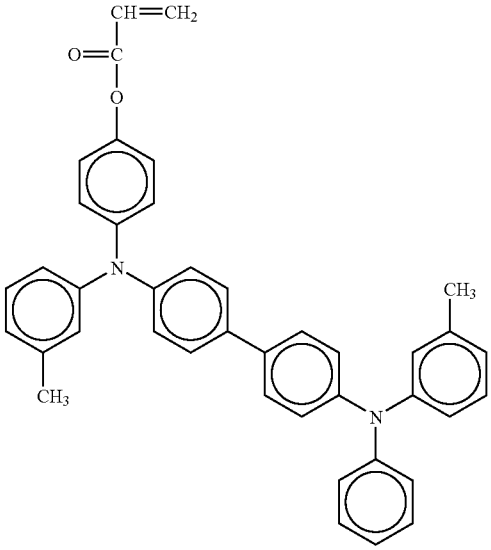
No. 51
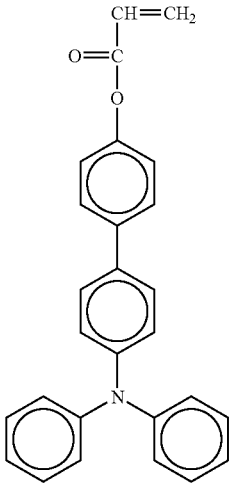
No. 52
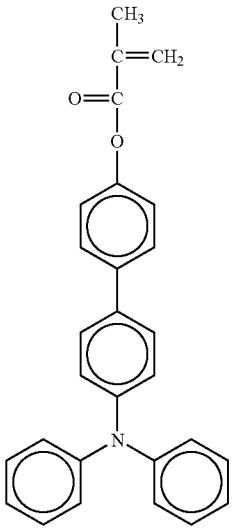

-continued
No. 53
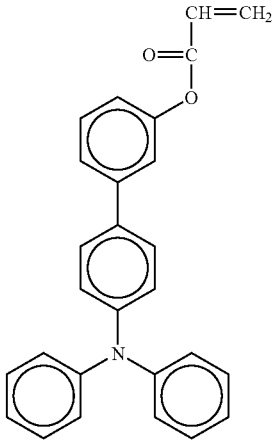
No. 54
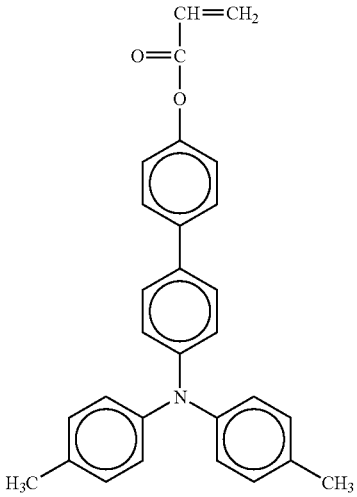
No. 55
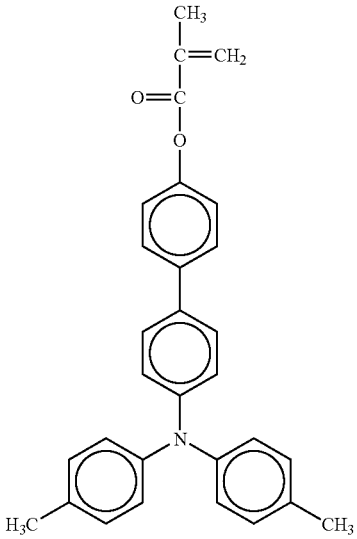
-continued
No. 56
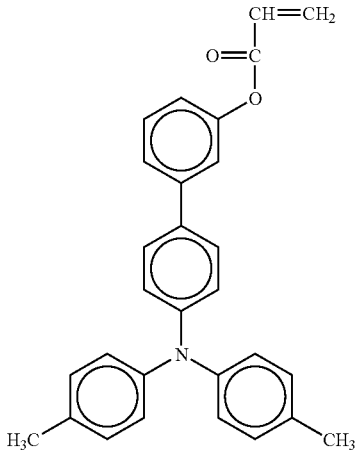
No. 57
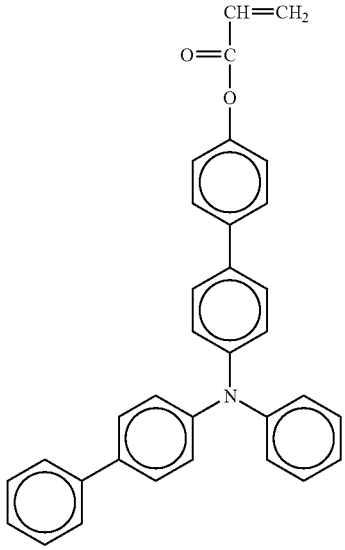
No. 58
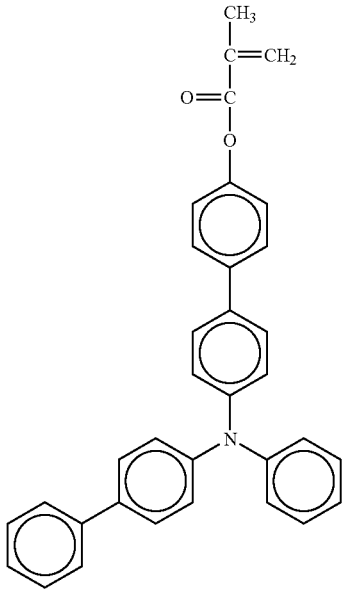

-continued
No. 59
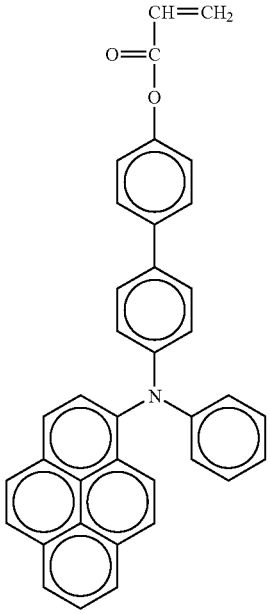
No. 60
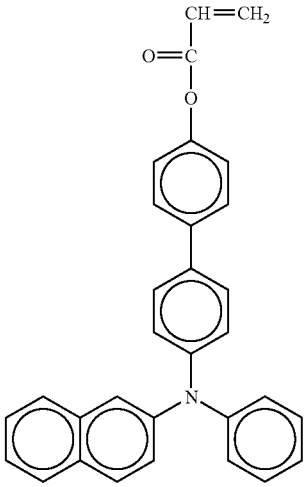
No. 61
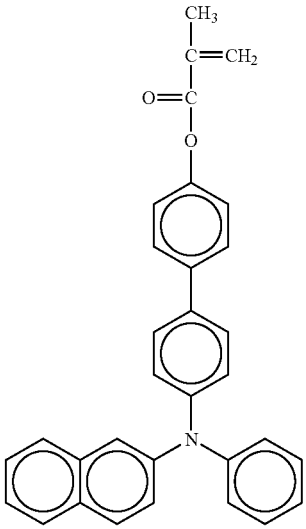
-continued
No. 62
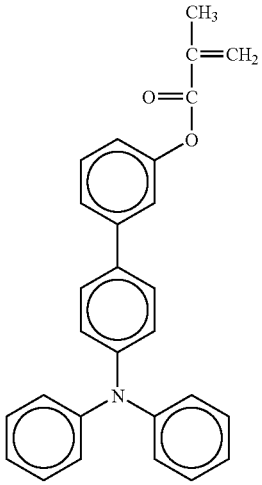
No. 63
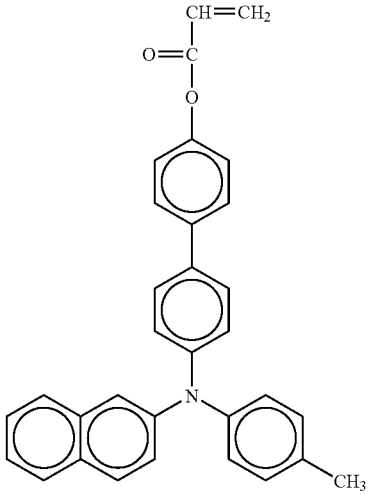
No. 64
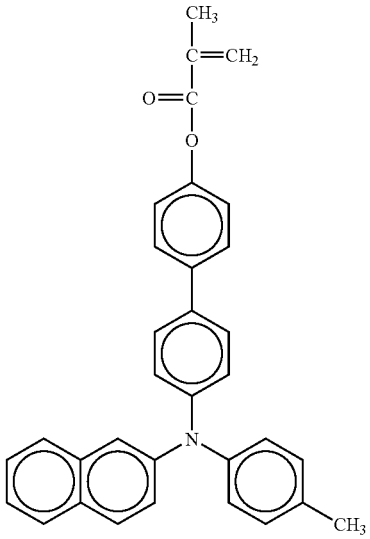

-continued
No. 65
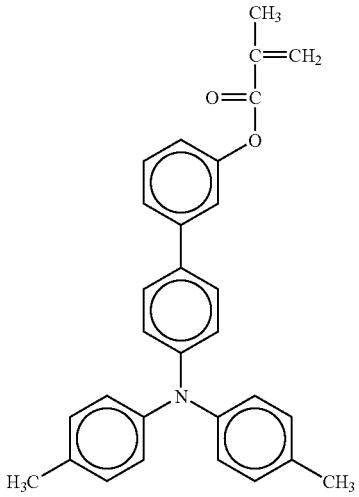
No. 66
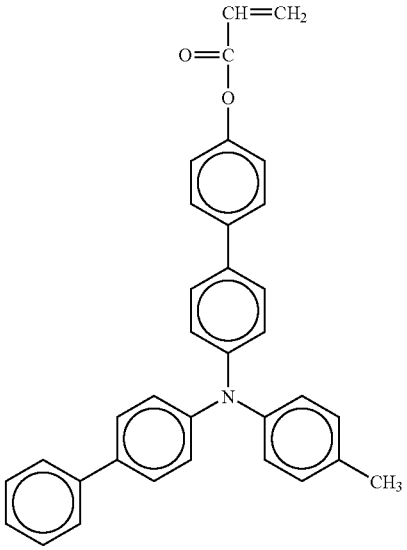
No. 67
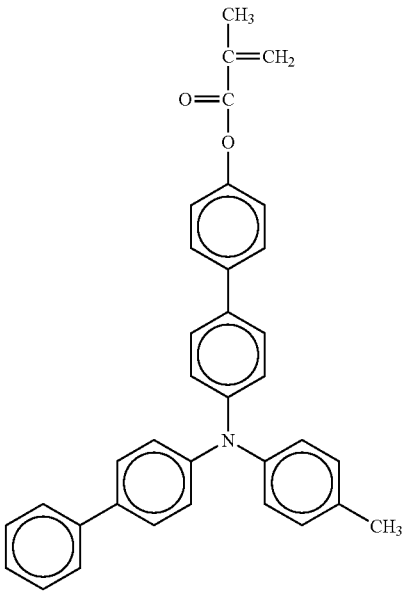
-continued
No. 68
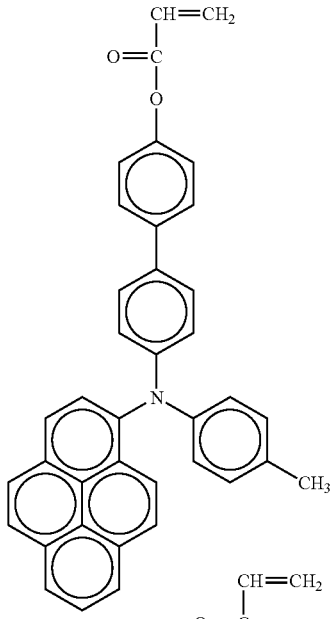
No. 69
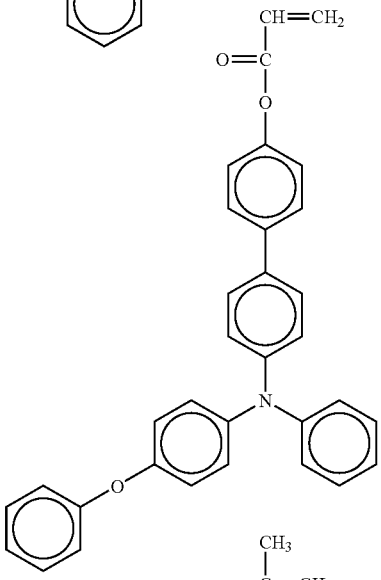
No. 70
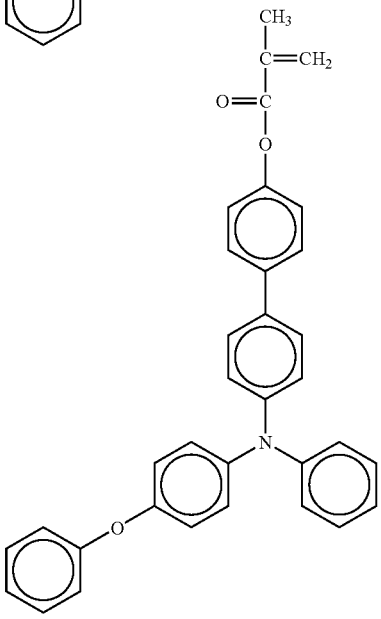

-continued
No. 71
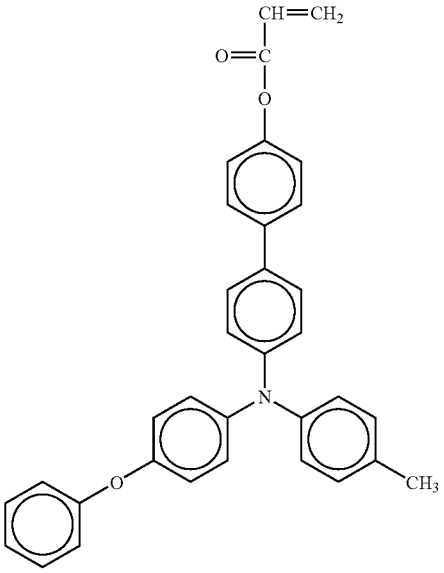
No. 72
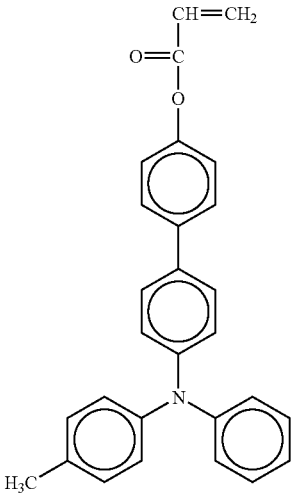
No. 73
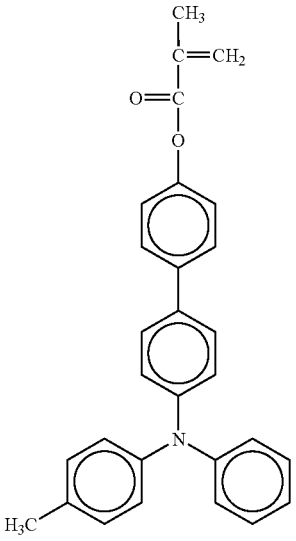
-continued
No. 74
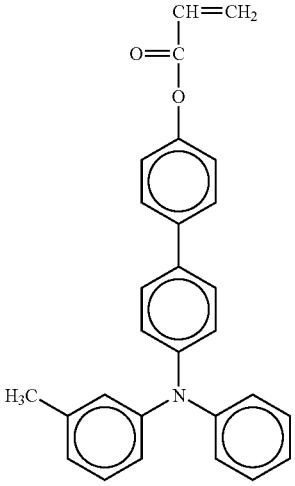
No. 75
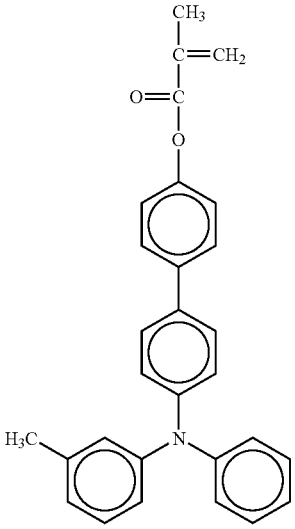
No. 76
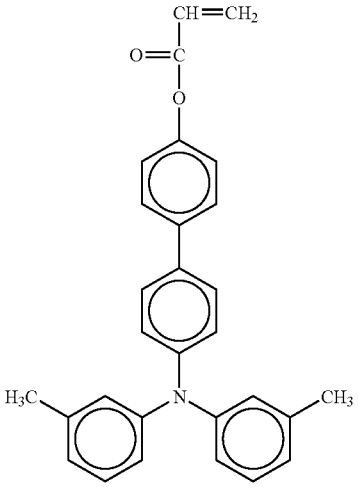

No. 77
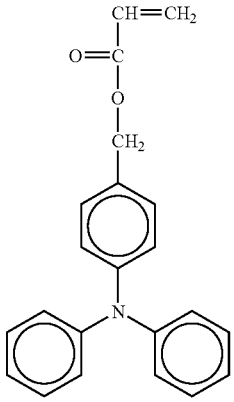
No. 78
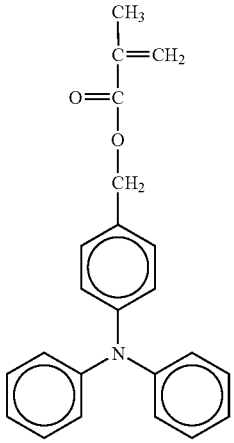
No. 79
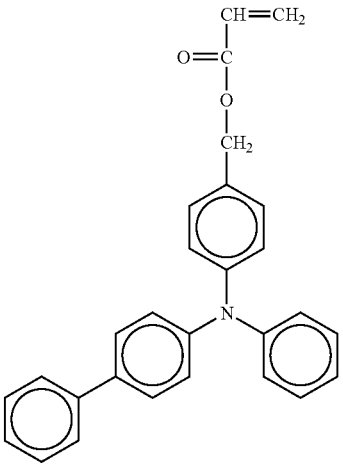
No. 80
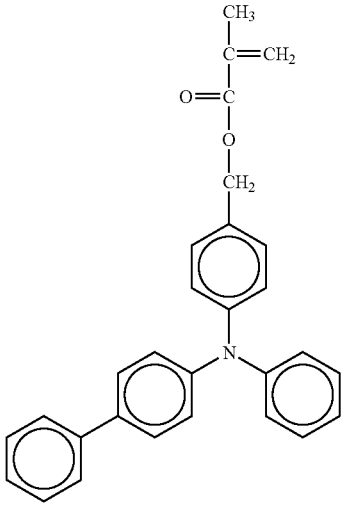
No. 81
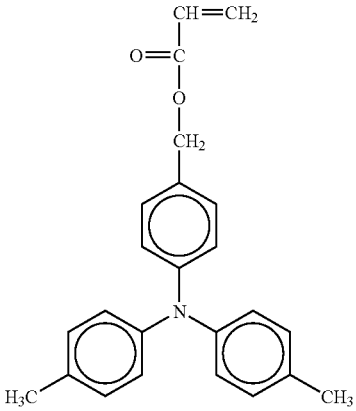
No. 82
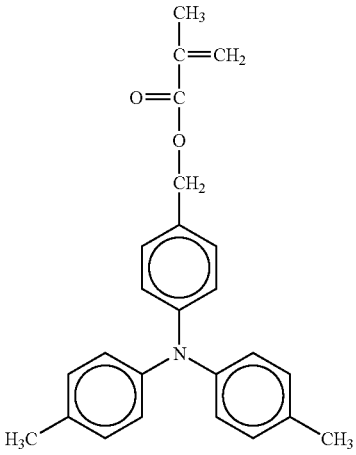

-continued
No. 83
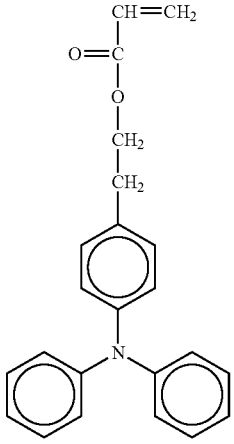
No. 84
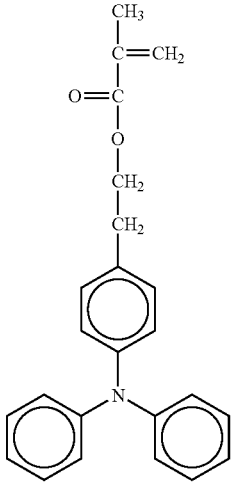
No. 85
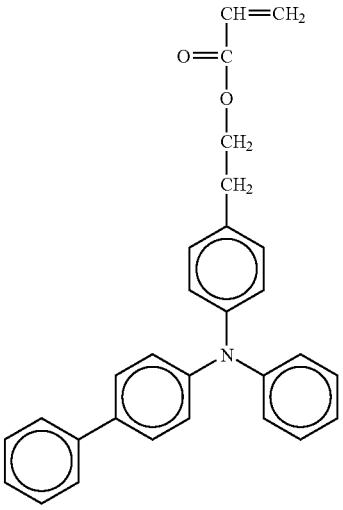
-continued
No. 86
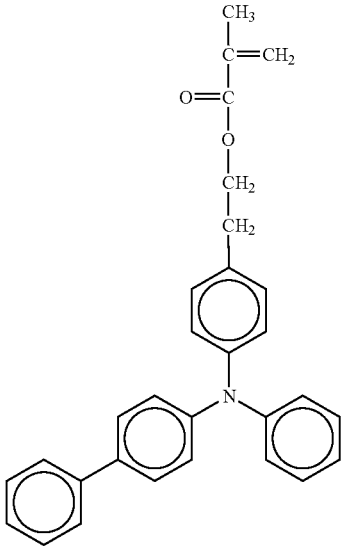
No. 87
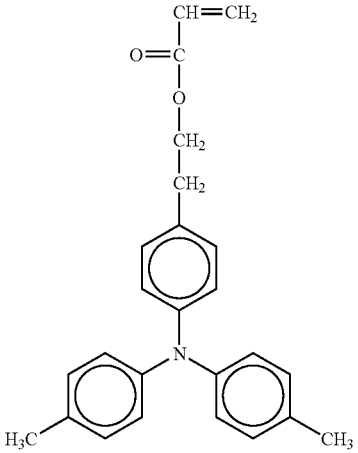
No. 88
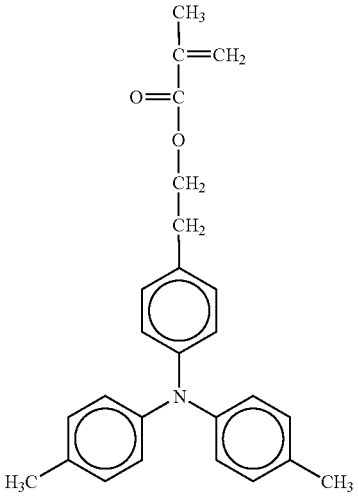

-continued
No. 89
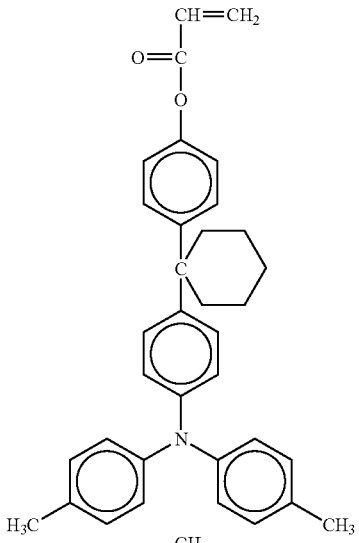
No. 90
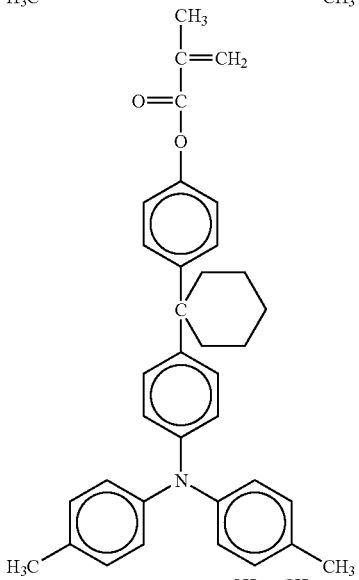
No. 91
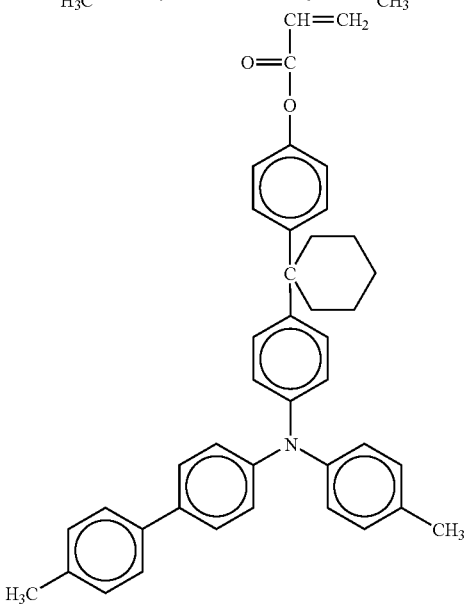
-continued
No. 92
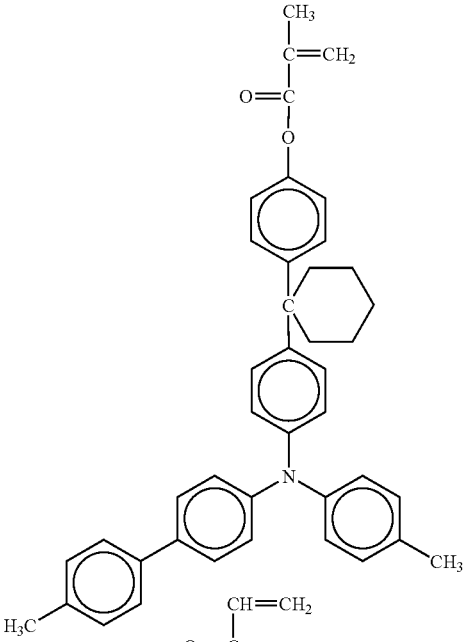
No. 93
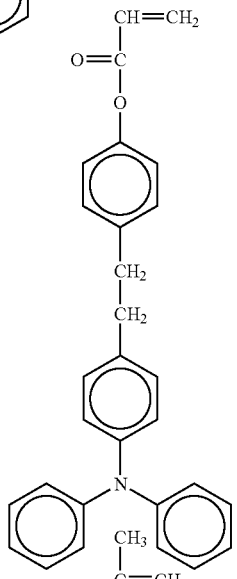
No. 94
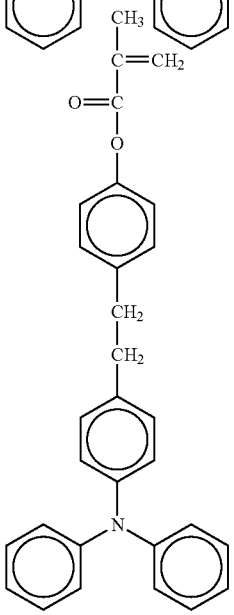

-continued
No. 95
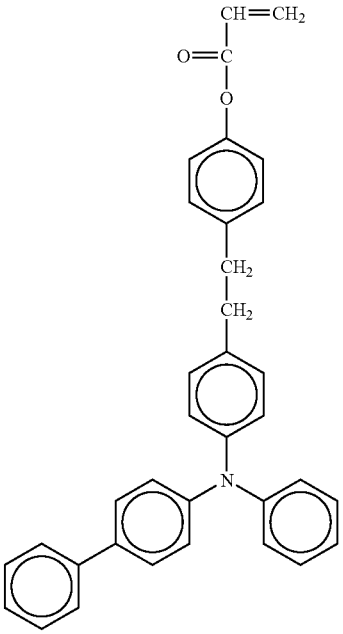
No. 96
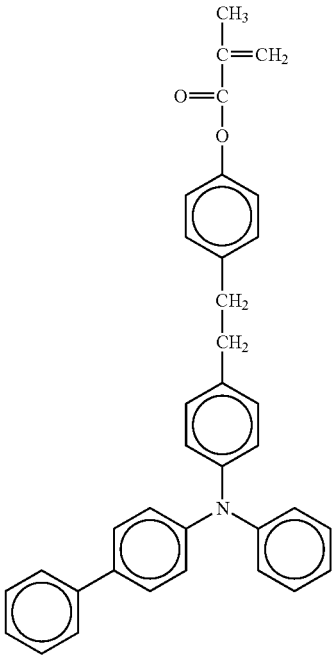
-continued
No. 97
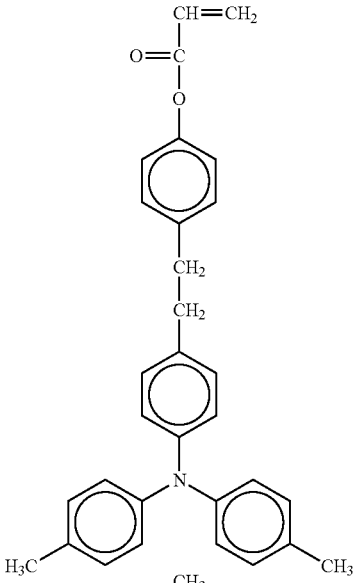
No. 98
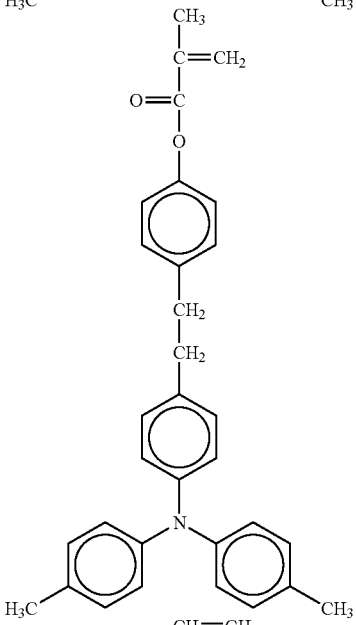
No. 99
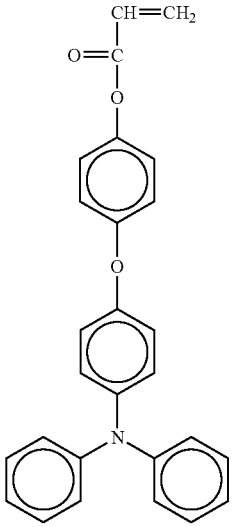

-continued
No. 100
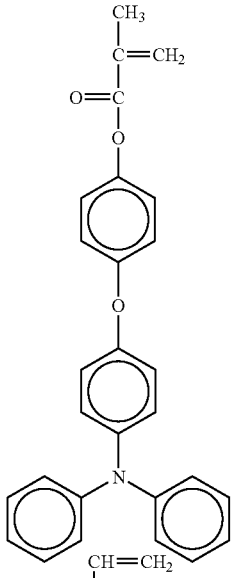
No. 101
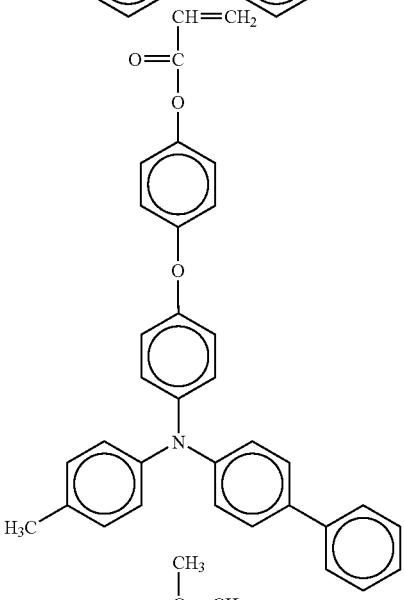
No. 102
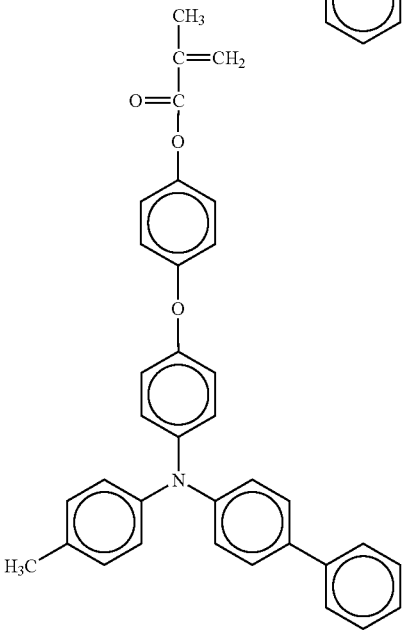
-continued
No. 103
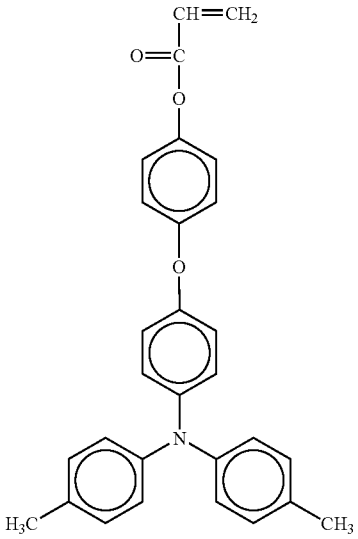
No. 104
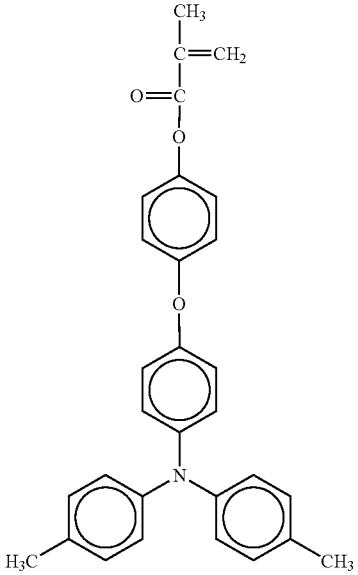
No. 105
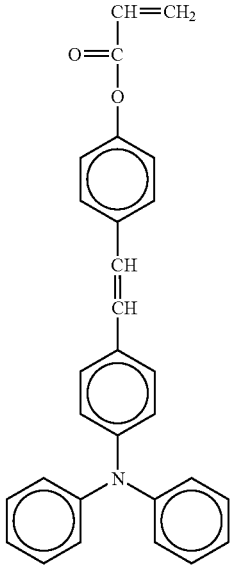

No. 106
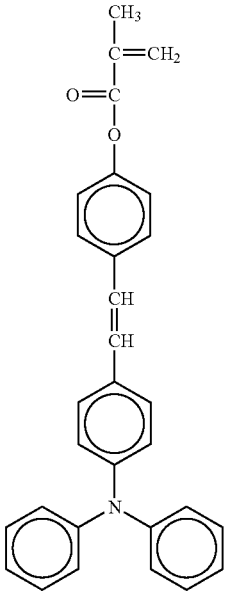
No. 107
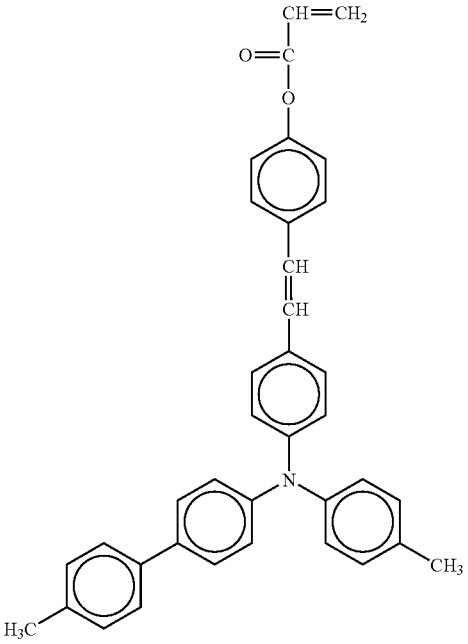
No. 108
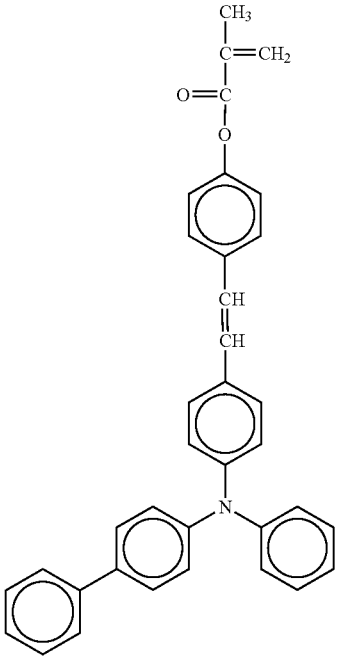
No. 109
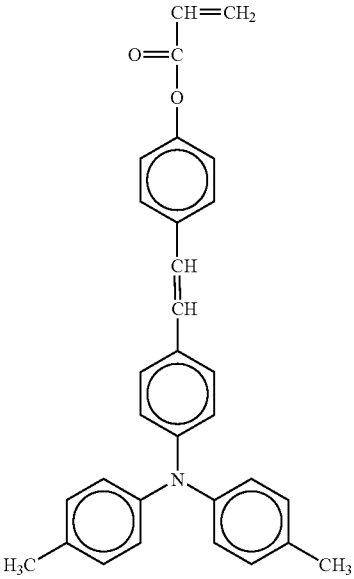

-continued
No. 110
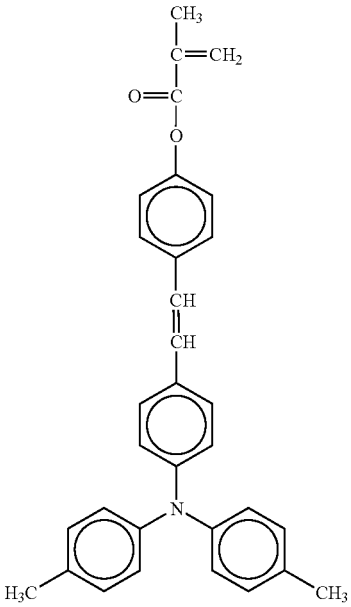
No. 111
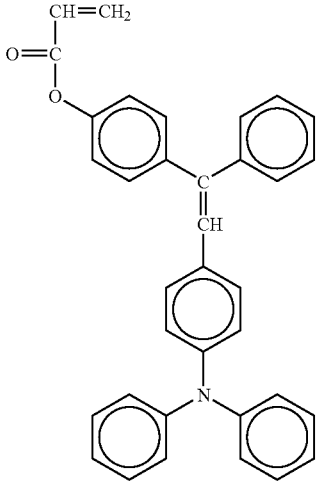
No. 112
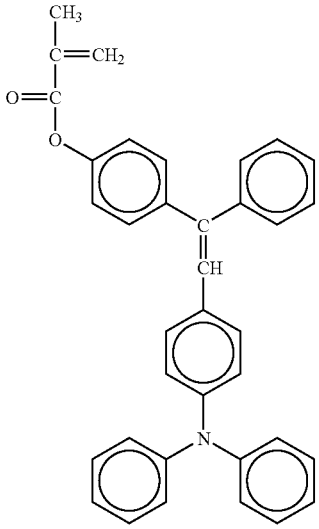
-continued
No. 113
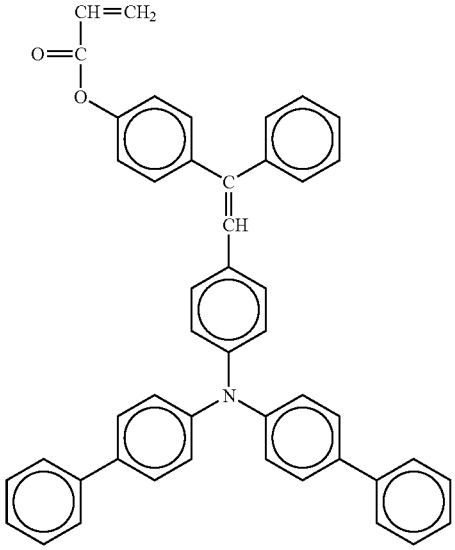
No. 114
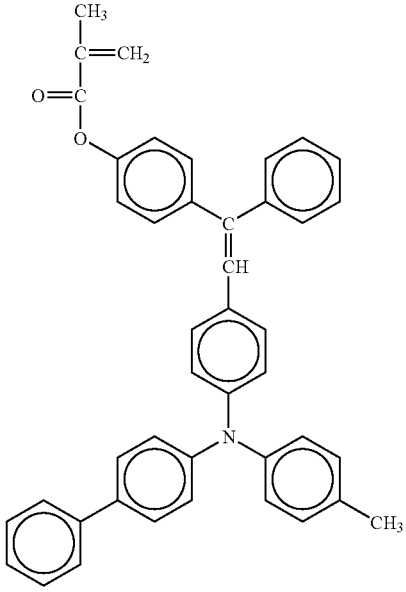
No. 115
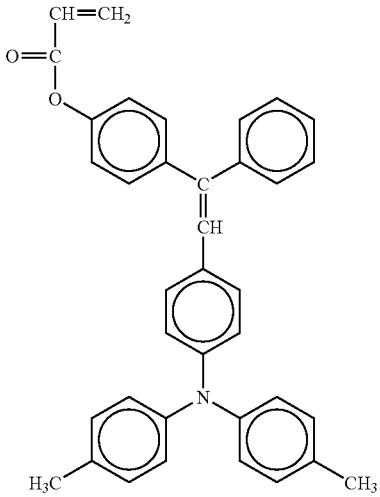

No. 116
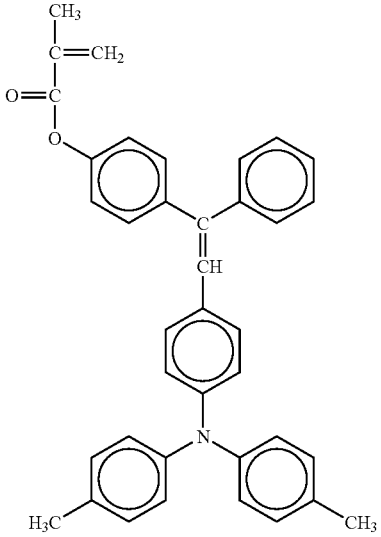
No. 117
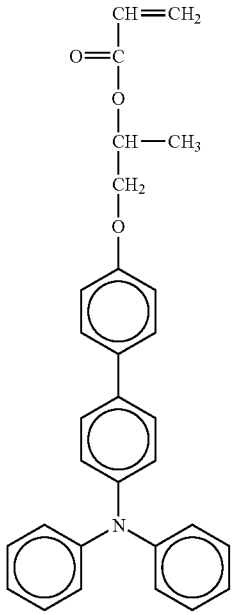
No. 118
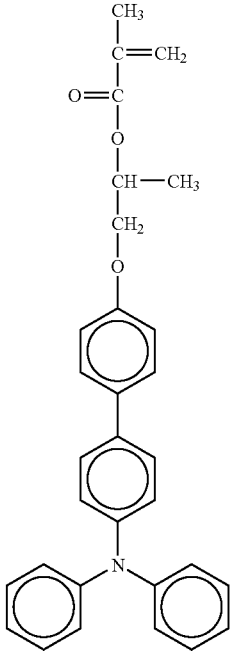
No. 119
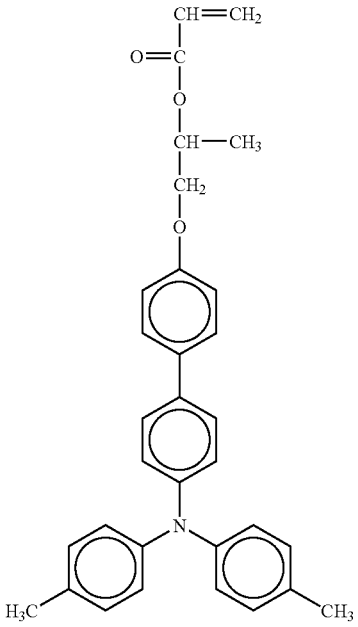

No. 120
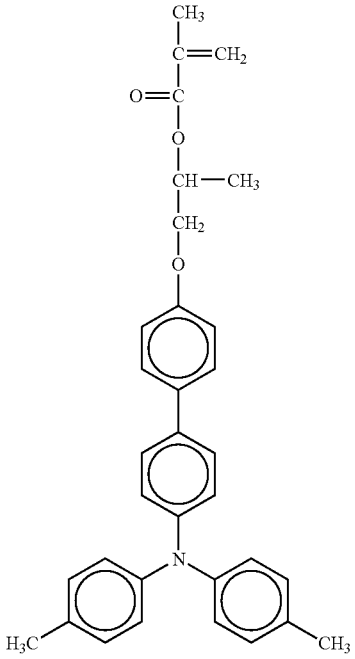
No. 121
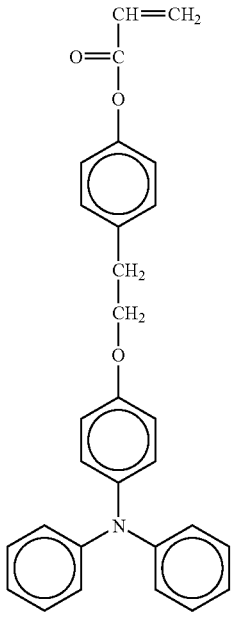
No. 122
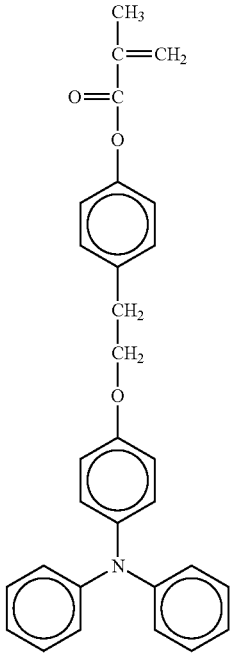
No. 123
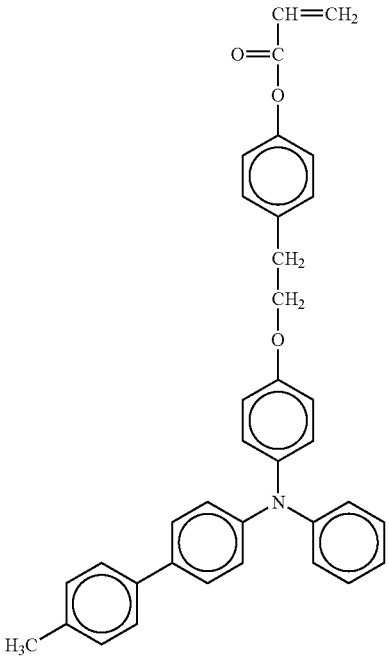

-continued
No. 124
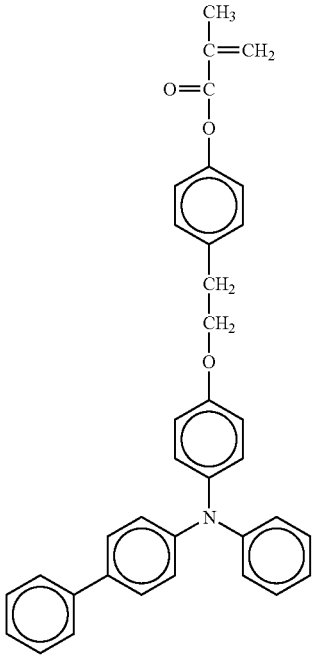
No. 125
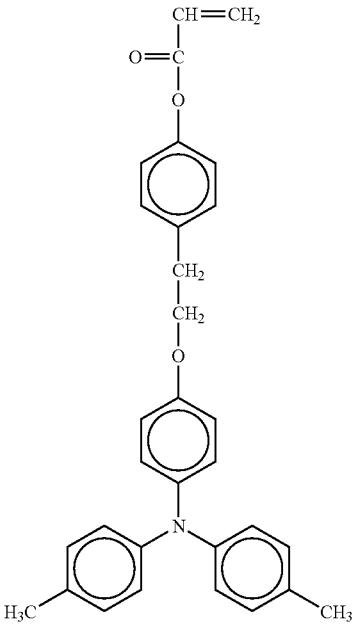
-continued
No. 126
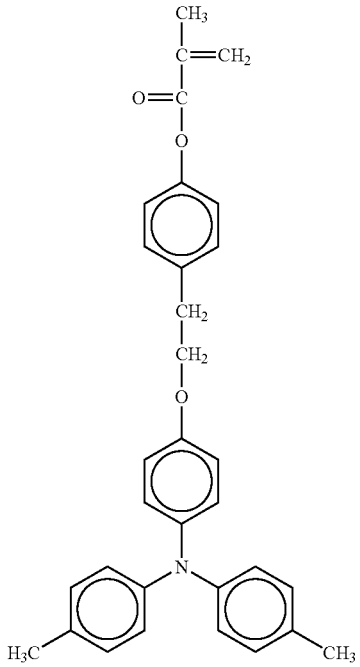
No. 127
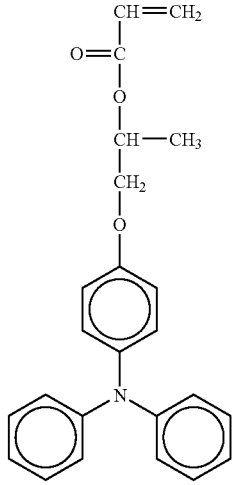
No. 128
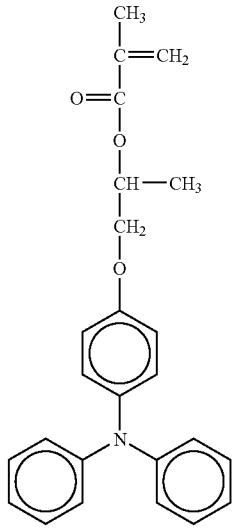

-continued
No. 129
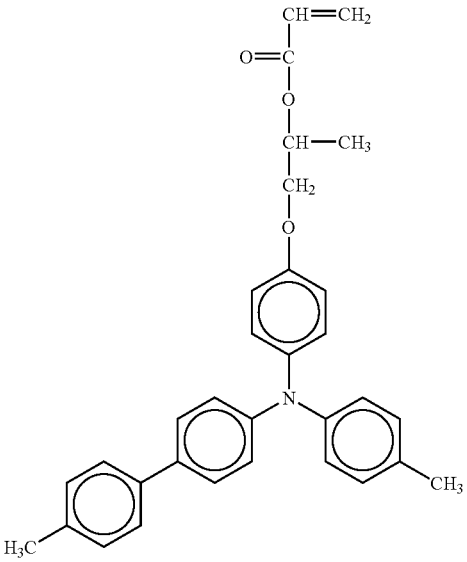
No. 130
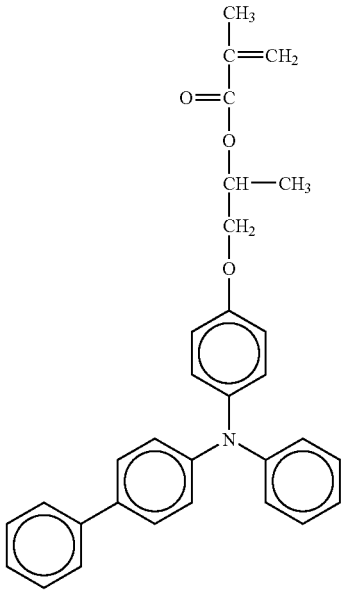
No. 131
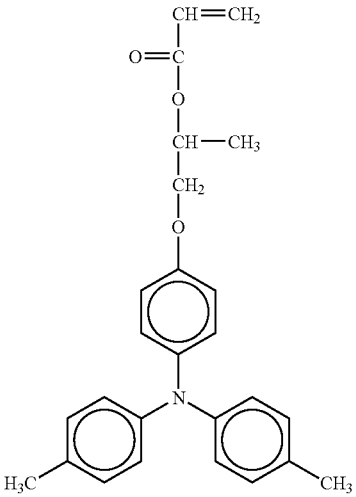
-continued
No. 132
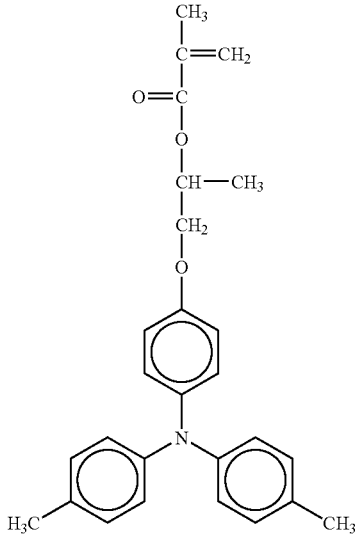
No. 133
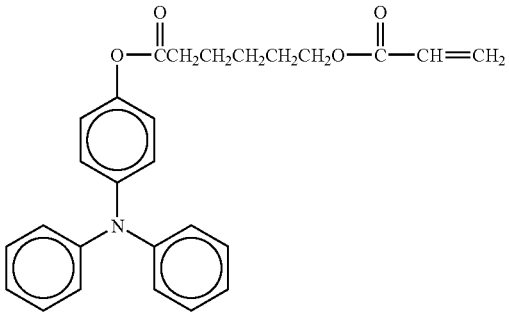
No. 134
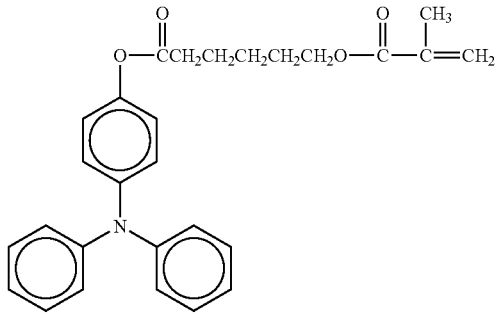
No. 135
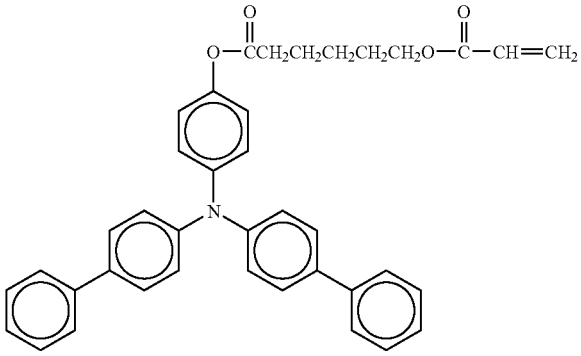

-continued
No. 136
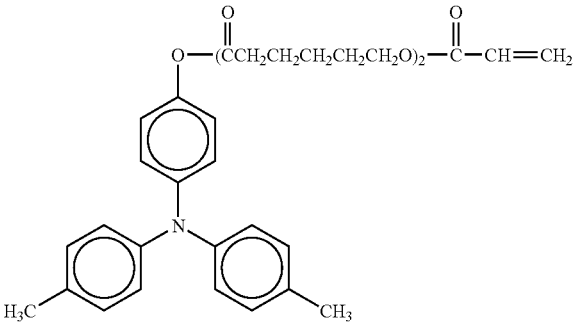
No. 137
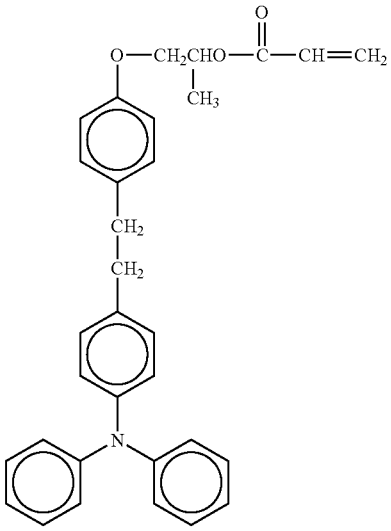
No. 138
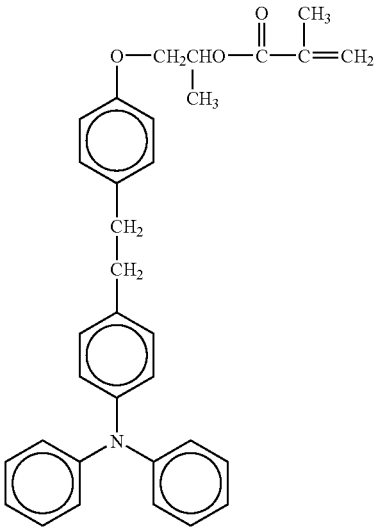
-continued
No. 139
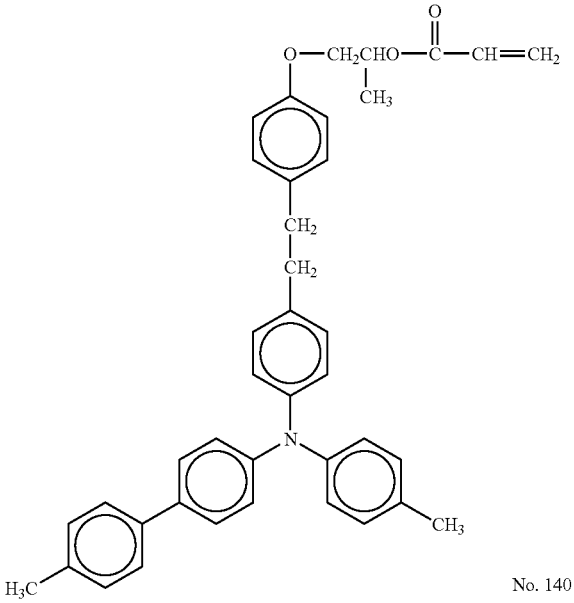
No. 140
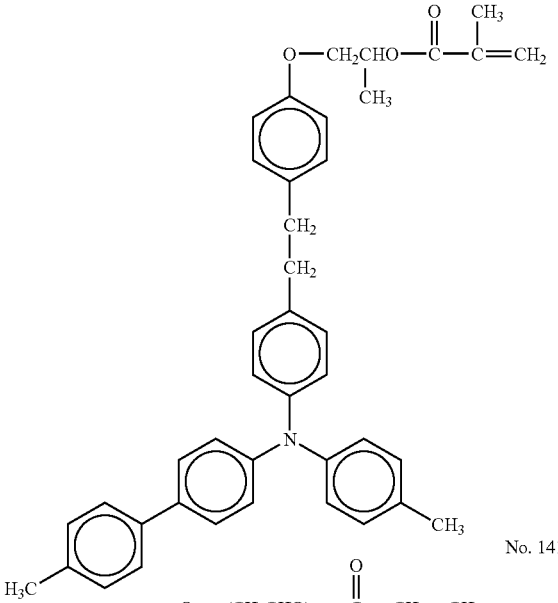
No. 141
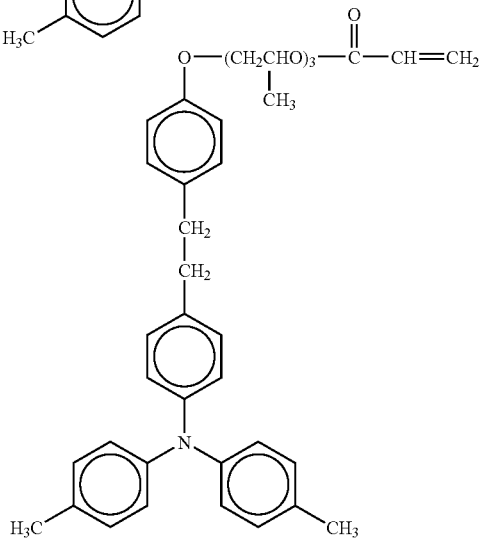

-continued
No. 142
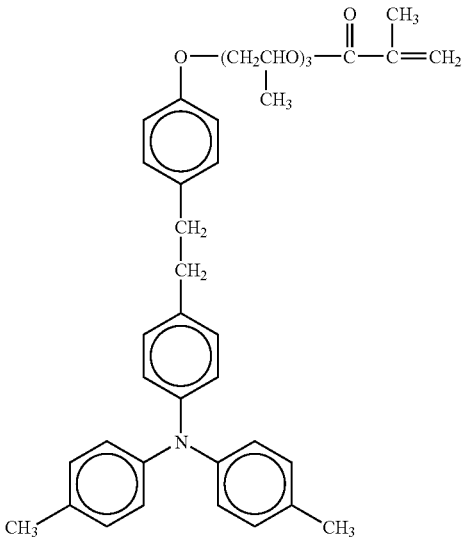
No. 143
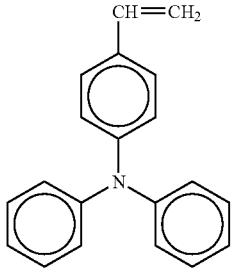
No. 144
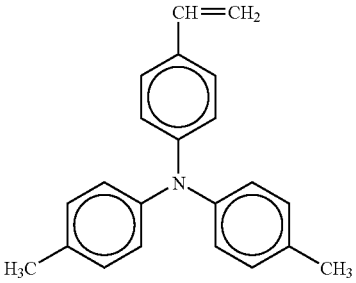
No. 145
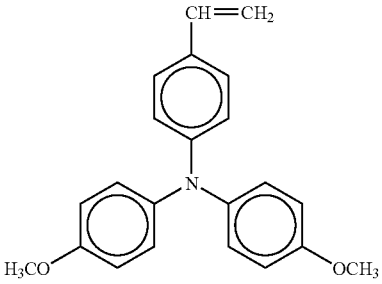
-continued
No. 146
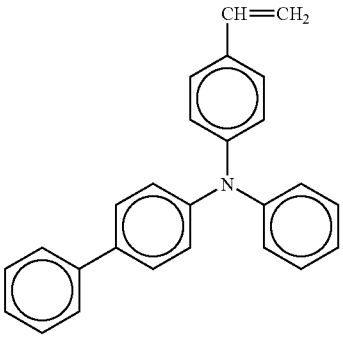
No. 147
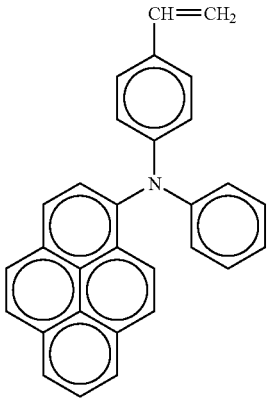
No. 148
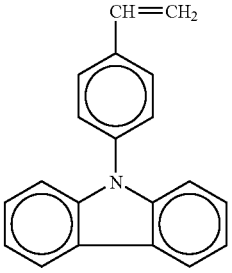
No. 149
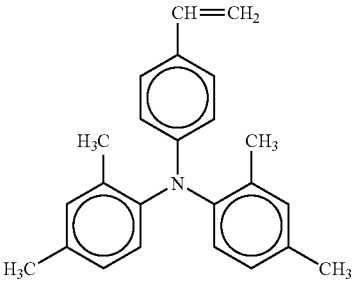
No. 150
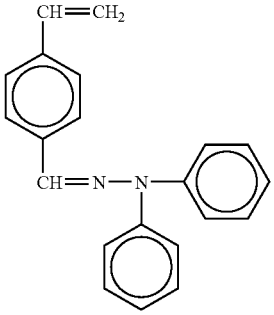

-continued
No. 151
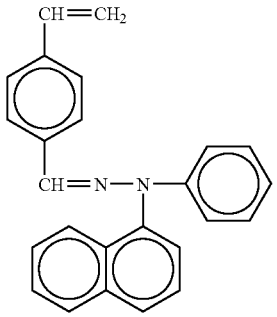
No. 152
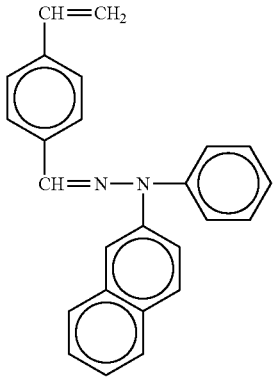
No. 153
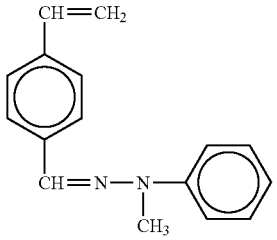
No. 154
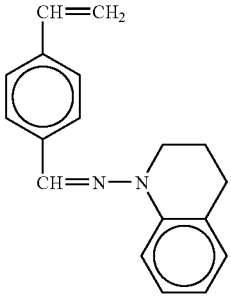
No. 155
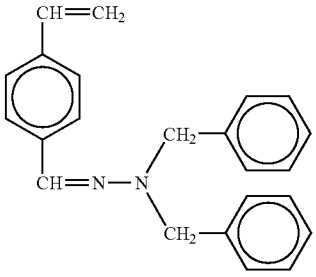
-continued
No. 156
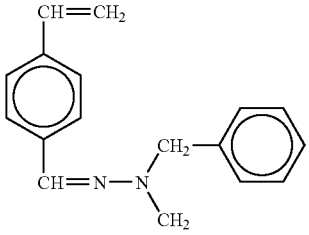
No. 157
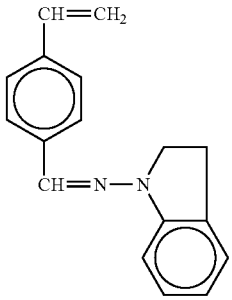
No. 158
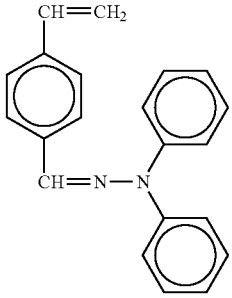
No. 159
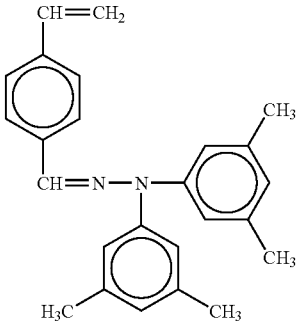
No. 160
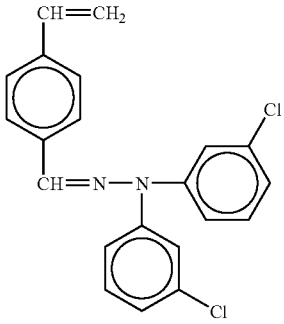
Radical Polymerizable Compound Having Two Functional Groups with a Charge Transport Structure
Specific examples of the radical polymerizable compound having two functional groups with a charge transport structure include, but are not limited to, the following:

NO. 161
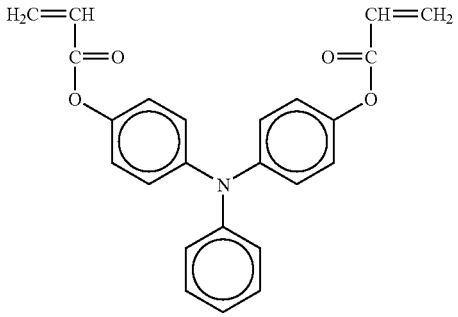
NO. 162
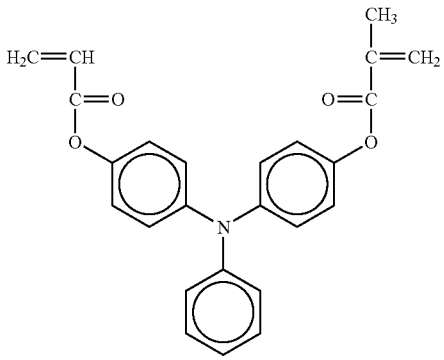
NO. 163
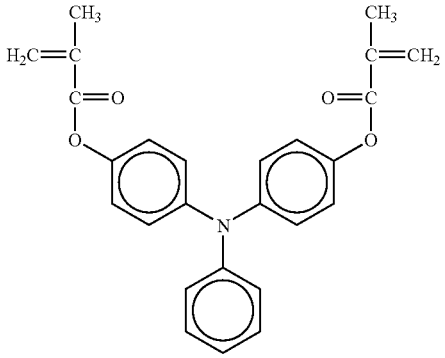
NO. 164
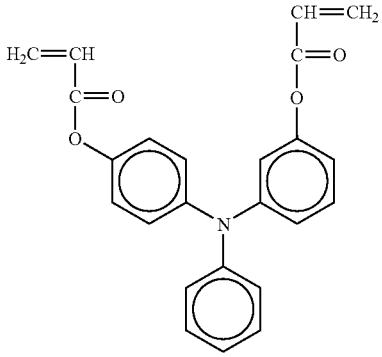
NO. 165
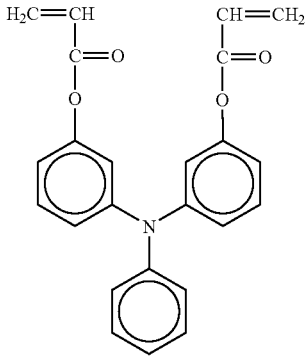
NO. 166
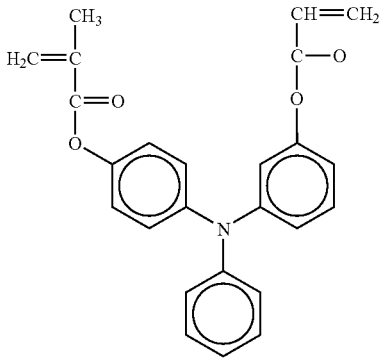
NO. 167
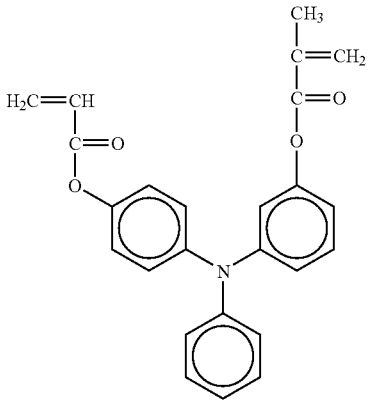
NO. 168
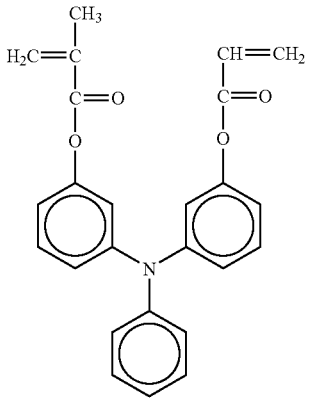

-continued
NO. 169
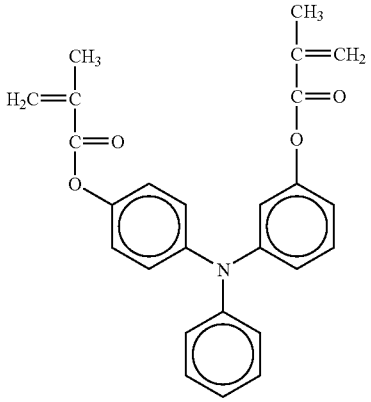
NO. 170
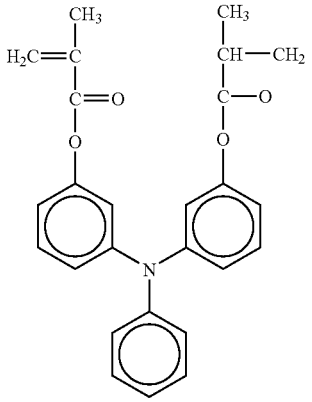
NO. 171
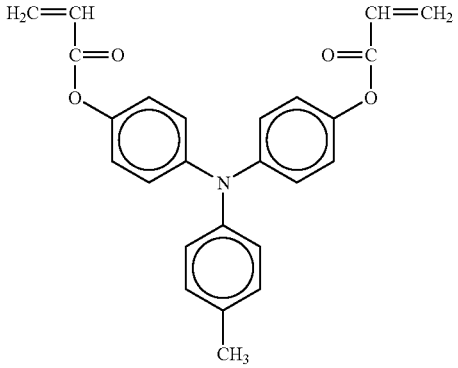
NO. 172
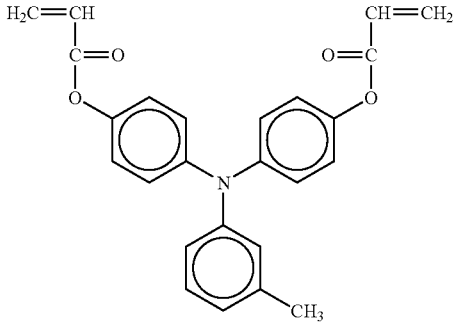
NO. 173
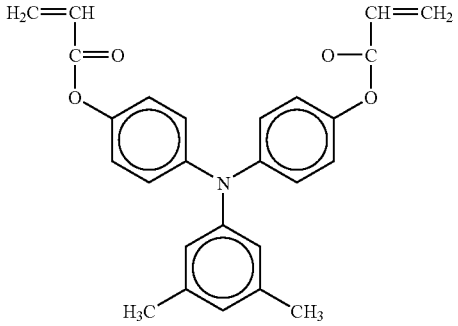
NO. 174
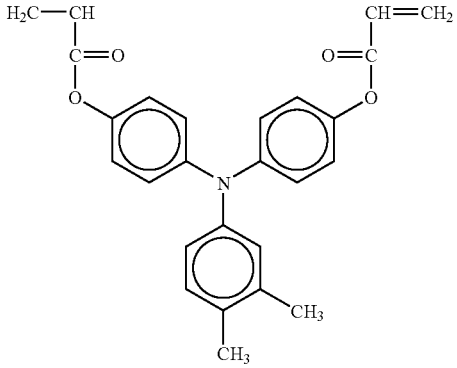
NO. 175
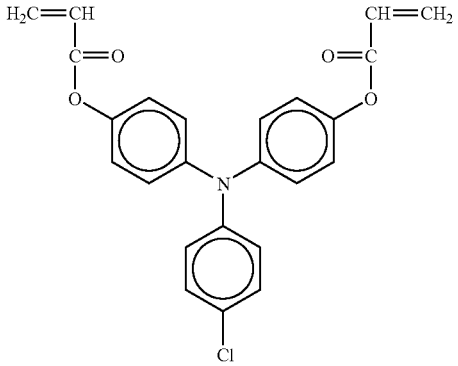
NO. 176
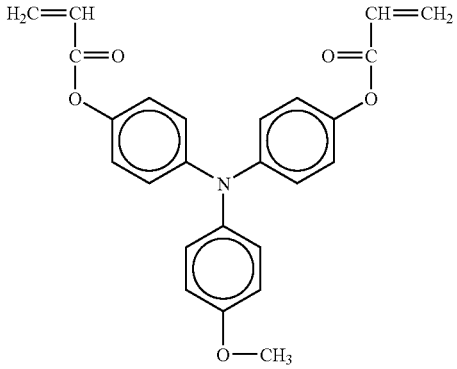

-continued
NO. 177
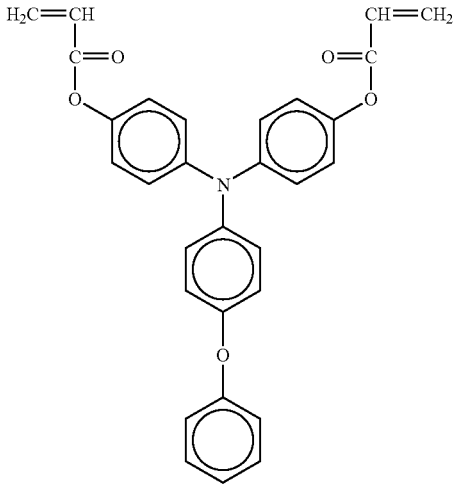
NO. 178
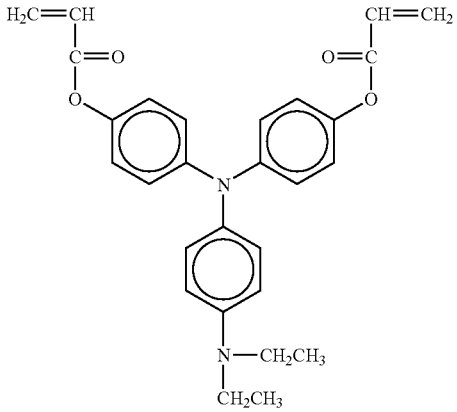
NO. 179
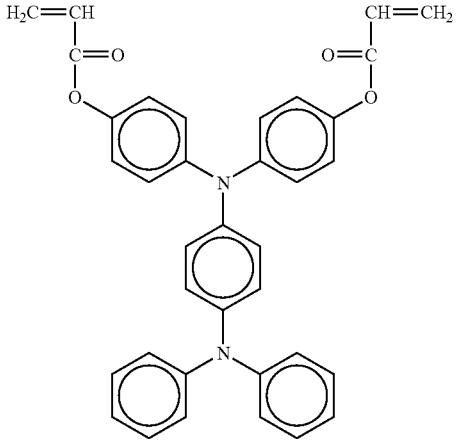
NO. 180
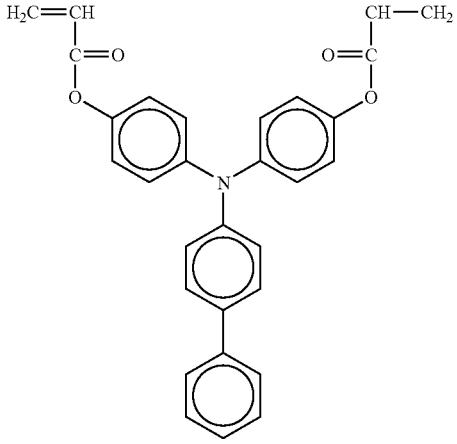
NO. 181
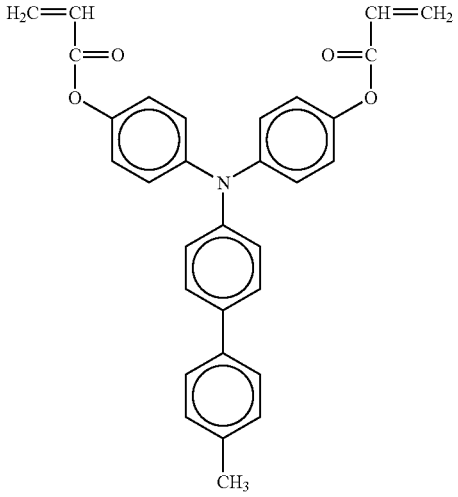
NO. 182
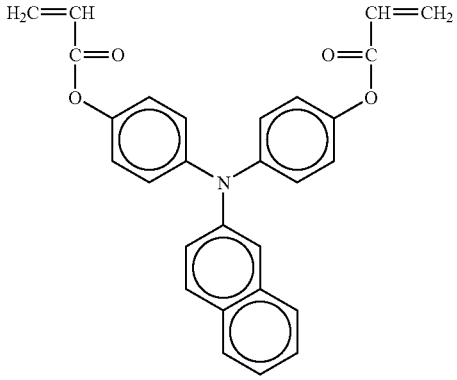

-continued
NO. 183
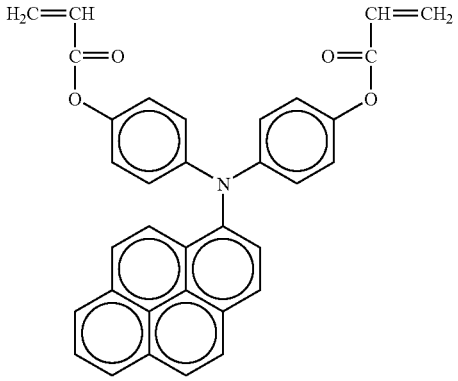
NO. 184
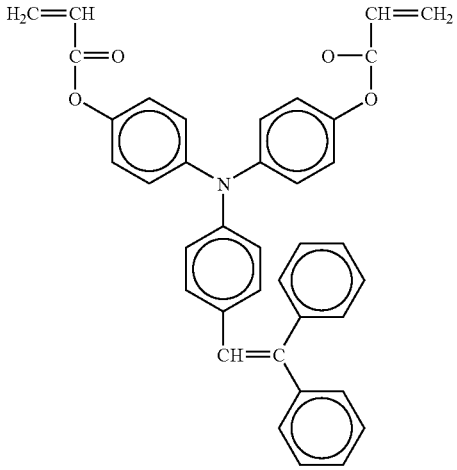
NO. 185
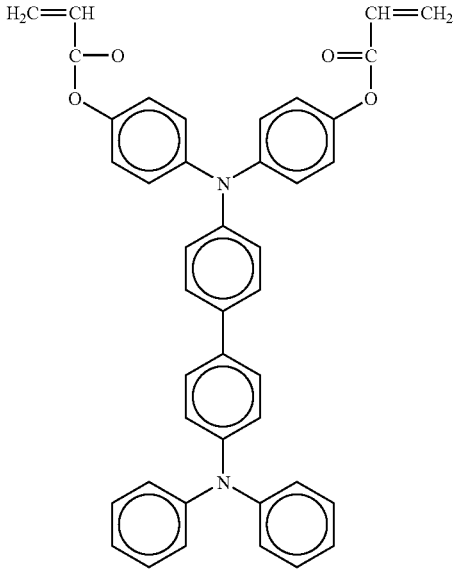
NO. 186
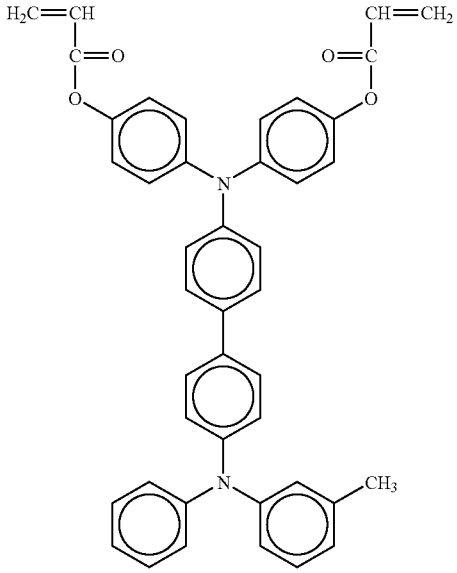
NO. 187
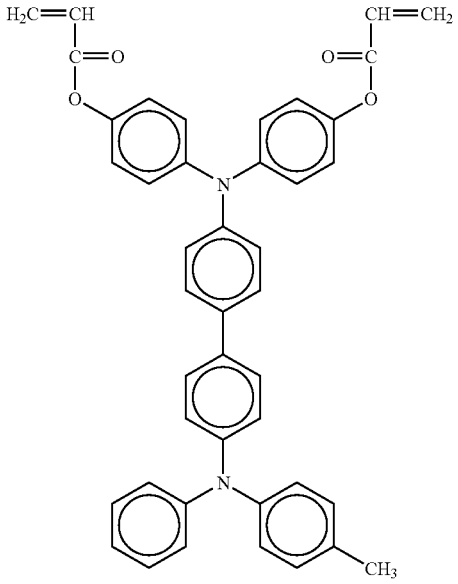
NO. 188
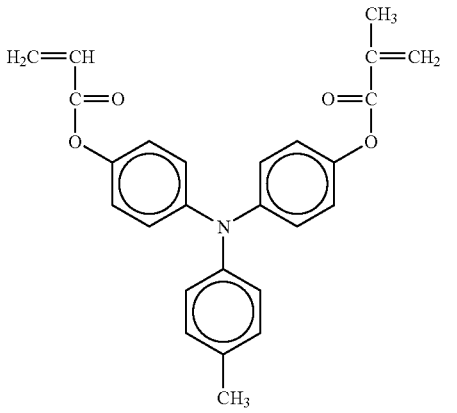

-continued
NO. 189
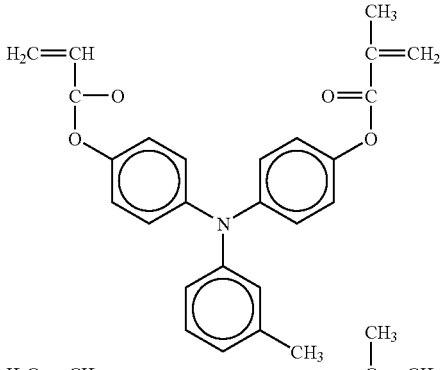
NO. 190
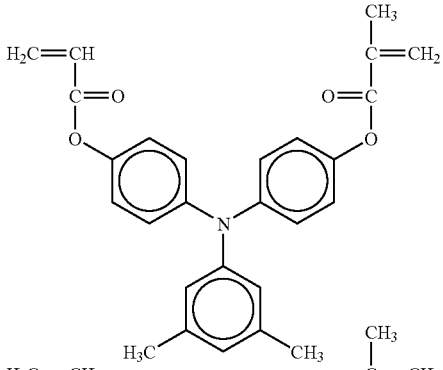
NO. 191
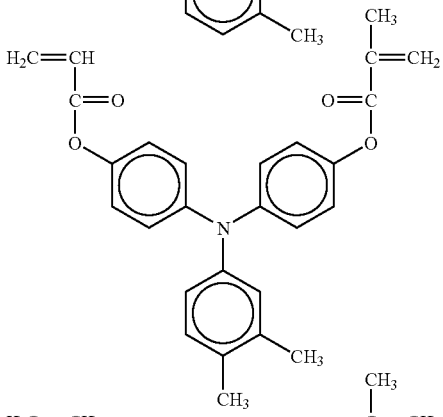
NO. 192
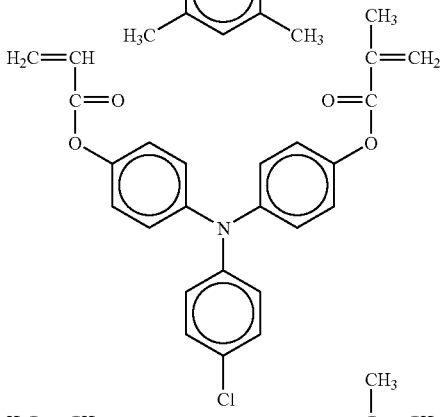
NO. 193
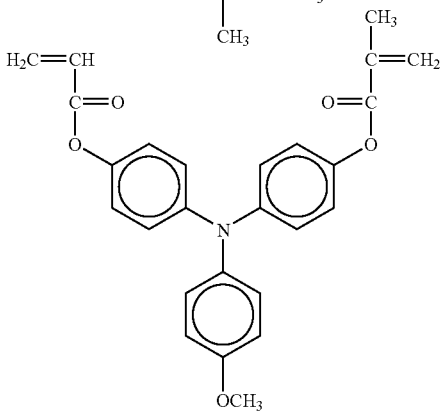
NO. 194
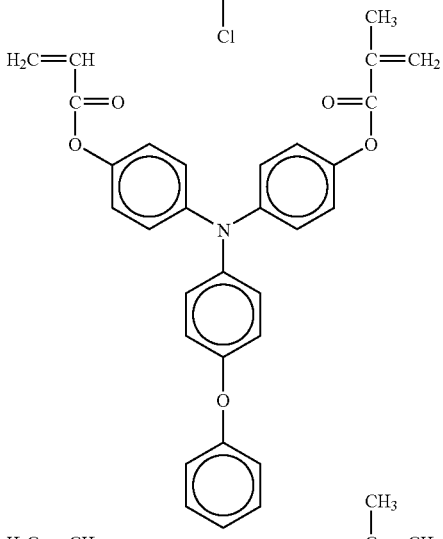
NO. 195
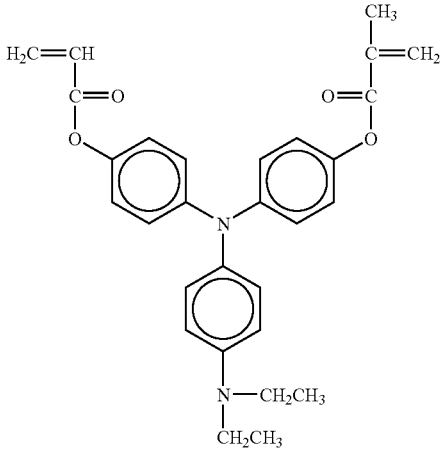
NO. 196
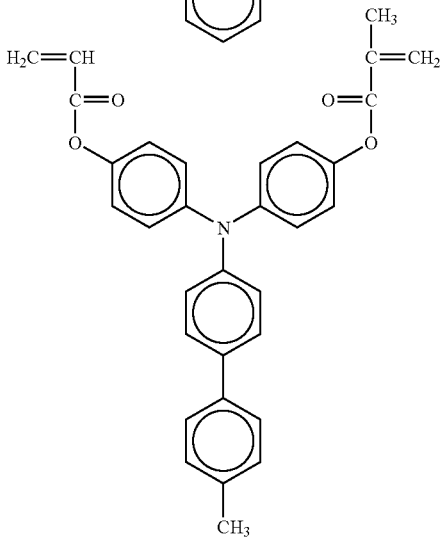

-continued
NO. 197
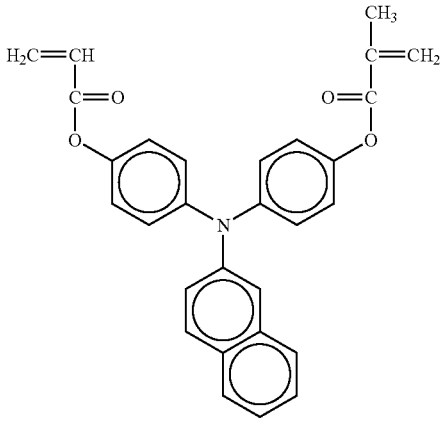
NO. 198
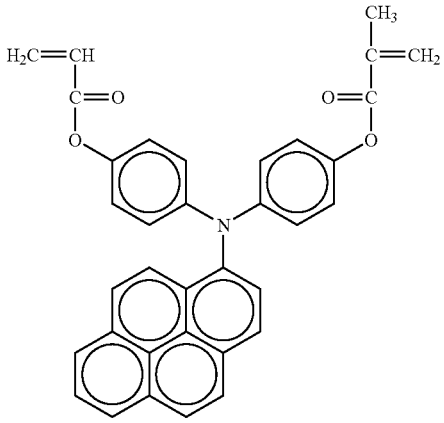
NO. 199
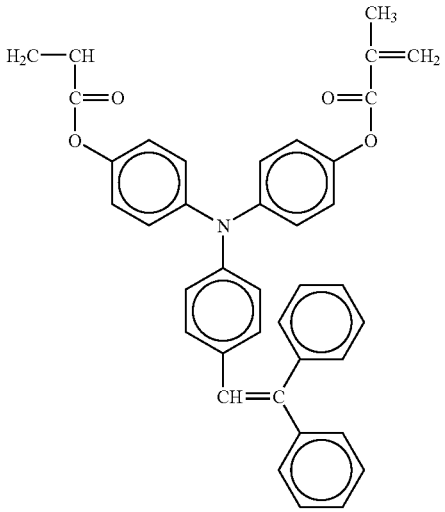
NO. 200
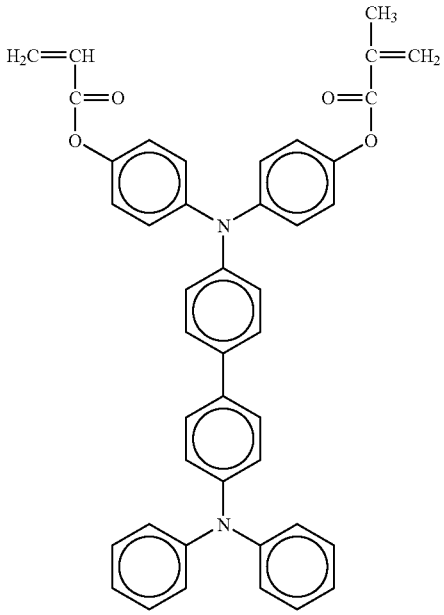
NO. 201
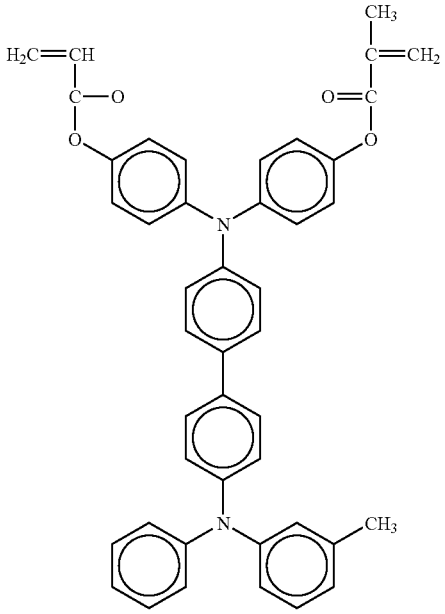
NO. 202
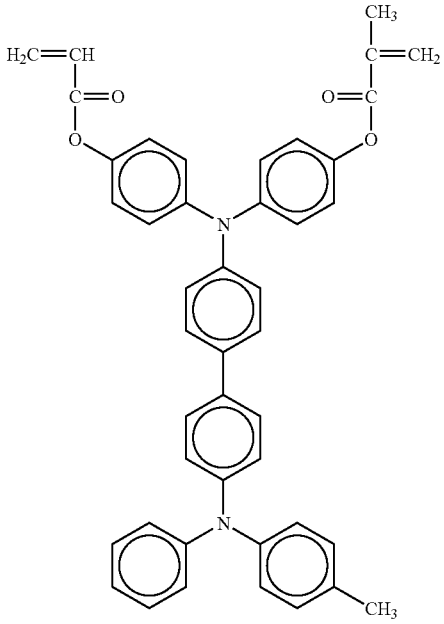

-continued
NO. 203
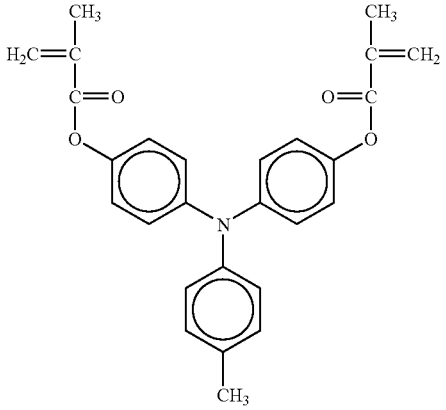
NO. 204
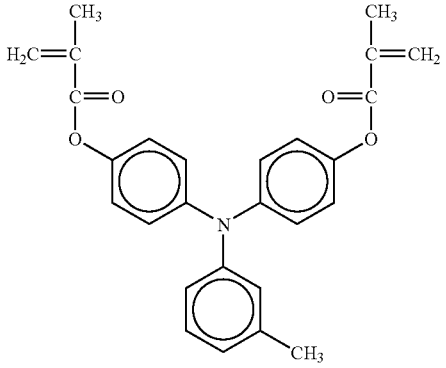
NO. 205
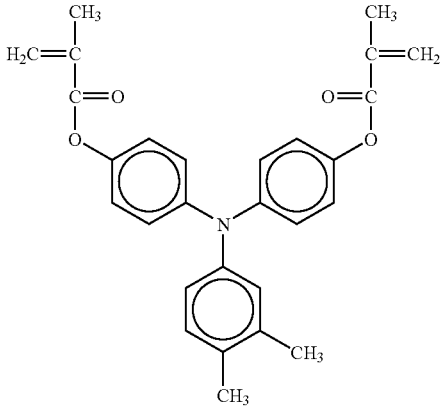
NO. 206
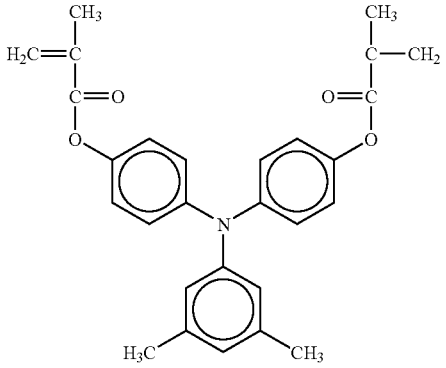
NO. 207
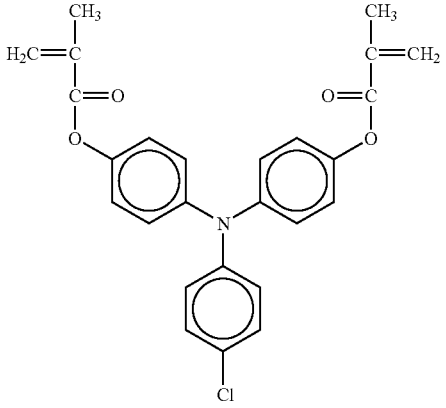
NO. 208
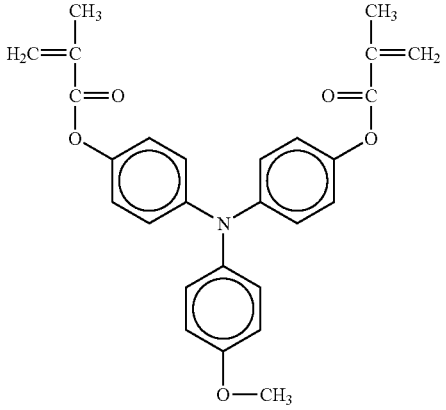

-continued
NO. 209
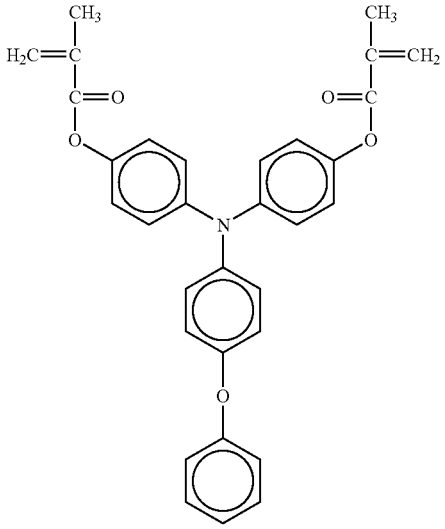
NO. 210
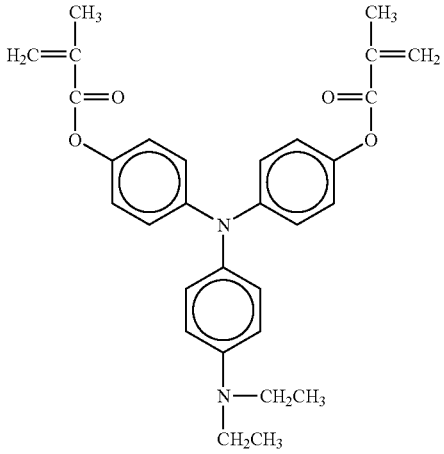
NO. 211
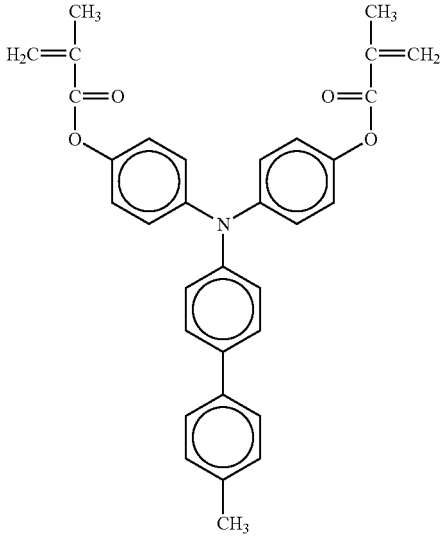
NO. 212
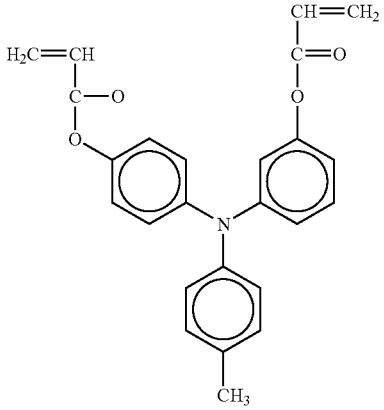
NO. 213
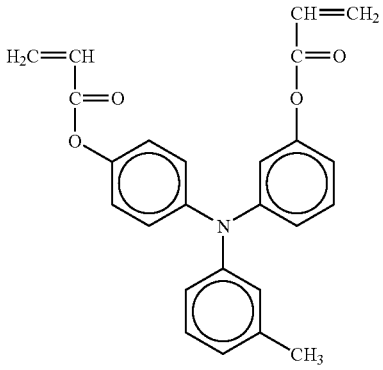
NO. 214
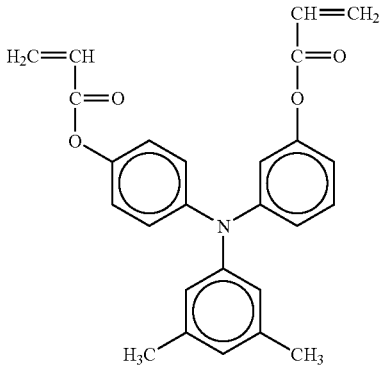

-continued
NO. 215
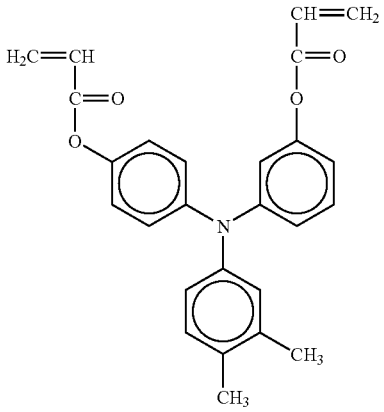
NO. 216
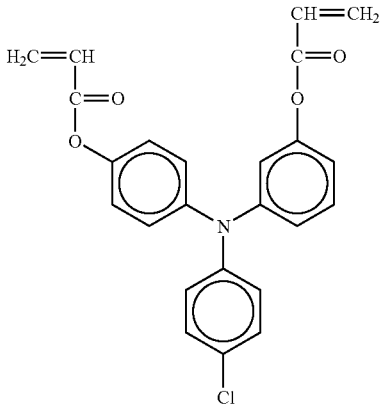
NO. 217
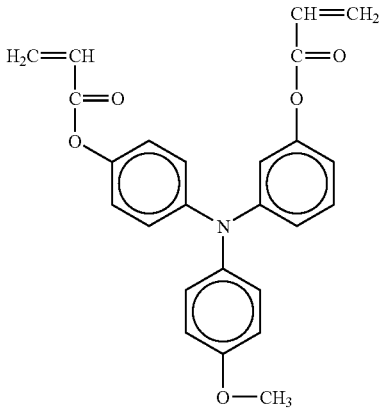
NO. 218
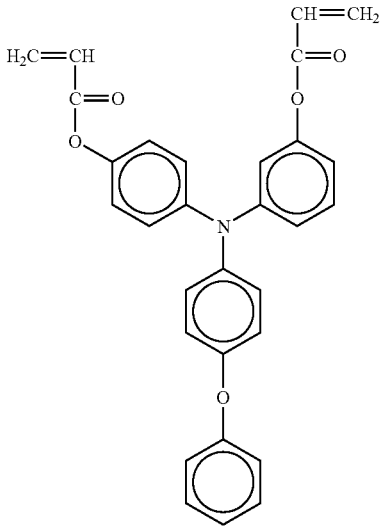
NO. 219
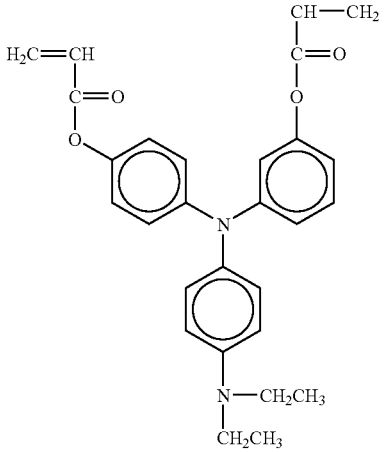
NO. 220
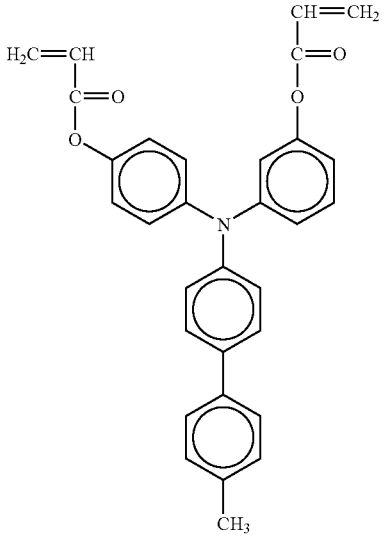

-continued
NO. 221
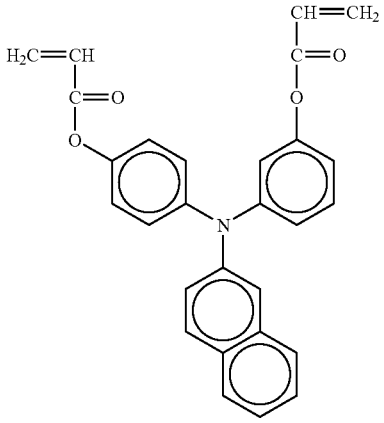
NO. 222
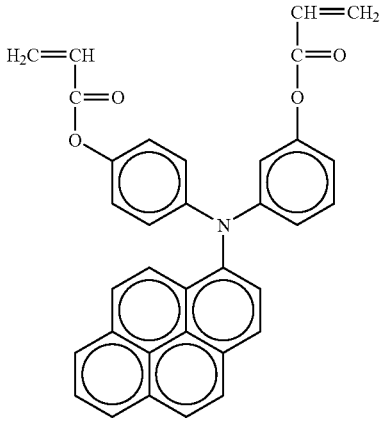
NO. 223
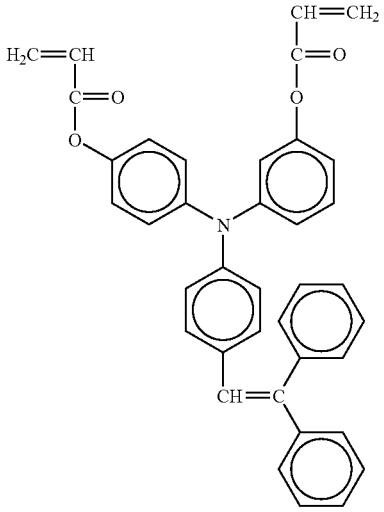
NO. 224
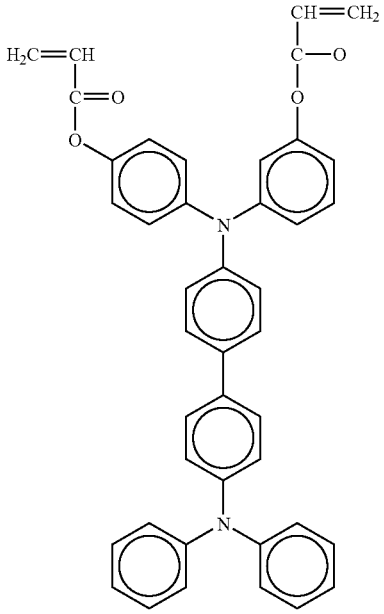
NO. 225
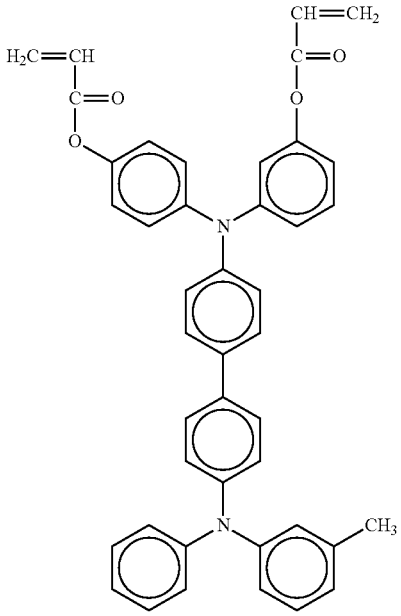
NO. 226
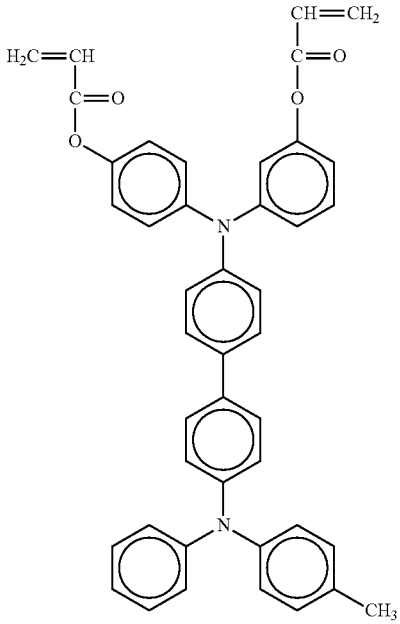

-continued
NO. 227
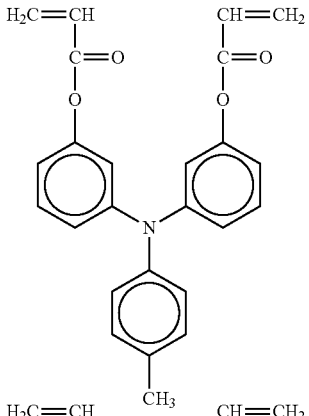
NO. 228
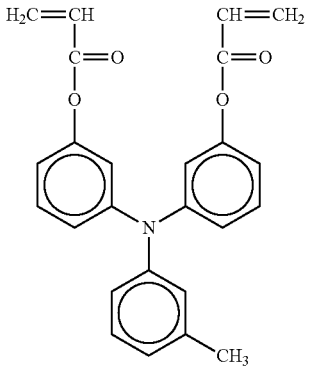
NO. 229
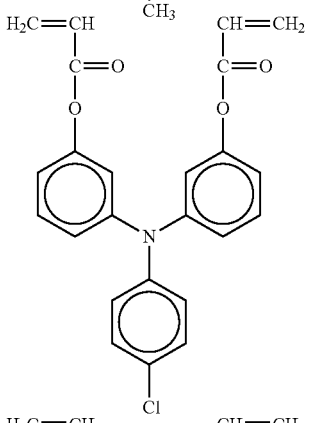
NO. 230
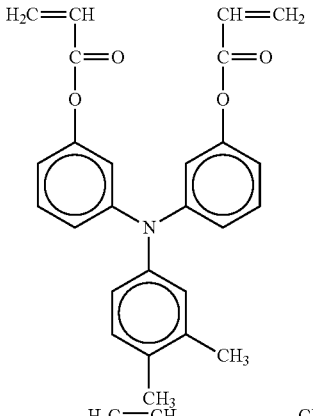
NO. 231
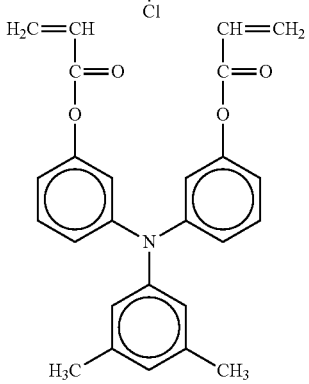
NO. 232
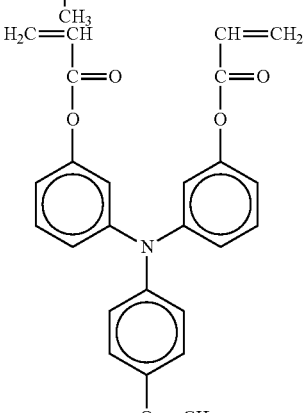
NO. 233
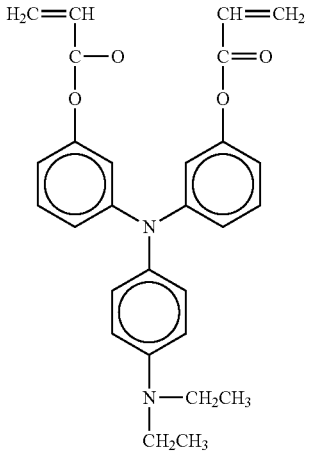
NO. 234
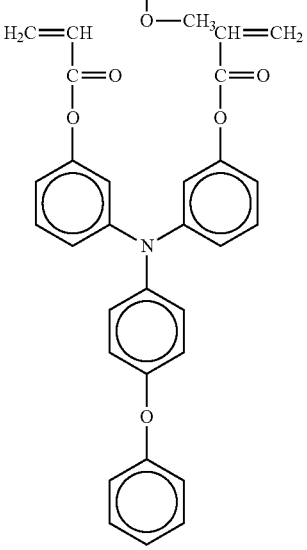

-continued
NO. 235
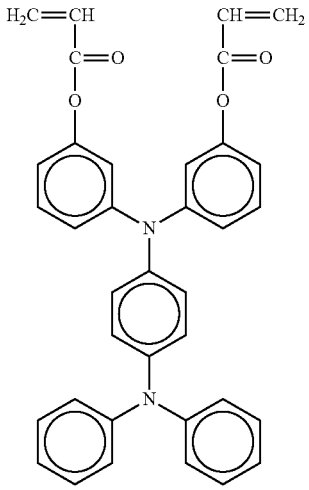
NO. 236
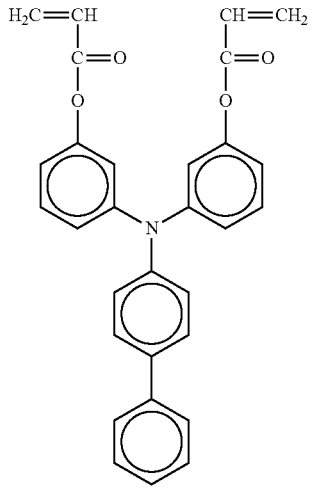
NO. 237
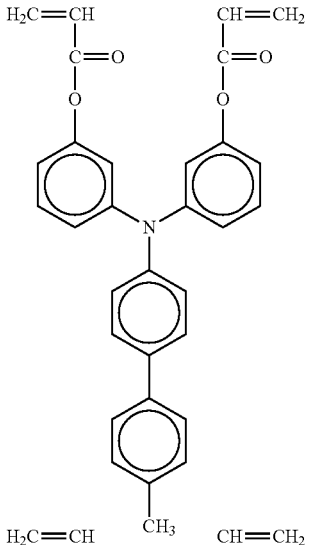
NO. 238
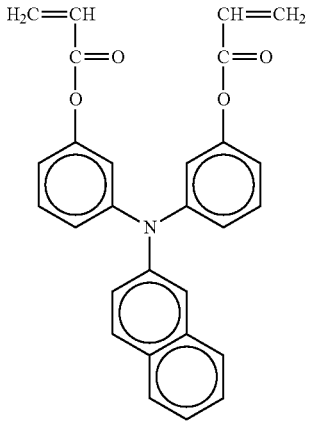
NO. 239
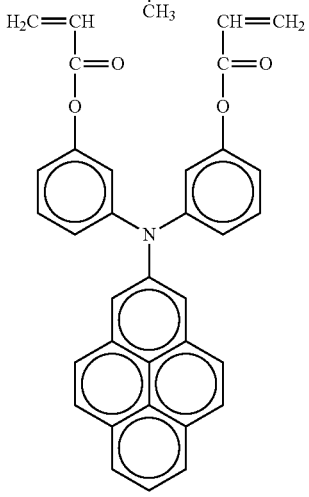
NO. 240
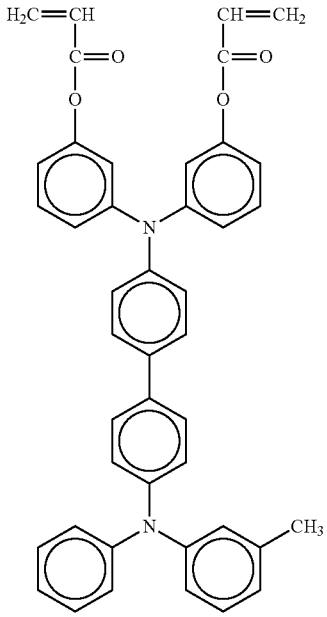

-continued
NO. 241
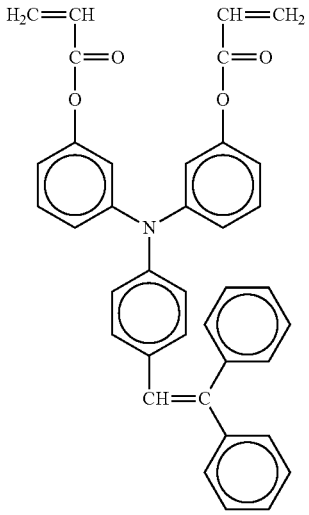
NO. 242
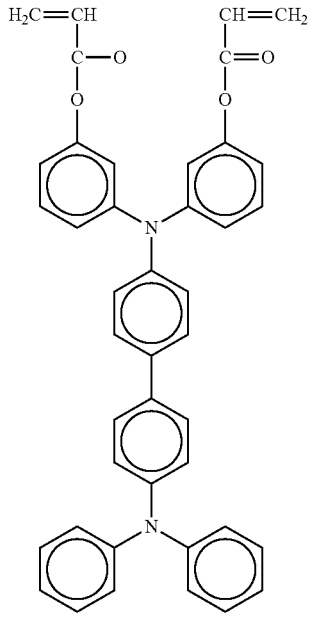
NO. 243
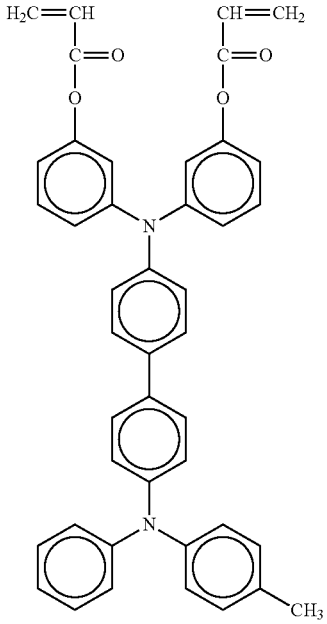
NO. 244
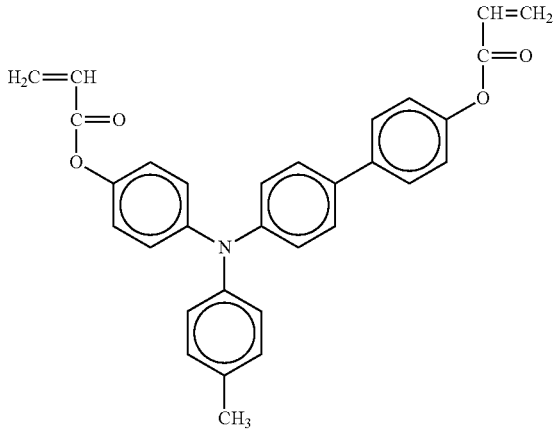

-continued
NO. 245
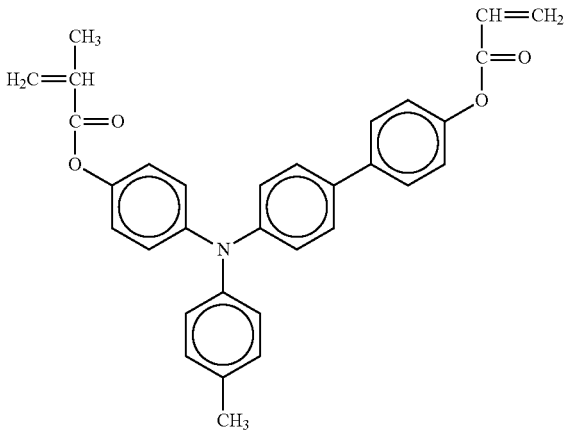
NO. 246
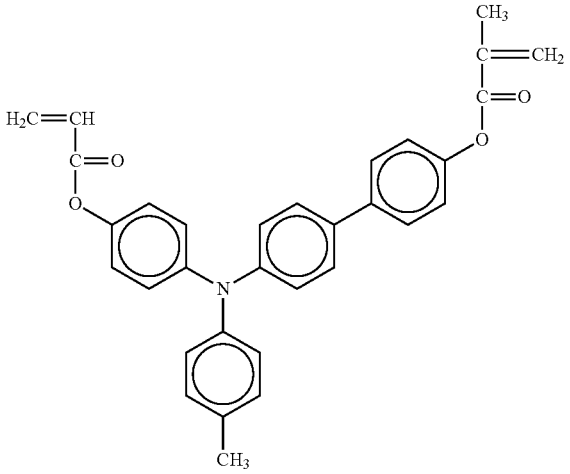
NO. 247
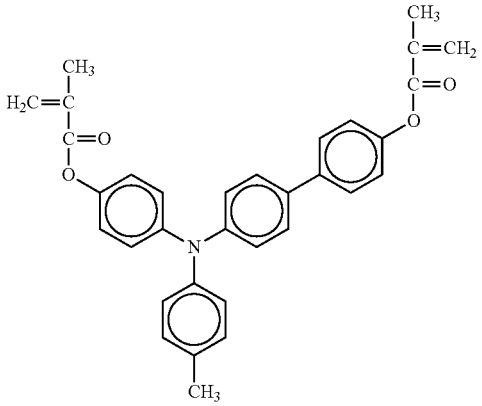
NO. 248
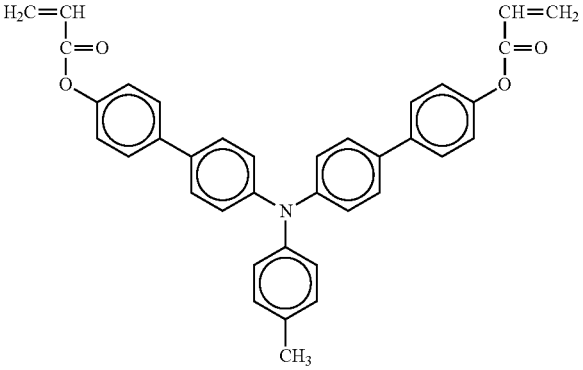
NO. 249
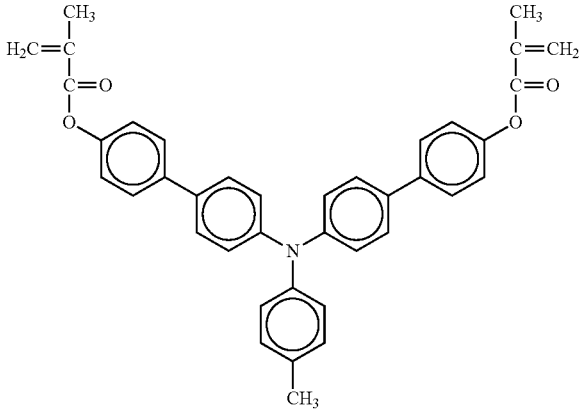
NO. 250
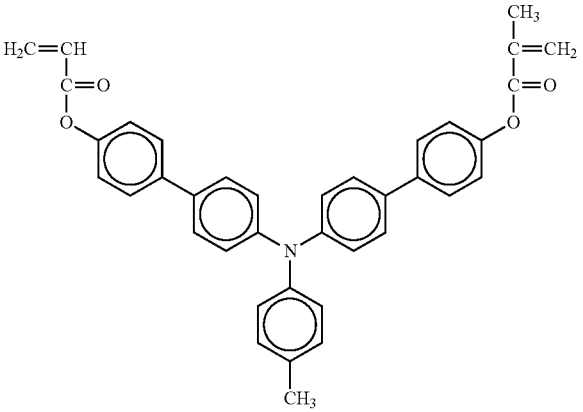

-continued
NO. 251
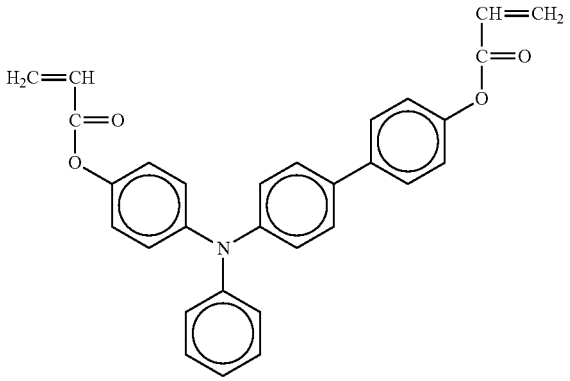
NO. 252
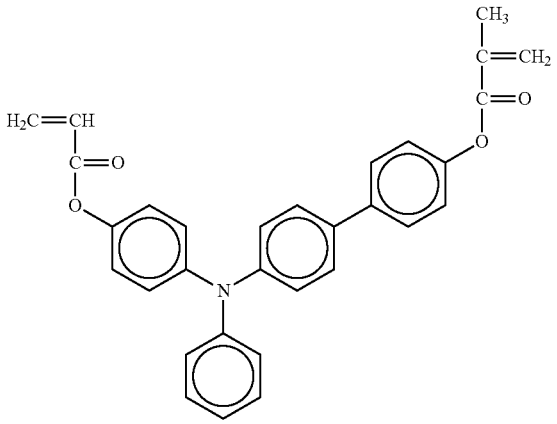
NO. 253
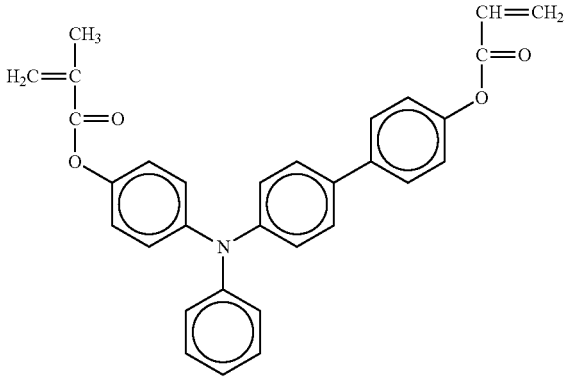
NO. 254
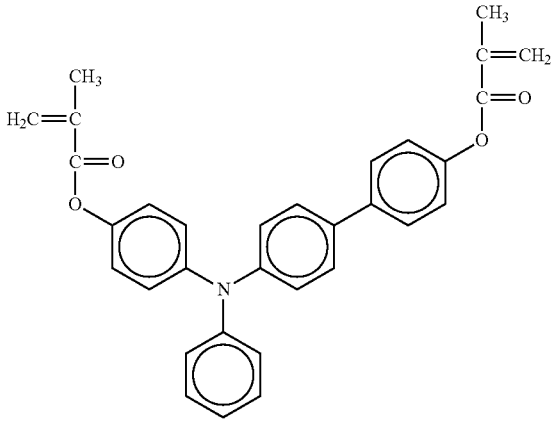
NO. 255
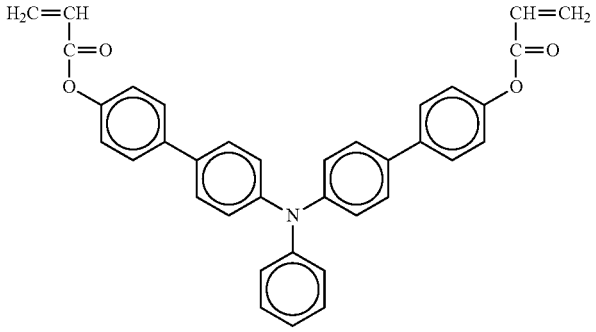
NO. 256
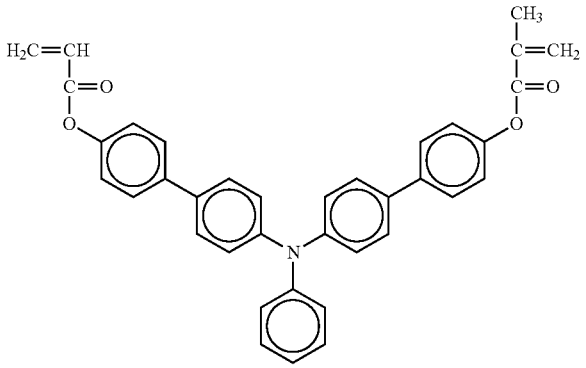

-continued
NO. 257
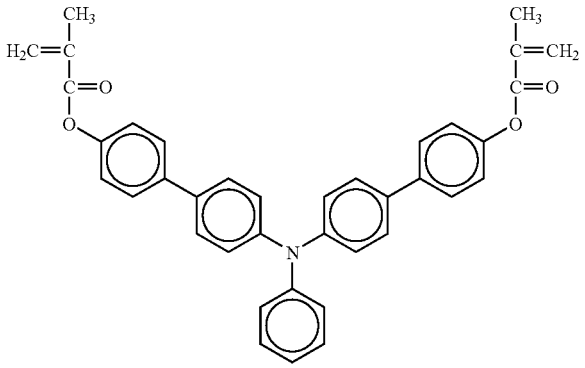
NO. 258
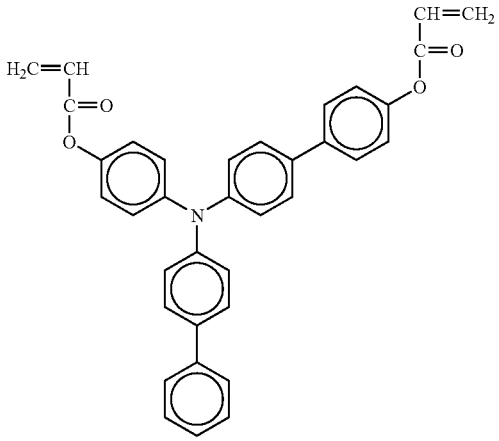
NO. 259
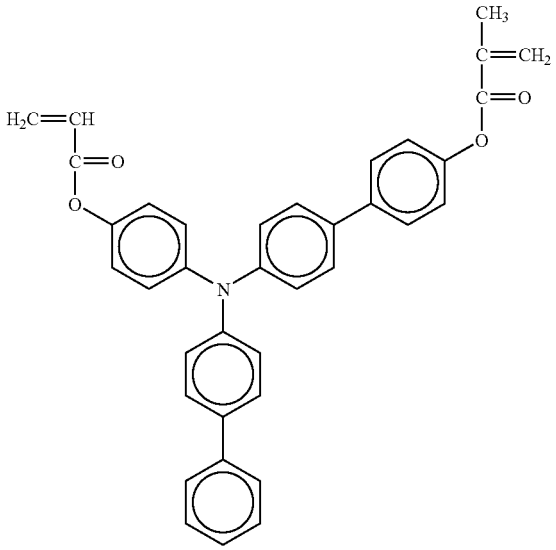
NO. 260
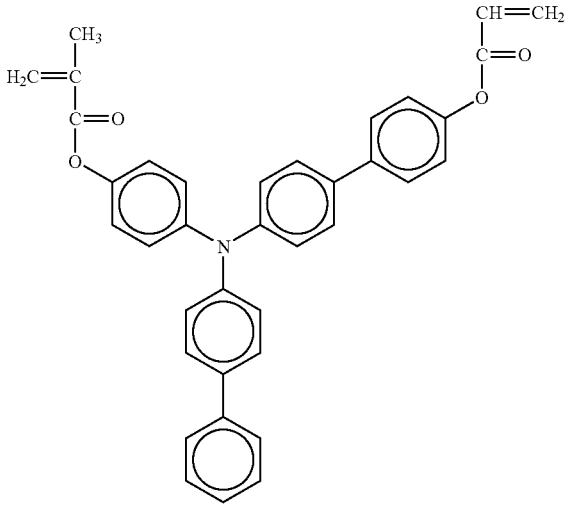
NO. 261
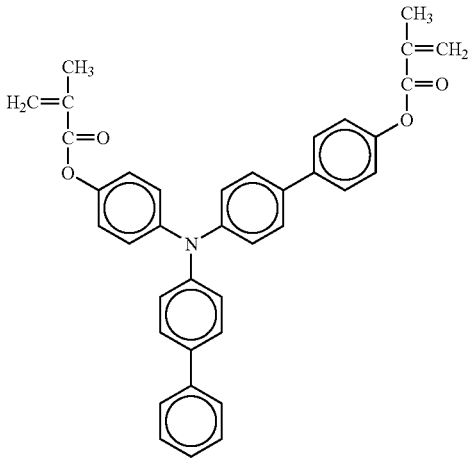
NO. 262
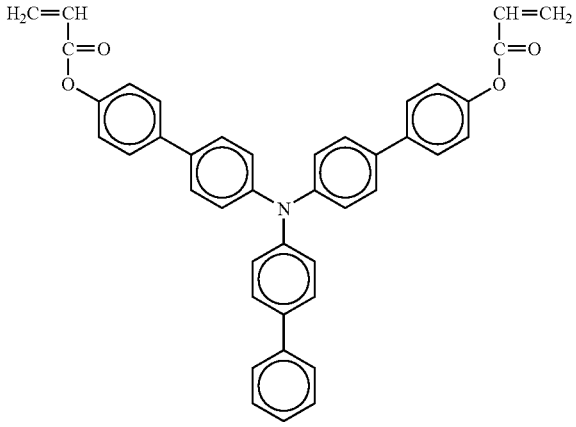

-continued
NO. 263
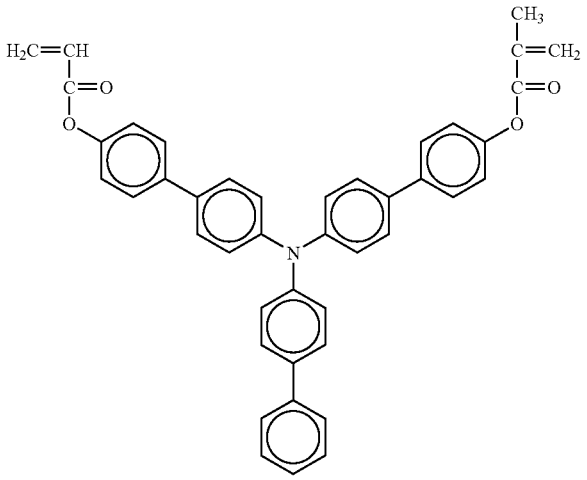
NO. 264
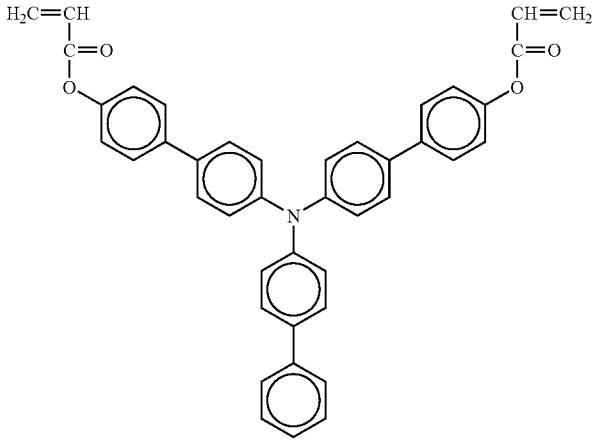
NO. 265
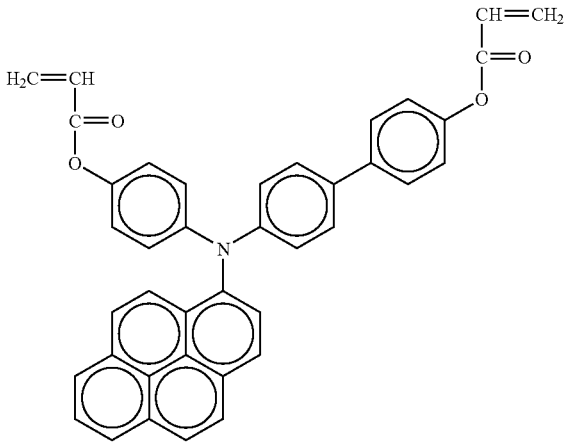
NO. 266
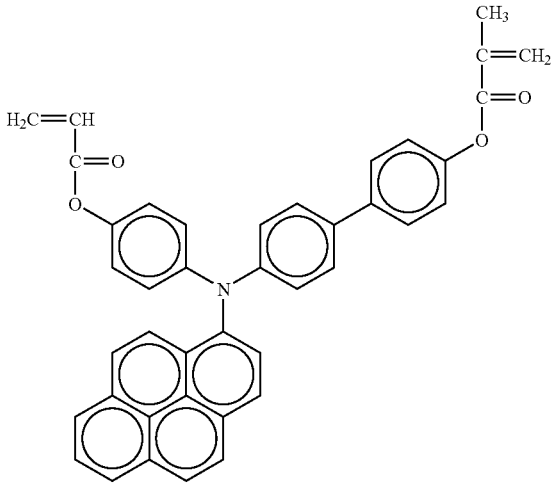
NO. 267
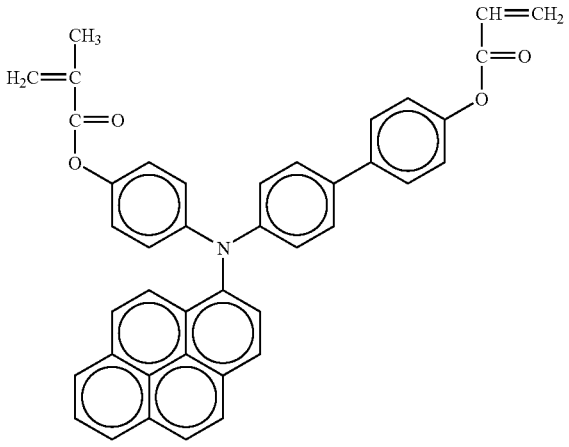
NO. 268
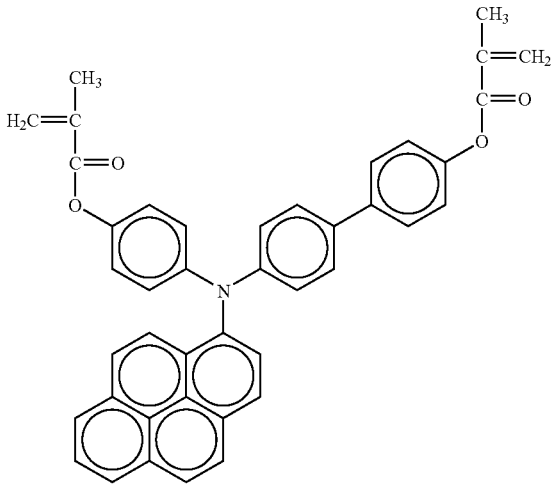

-continued
NO. 269
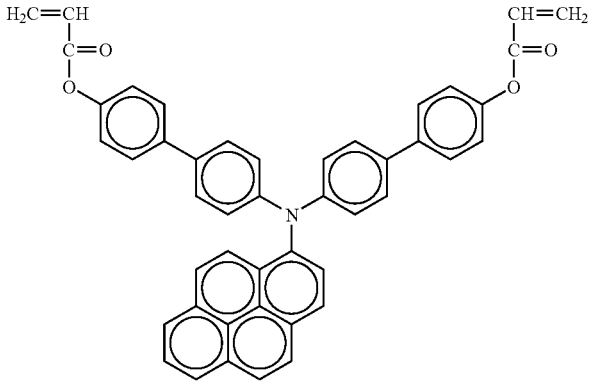
NO. 270
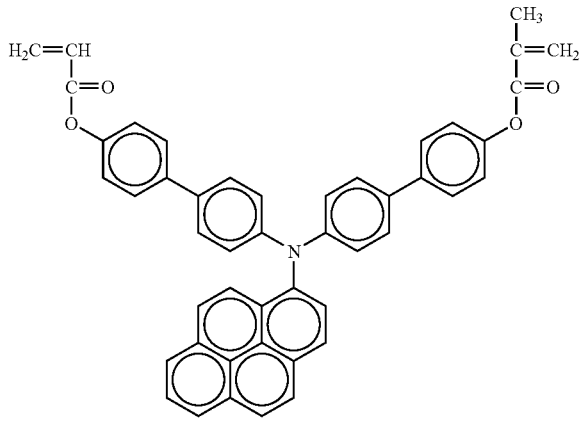
NO. 271
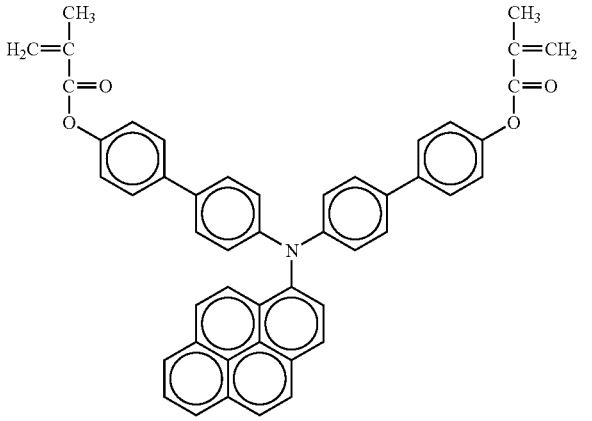
NO. 272
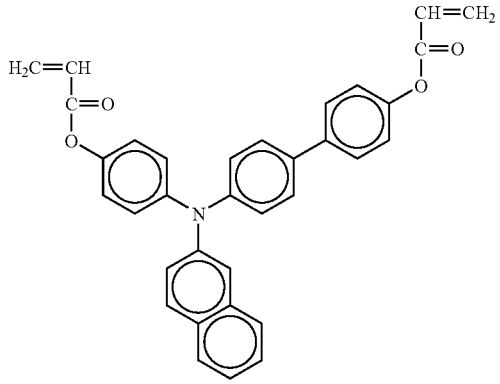
NO. 273
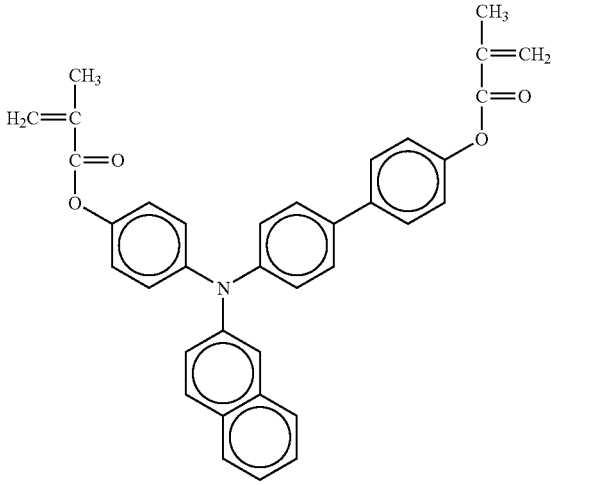
NO. 274
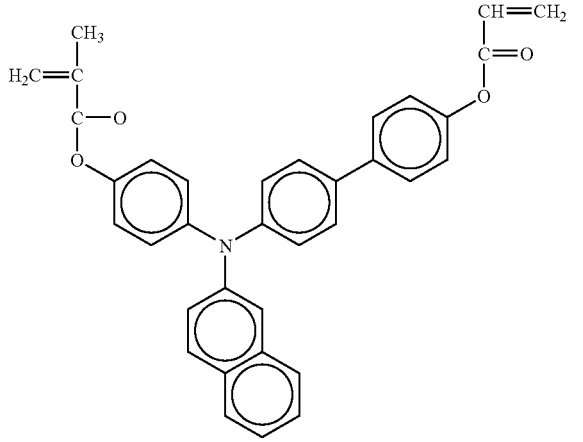

-continued
NO. 275
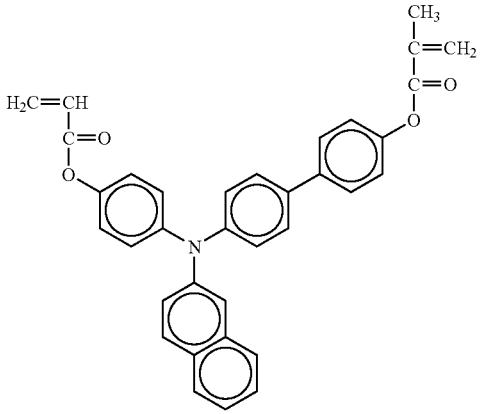
NO. 276
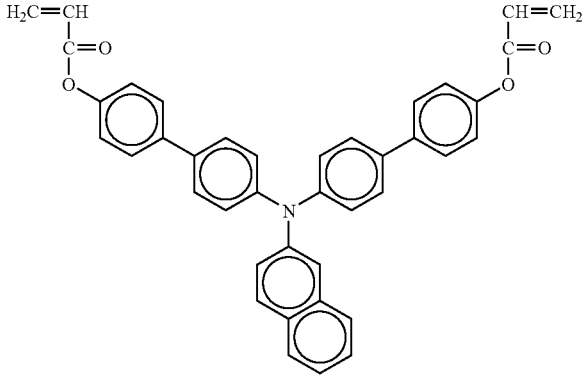
NO. 277
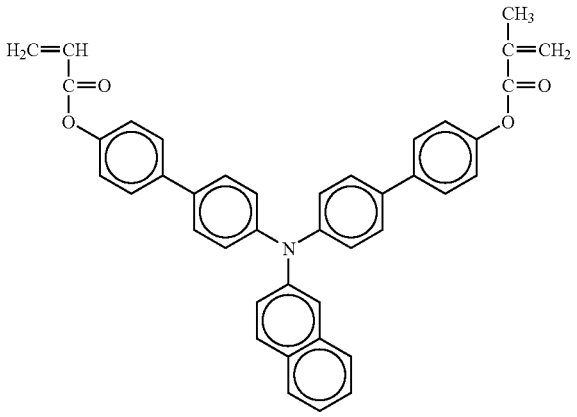
NO. 278
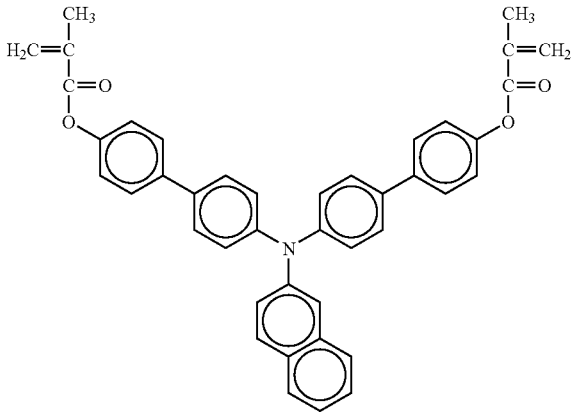
NO. 279
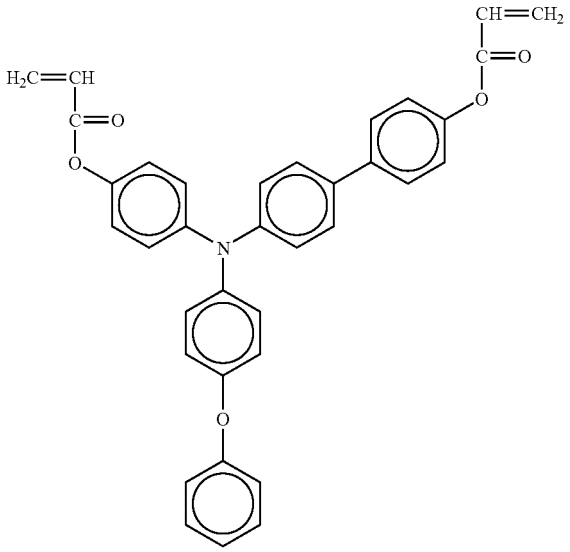
NO. 280
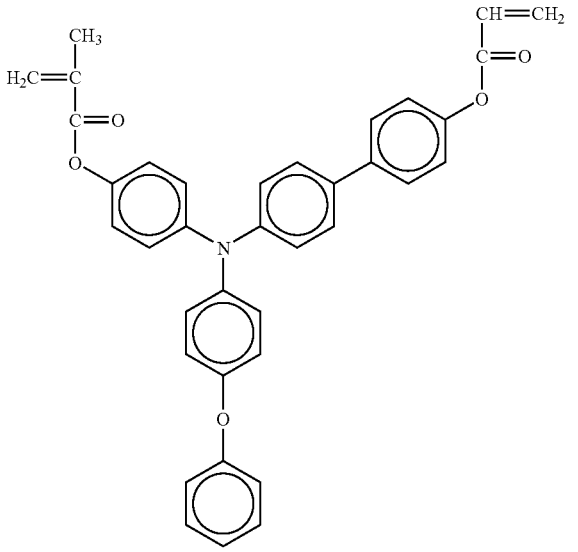

-continued
NO. 281
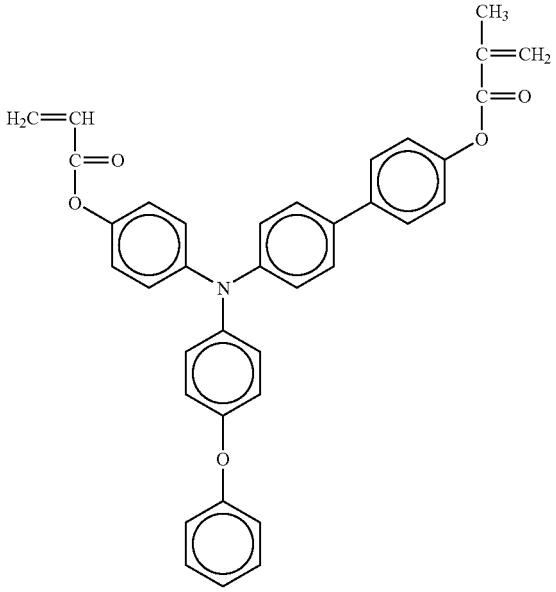
NO. 282
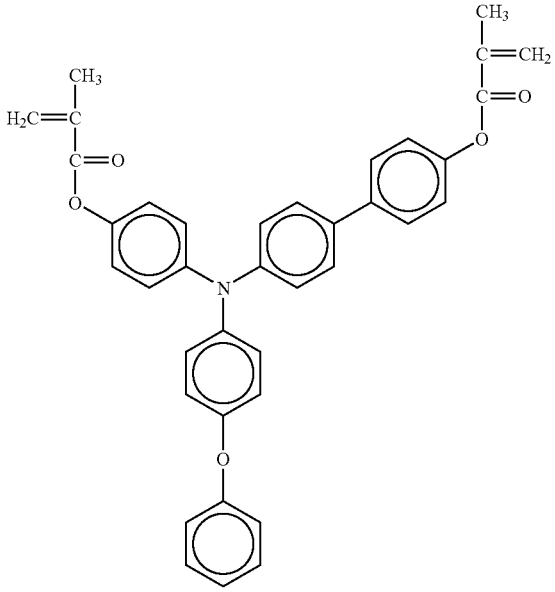
NO. 283
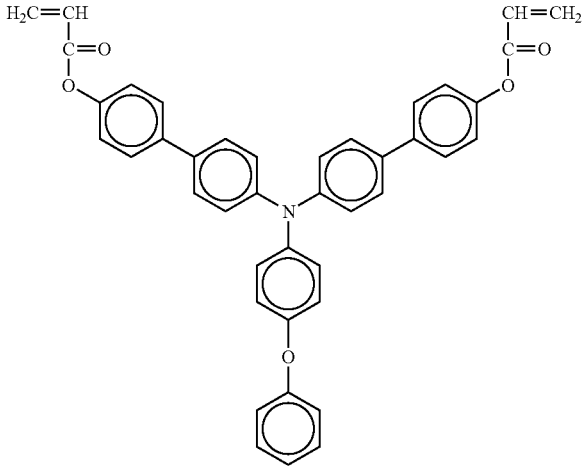
NO. 284
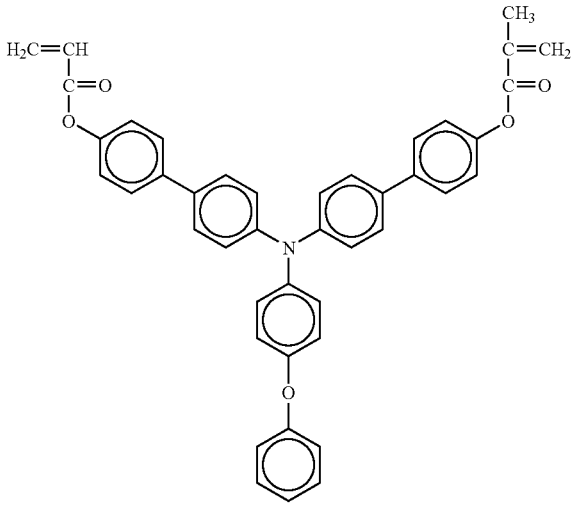
NO. 285
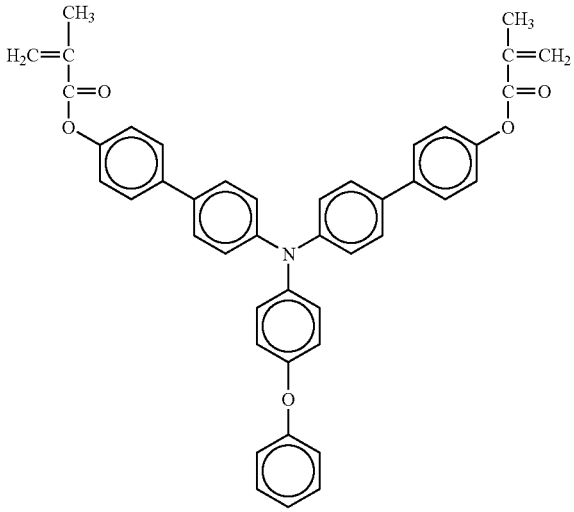
NO. 286
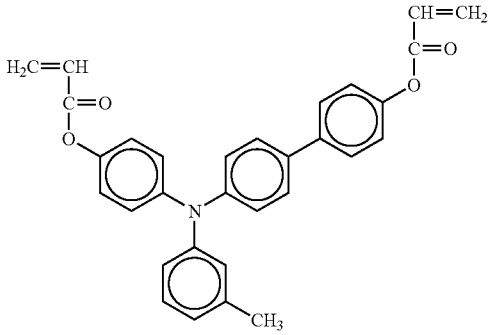

-continued
NO. 287
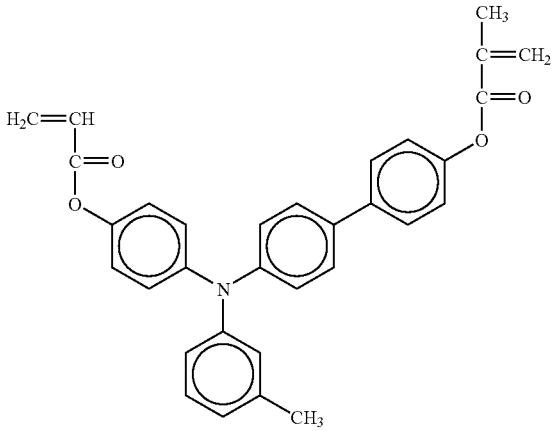
NO. 288
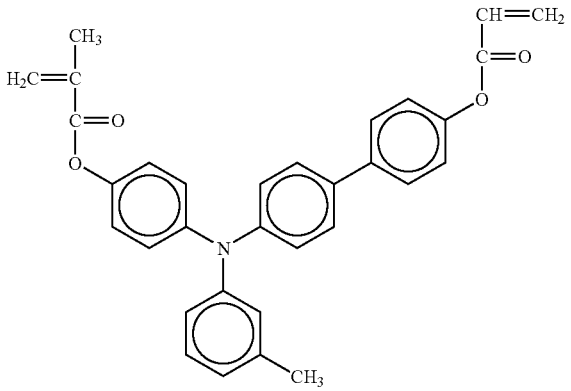
NO. 289
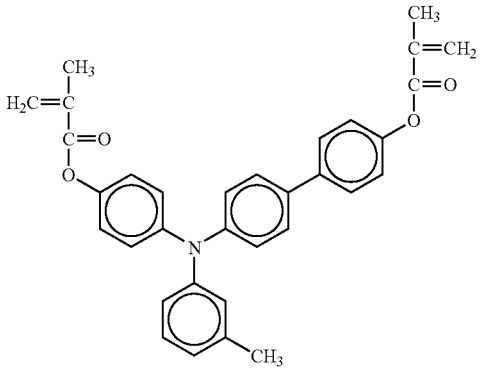
NO. 290
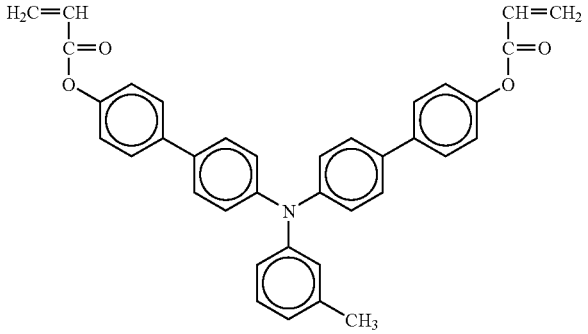
NO. 291
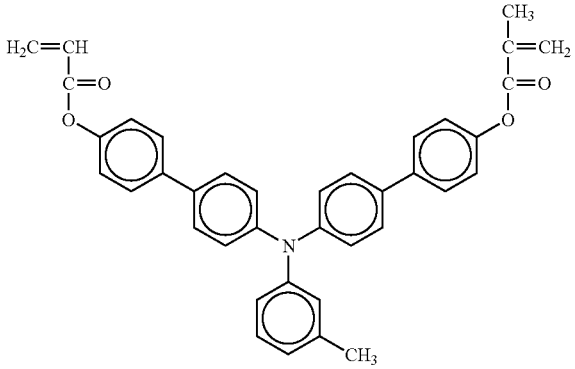
NO. 292
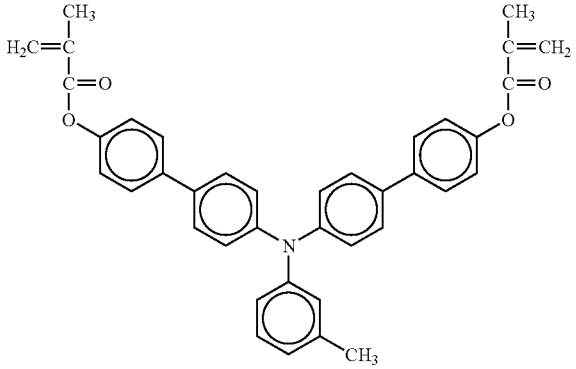
NO. 293
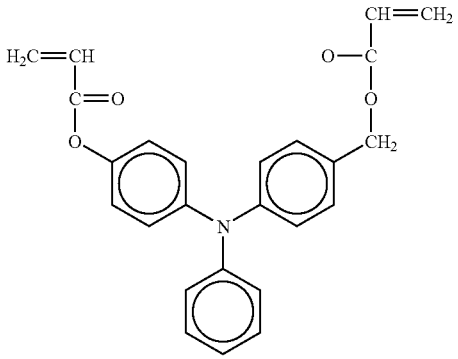
NO. 294
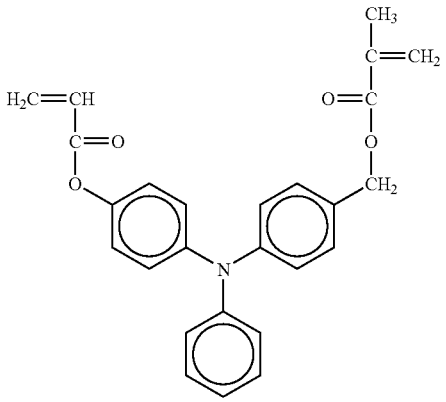

-continued
NO. 295
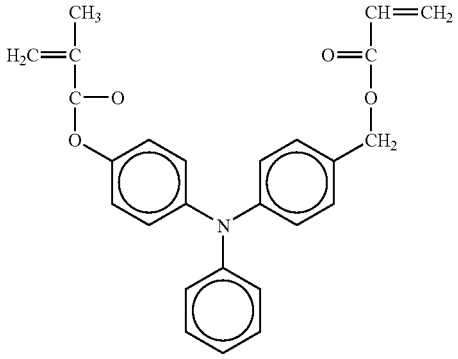
NO. 296
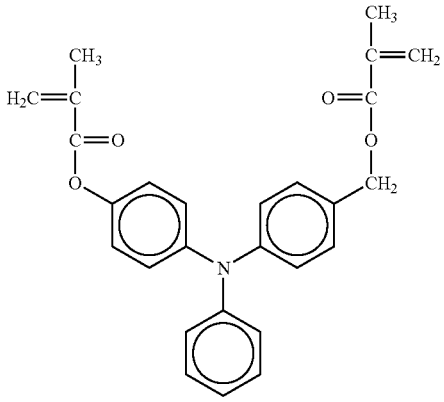
NO. 297
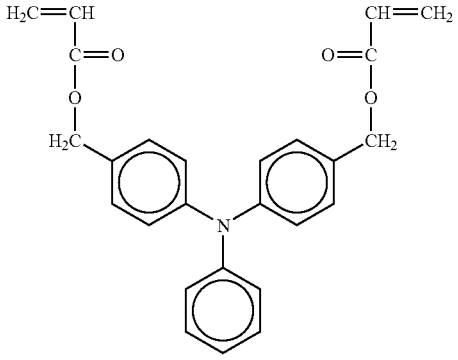
NO. 298
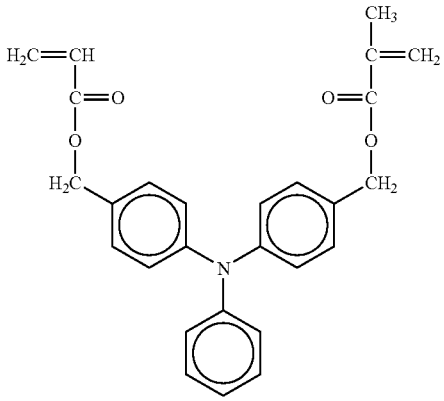
NO. 299
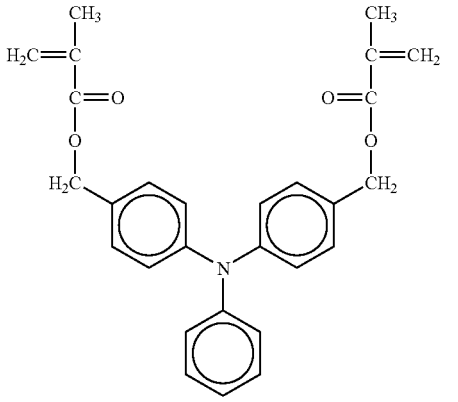
N0. 300
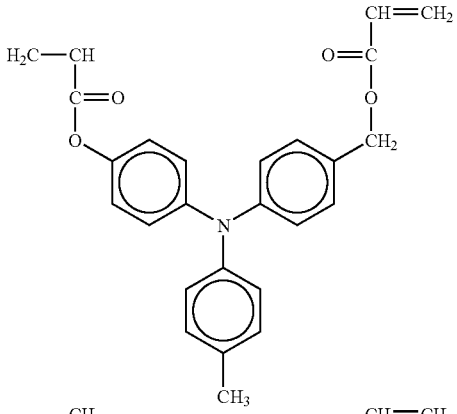
NO. 301
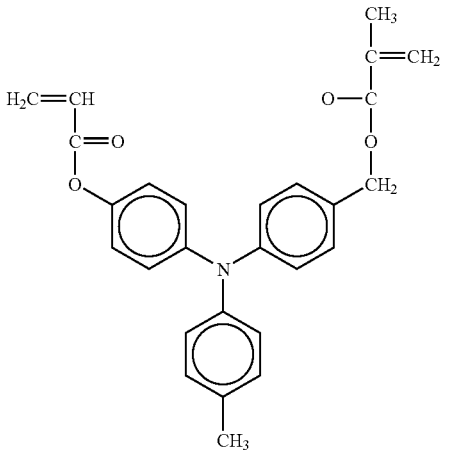
NO. 302
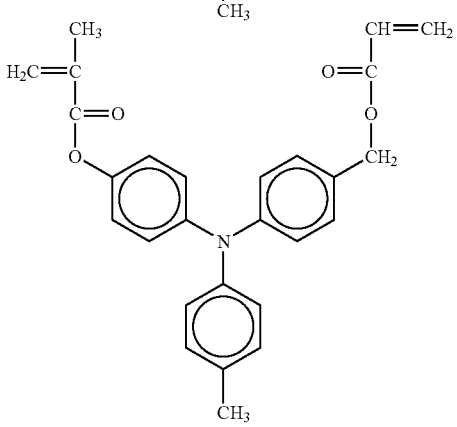

-continued
NO. 303
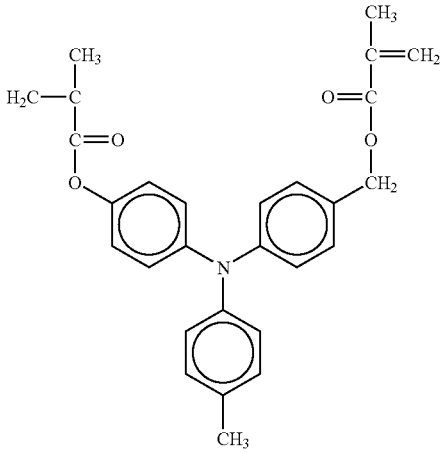
NO. 304
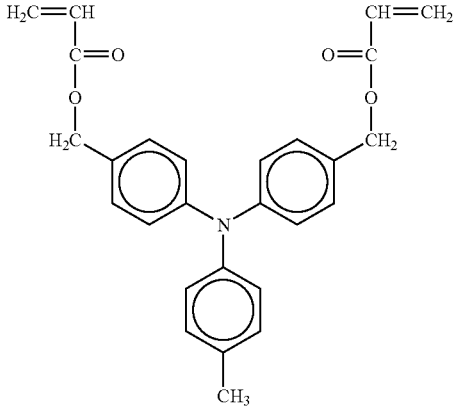
NO. 305
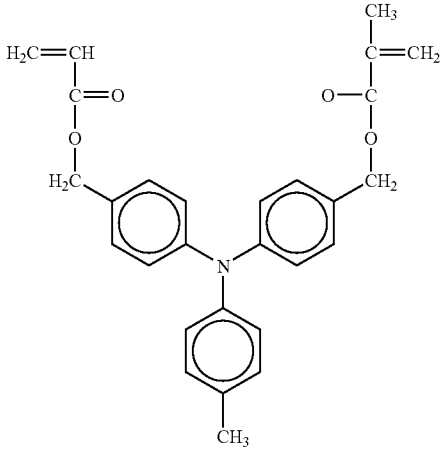
NO. 306
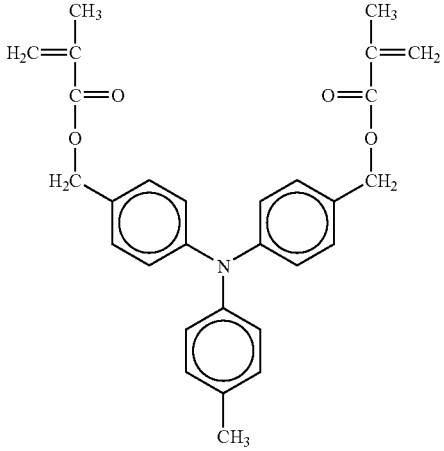
NO. 307
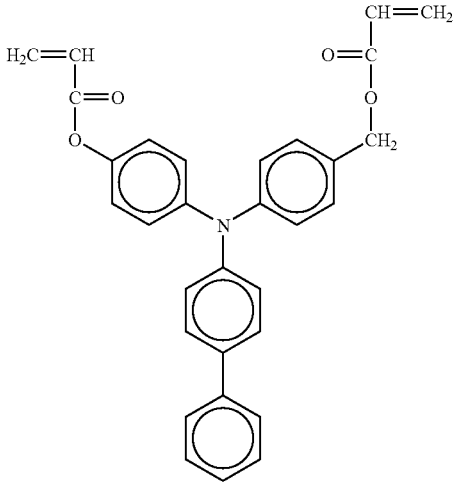
NO. 308
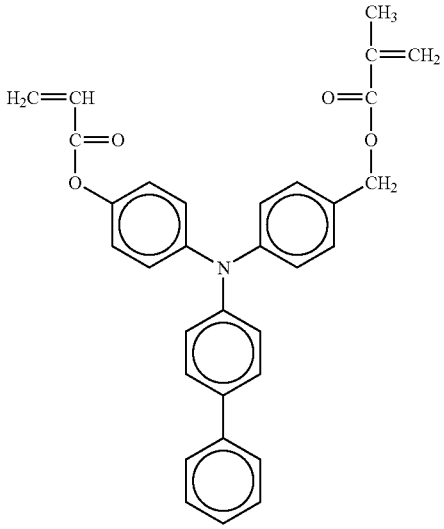

-continued
NO. 309
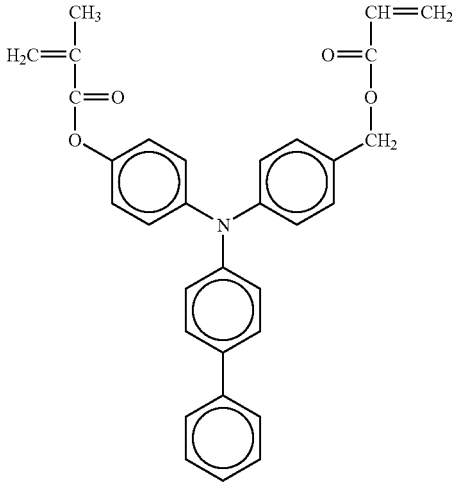
NO. 310
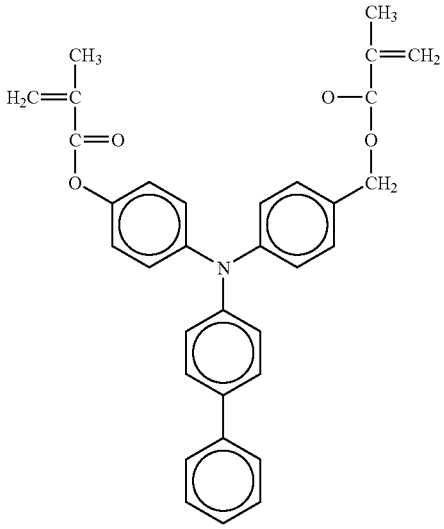
NO. 311
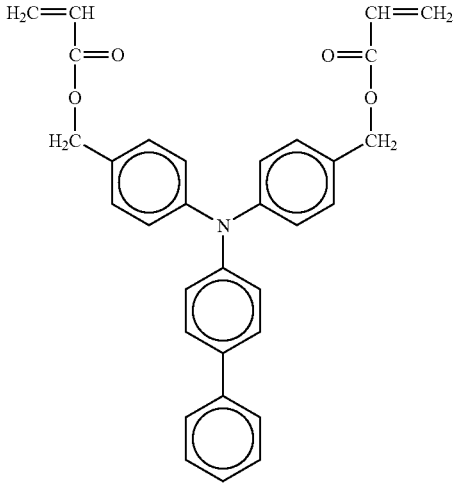
NO. 312
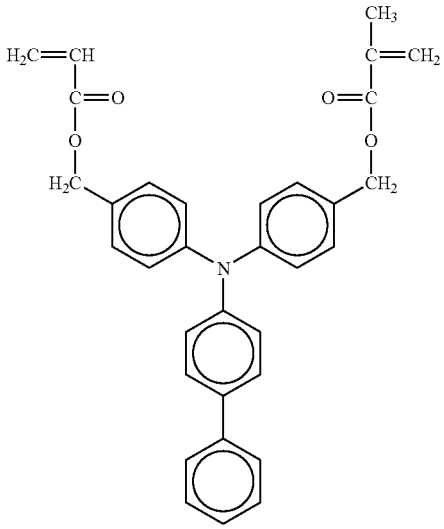
NO, 313
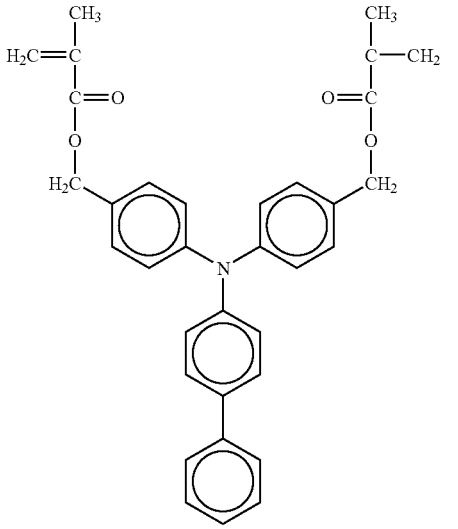
NO. 314
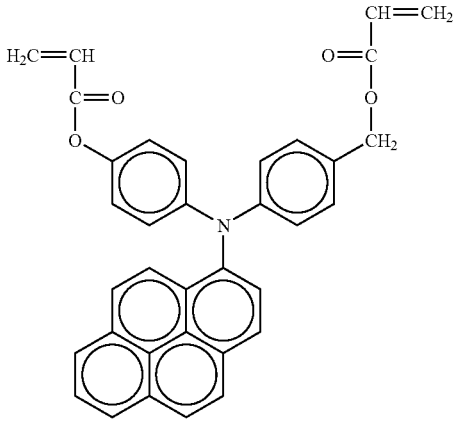

-continued
NO. 315
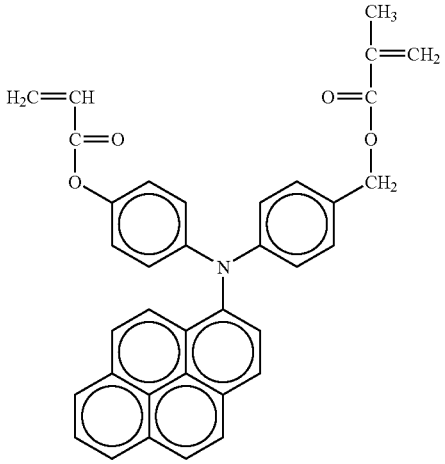
NO. 316
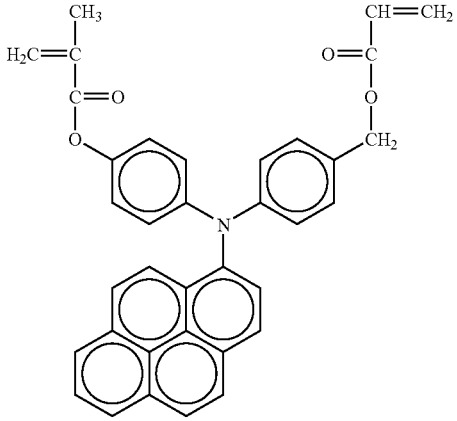
NO. 317
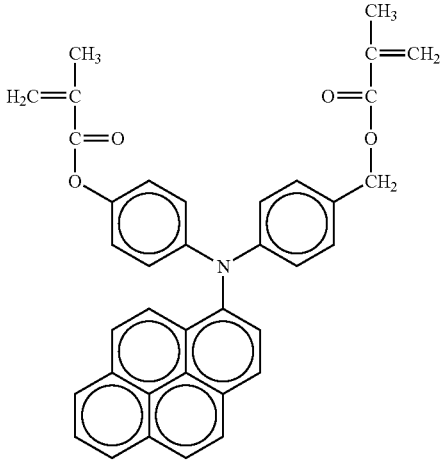
NO. 318
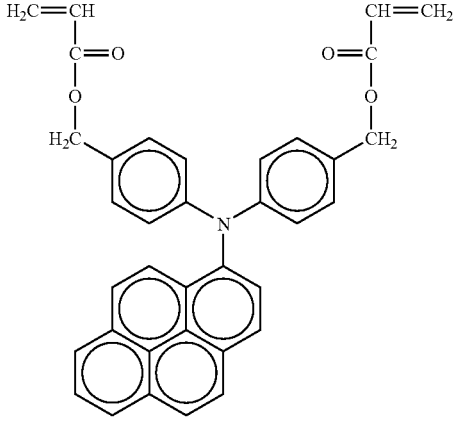
NO. 319
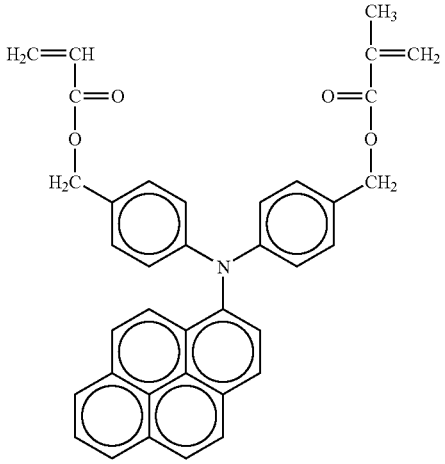
NO. 320
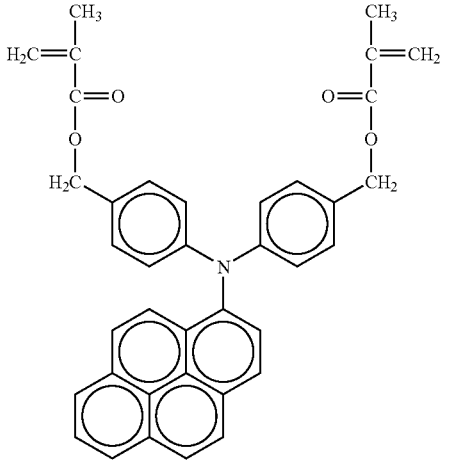

-continued
NO. 321
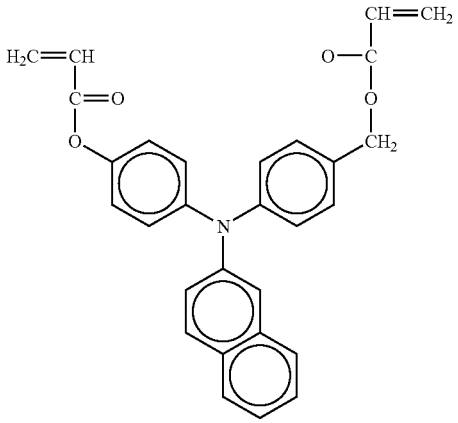
NO. 322
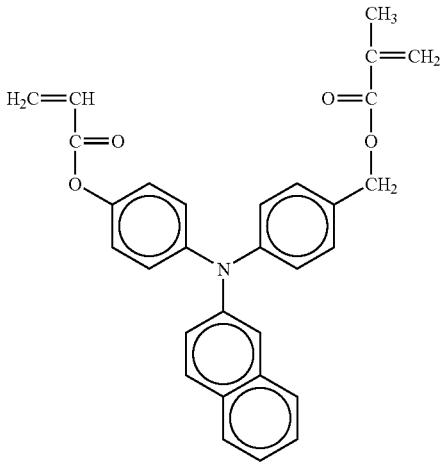
NO. 323
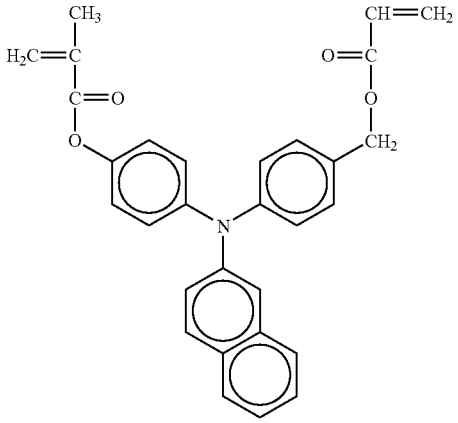
NO. 324
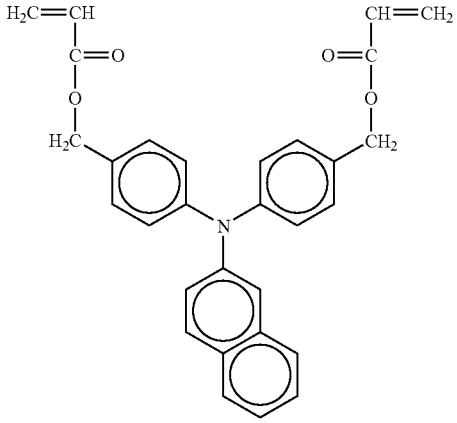
NO. 325
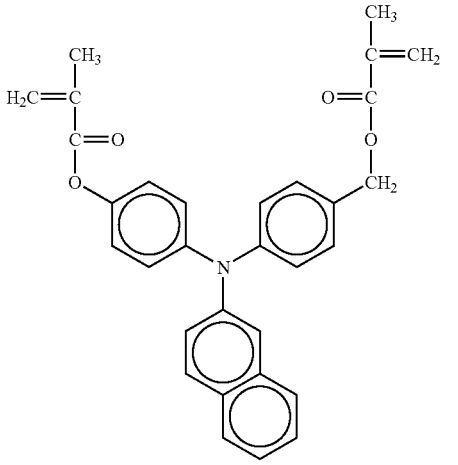
NO. 326
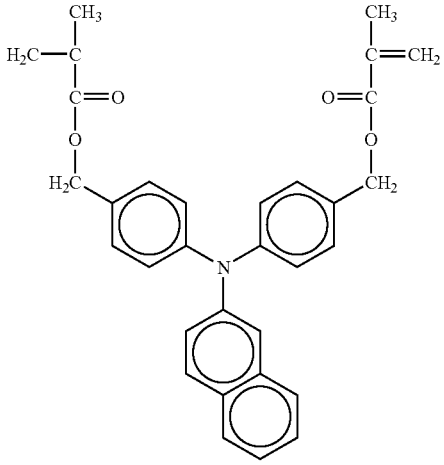

-continued
NO. 327
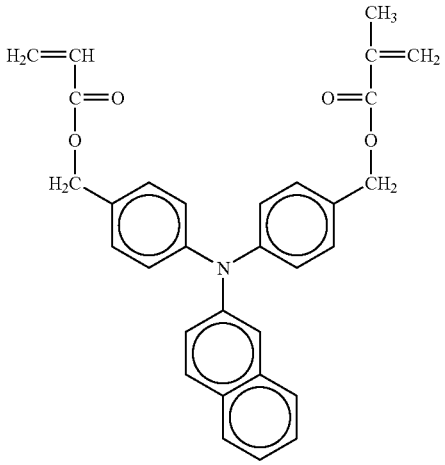
NO. 328
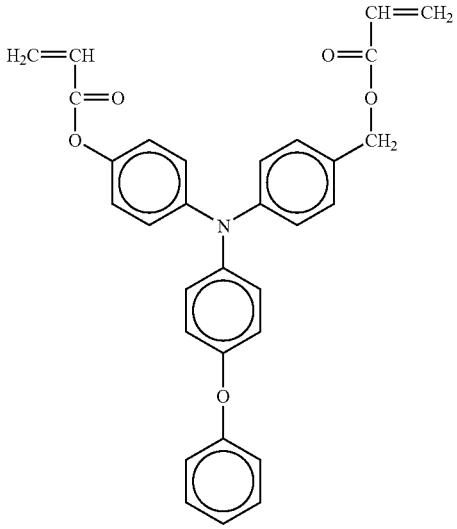
NO. 329
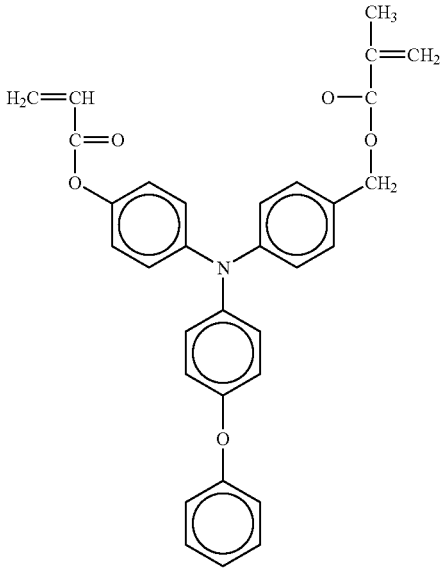
NO. 330
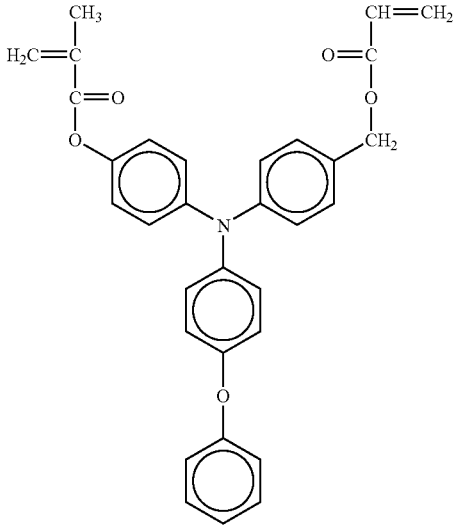
NO. 331
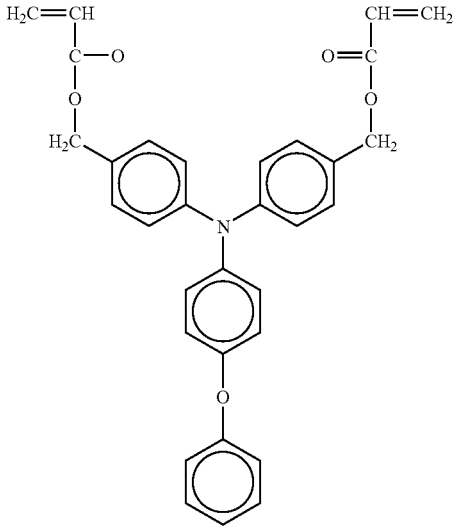
NO. 332
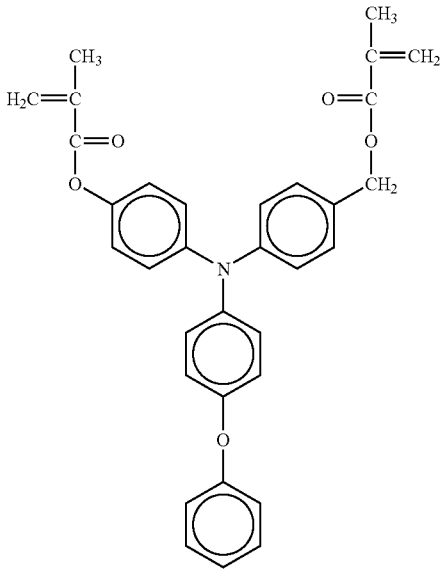

-continued
NO. 333
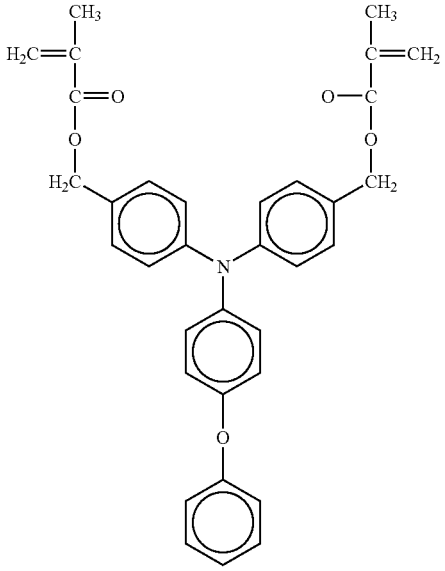
NO. 334
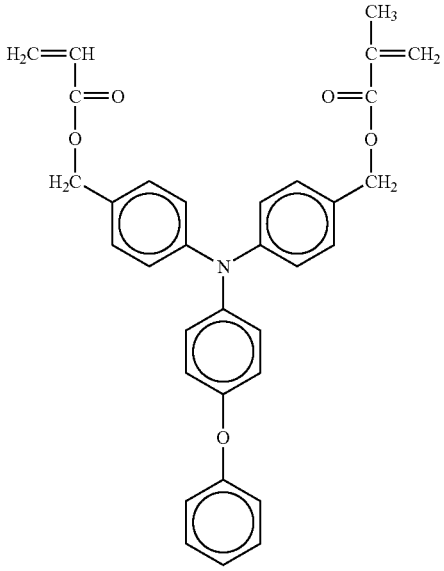
NO. 335
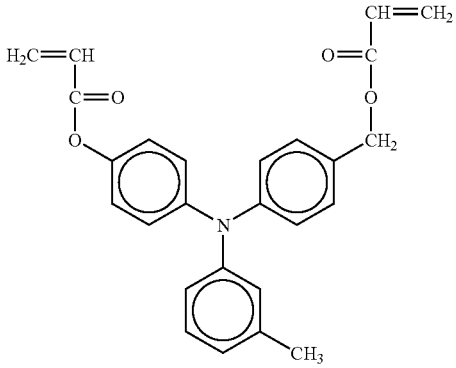
NO. 336
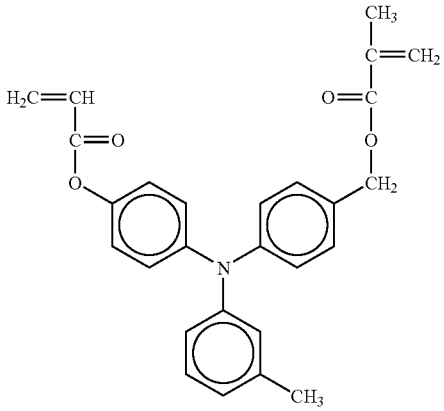
NO. 337
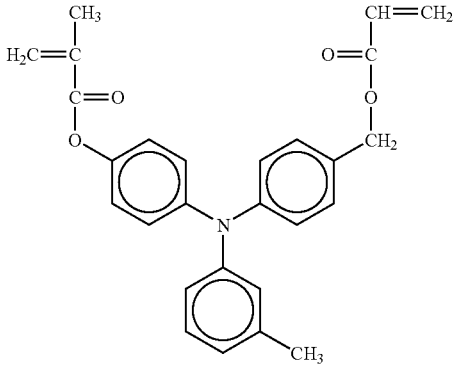
NO. 338
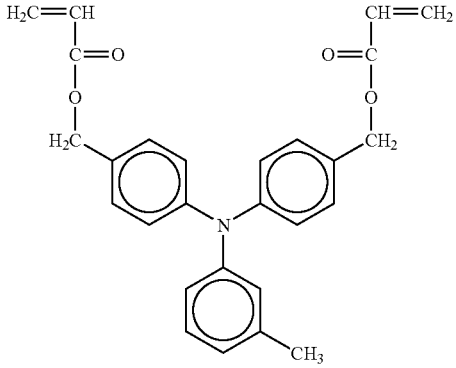

-continued
NO. 339
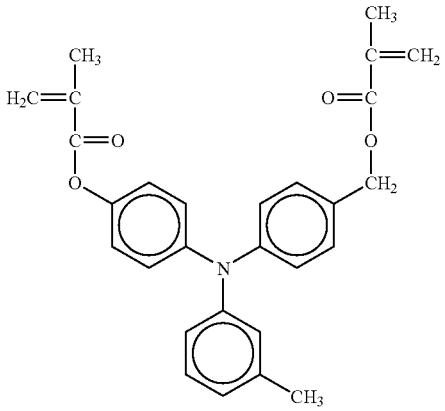
NO. 340
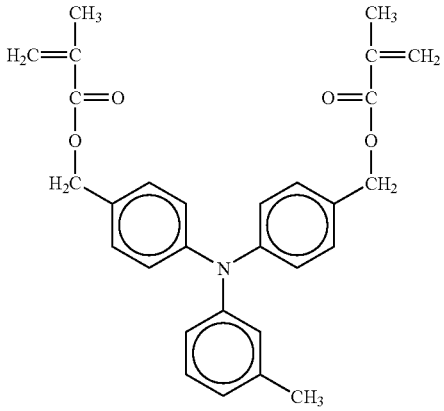
NO. 341
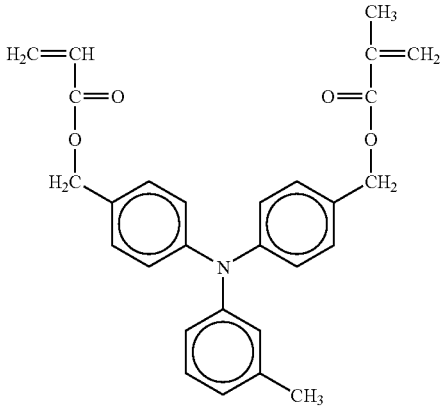
NO. 342
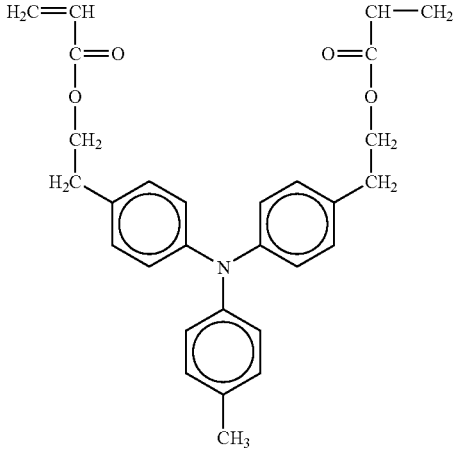
NO. 343
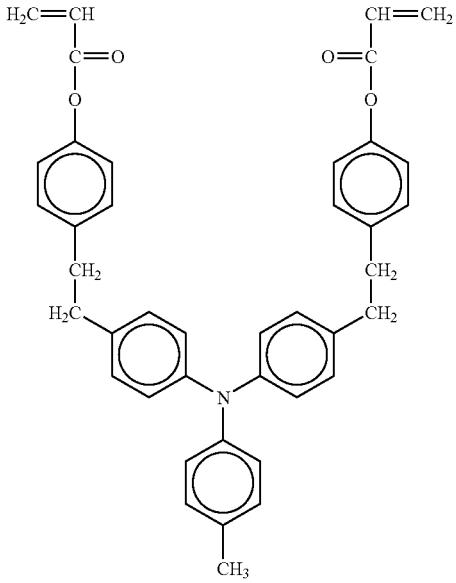
NO. 344
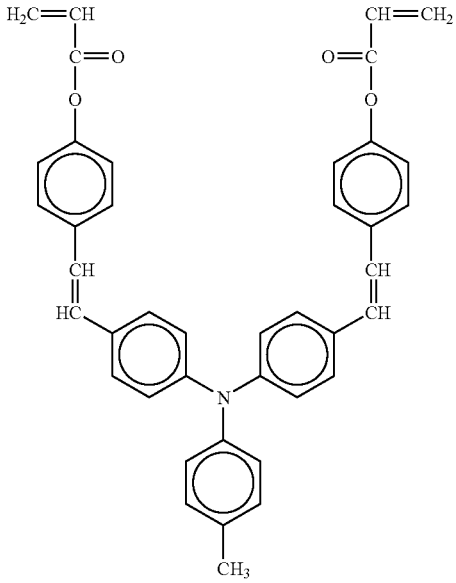

-continued
NO. 345
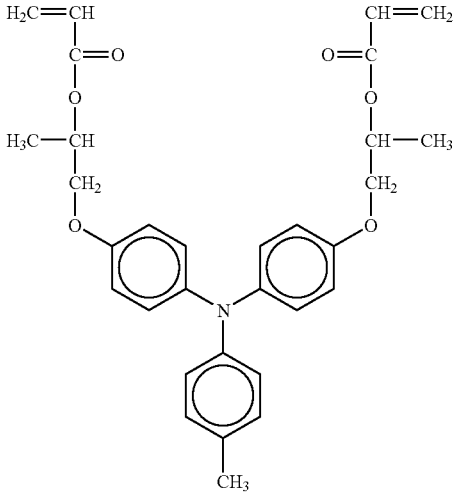
NO. 346
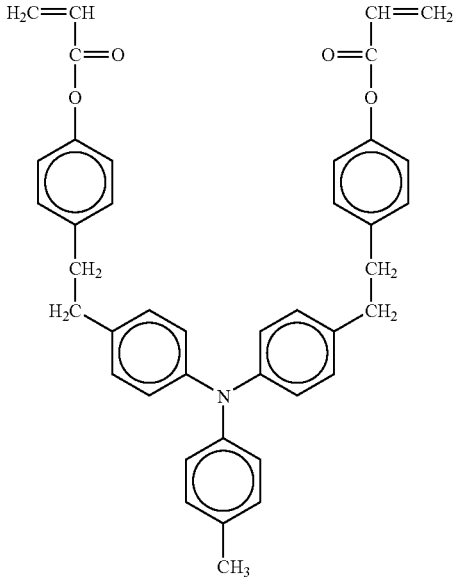
NO. 347
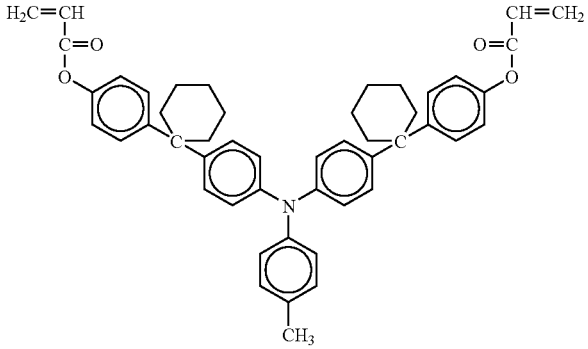
NO. 348
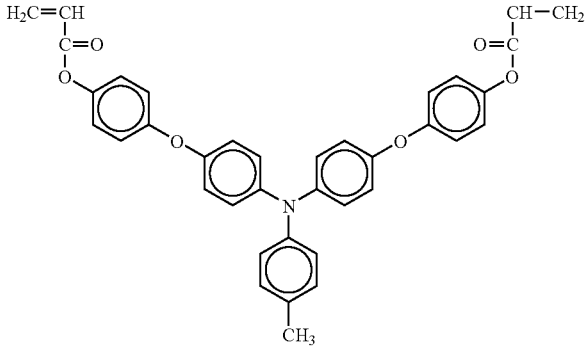
NO. 349
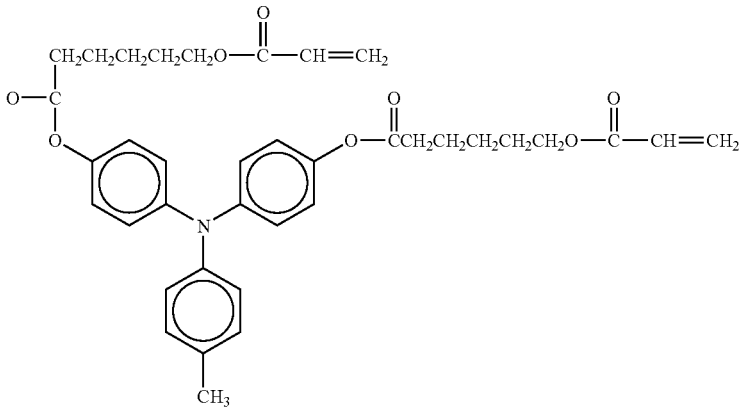

-continued
NO. 350
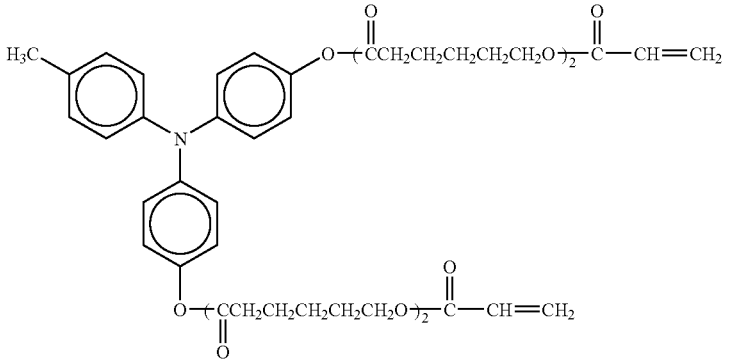
NO. 351
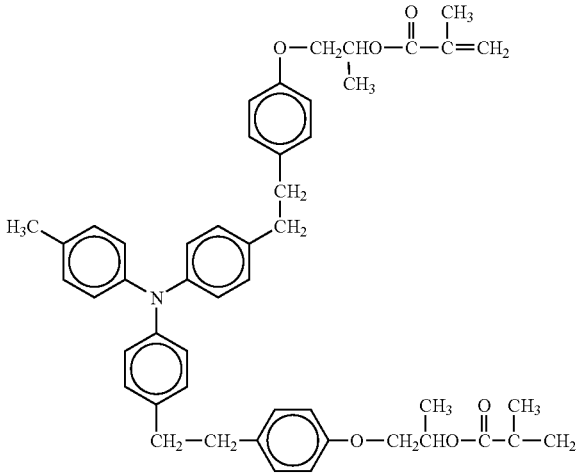
NO. 352
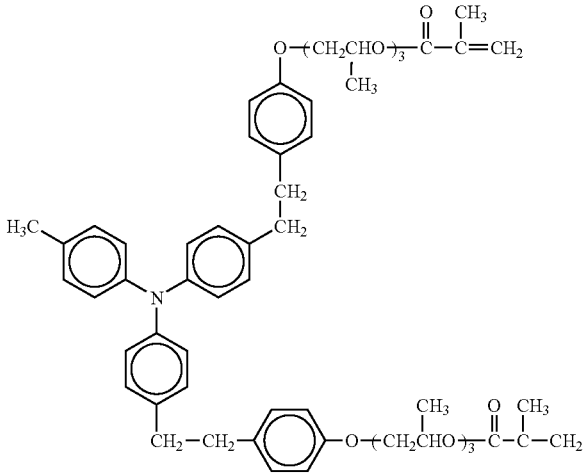
NO. 353
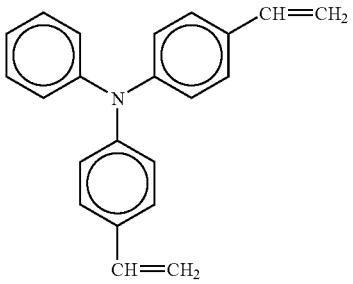
NO. 354
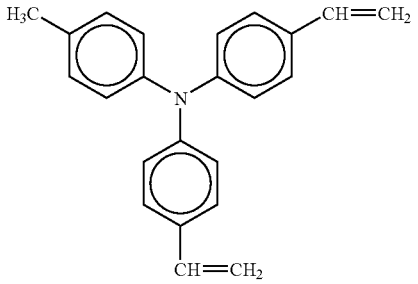
NO. 355
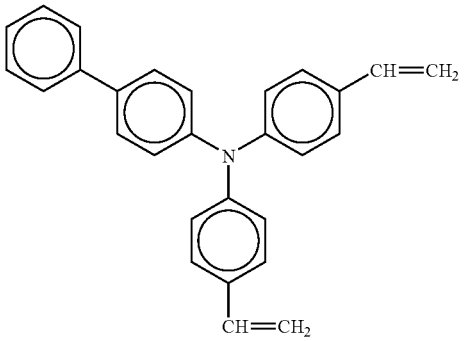
NO. 356
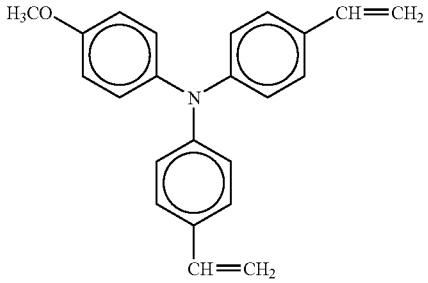

-continued
NO. 357
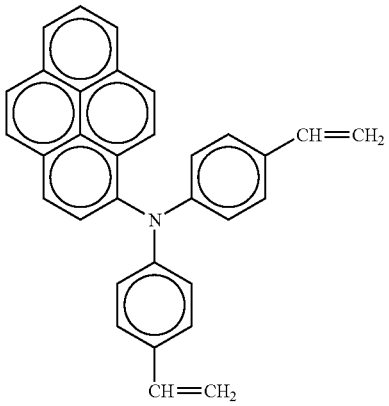
NO. 358
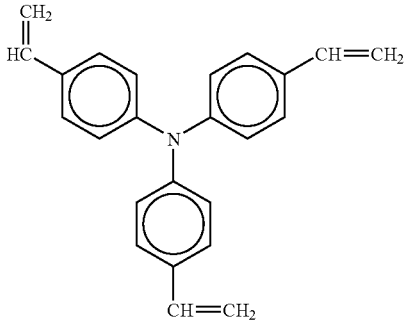
NO. 359
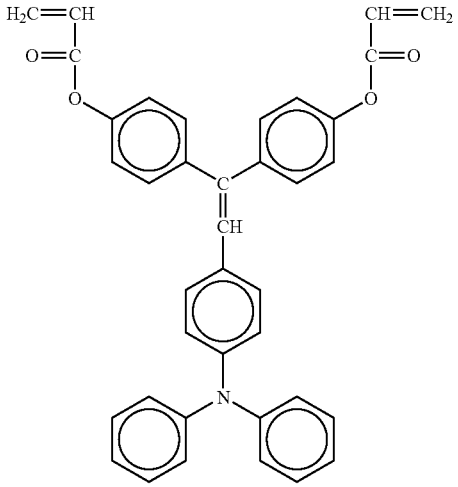
NO. 360
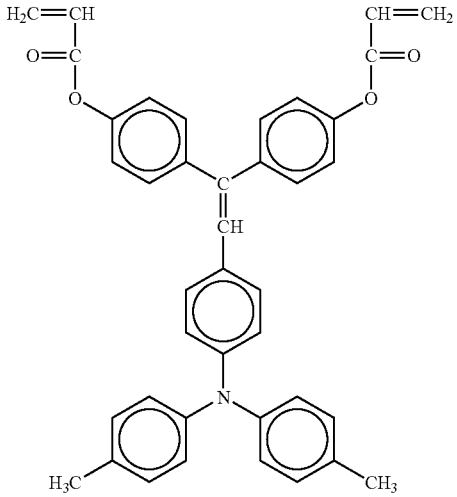
NO. 361
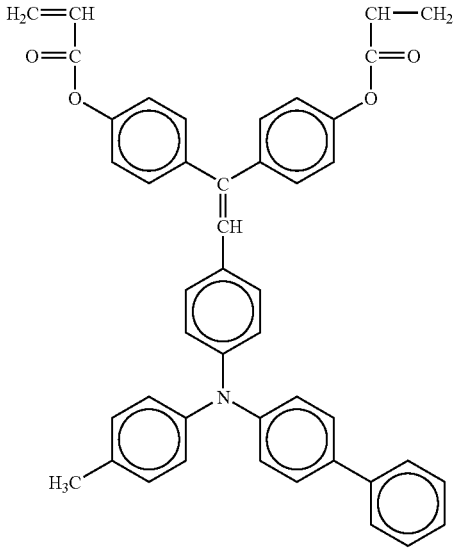
NO. 362
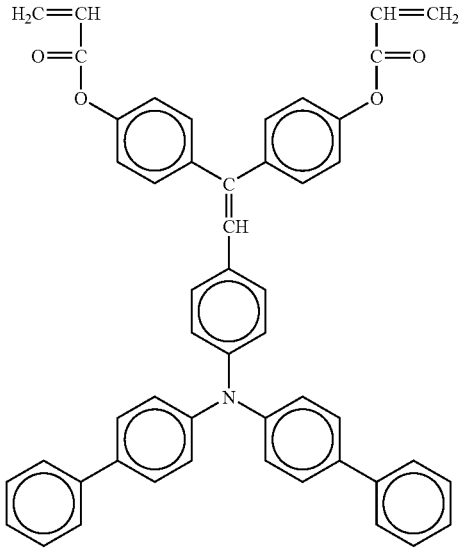

Radical Polymerizable Compound Having Three Functional Groups with a Charge Transport Structure Specific examples of the radical polymerizable compound having three functional groups with a charge transport structure include, but are not limited to, the following. These compounds are known compounds (for example, refer to JOP 2005-99688).

NO. 364

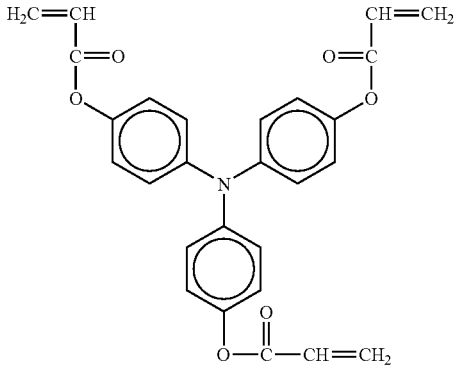

NO. 365

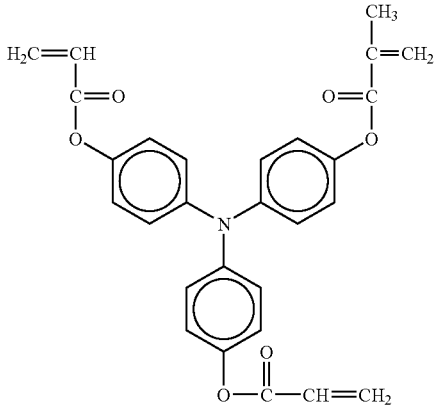

NO. 366

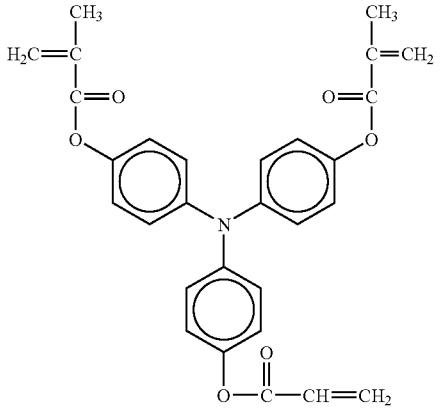

-continued

NO. 367

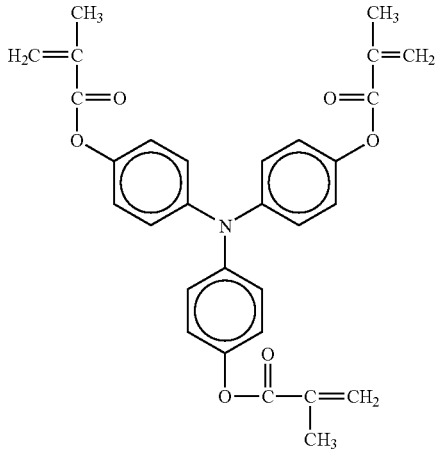

NO. 368

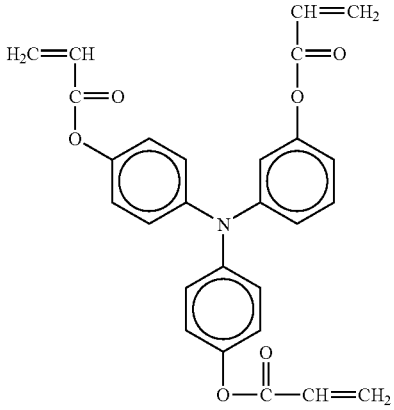

NO. 369

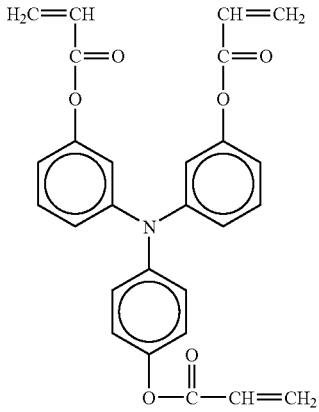

NO. 370

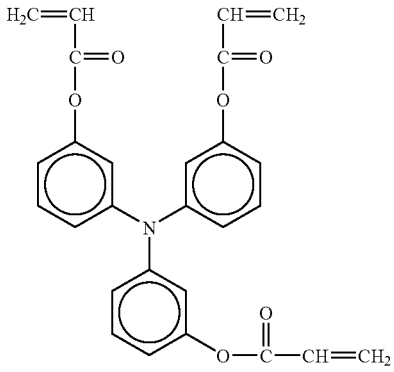

NO. 371
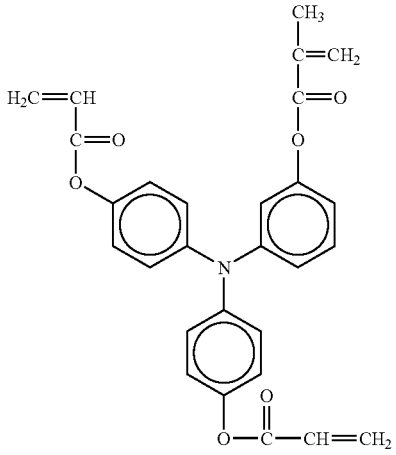
NO. 372
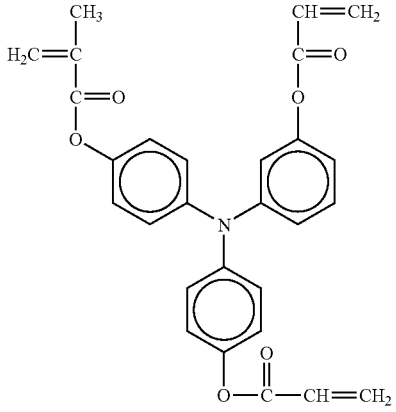
NO. 373
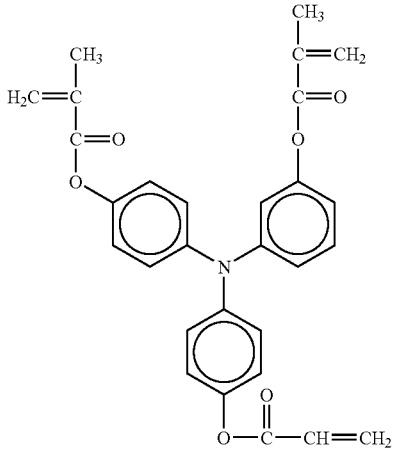
NO. 374
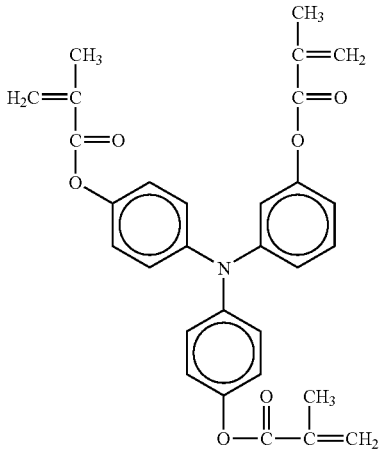
NO. 375
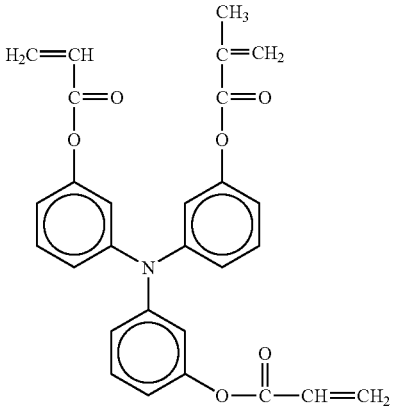
NO. 376
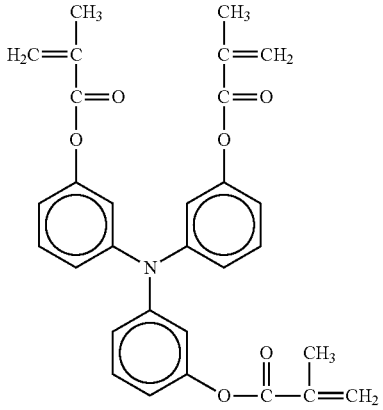

NO. 377
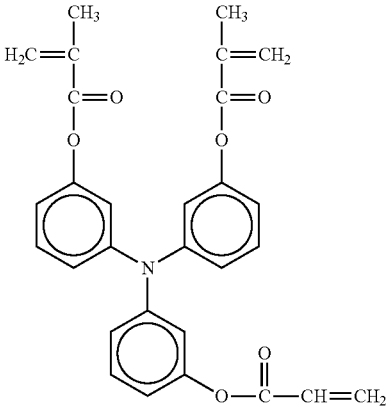
NO. 378
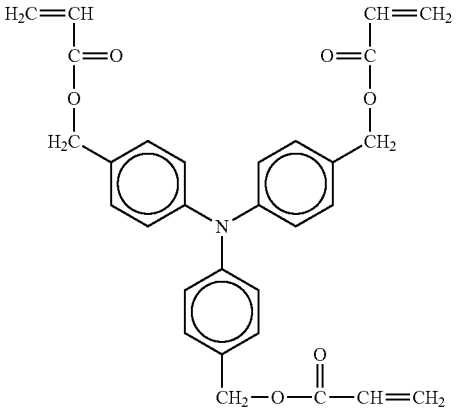
NO. 379
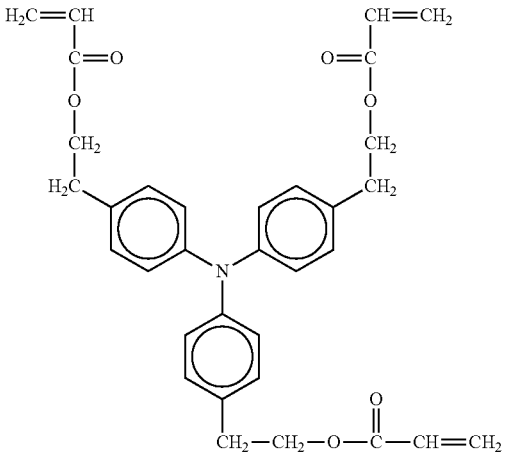
NO. 380
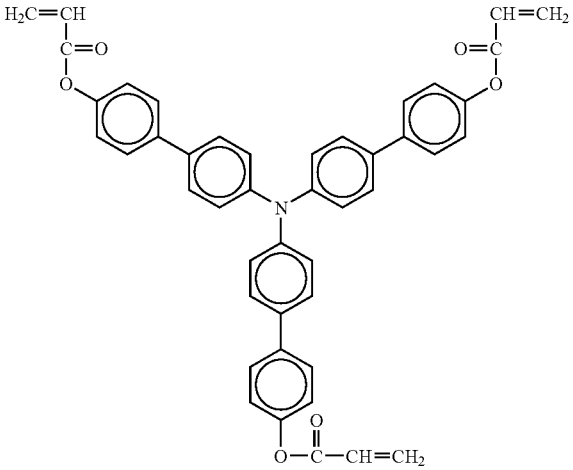
NO. 381
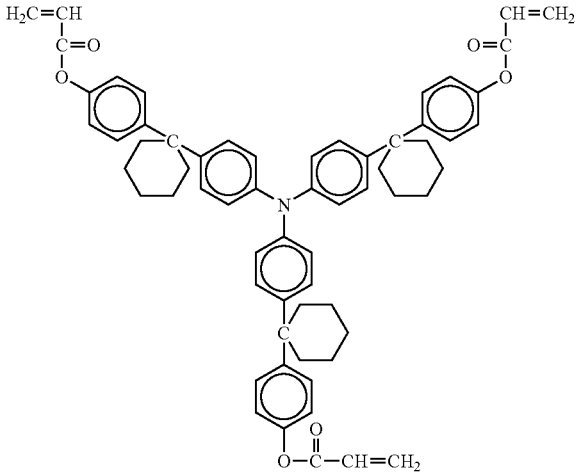
NO. 382
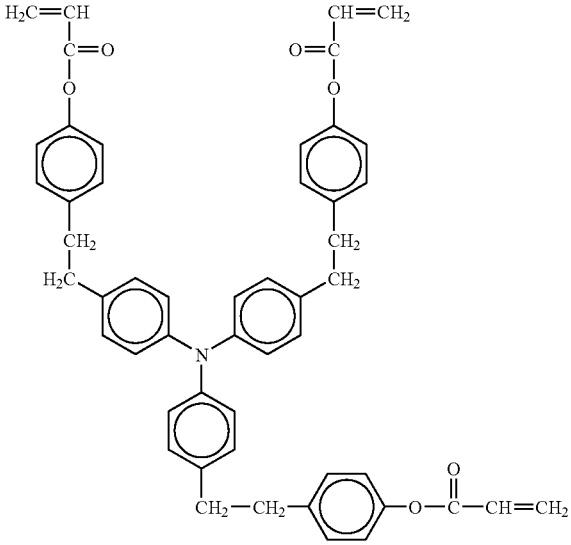

-continued

NO. 383

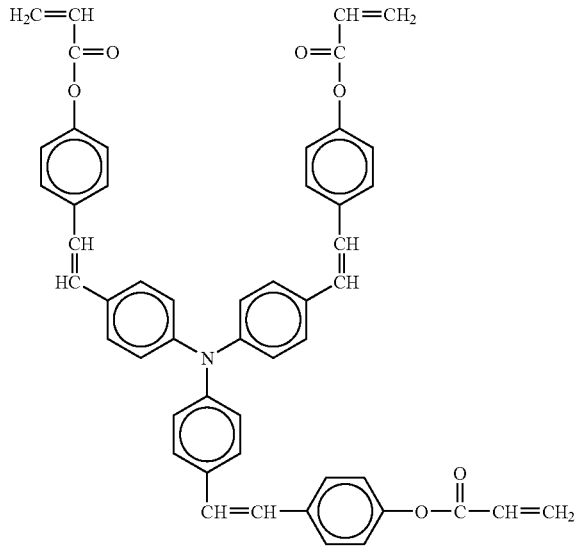

Surface Layer

The radical polymerizable compound for use in the present invention having a charge transport structure imparts a charge transport function to a cross-linked protective layer. The content of the radical polymerizable compound having a charge transport structure is from 20 to 80% by weight, and preferably from 30 to 70% by weight based on the total weight of the cross-linked surface layer. When the content is too small, the charge transport function of the cross-linked surface layer is not maintained, which may lead to the deterioration of the electric characteristics, for example, the decrease in the sensitivity and the rise in the residual voltage, during repetitive use. When the content is too large, the content of the radical polymerizable monomer having at least three functional groups without a charge transport structure decreases. That is, the cross-linking density decreases, resulting in insufficient abrasion resistance. Desired electric characteristics and anti-abrasion property vary depending on the process. Therefore, it is difficult to jump to any conclusion but considering the balance of both characteristics and property, the addition amount is most preferably in the range of from 30 to 70% by weight.

The surface layer for use in the present invention is formed by curing at least a monomer having at least three radical polymerizable functional groups without a charge transport structure and a radical polymerizable compound having a charge transport structure. In addition to this, a monomer or oligomer having one or two radical polymerizable functional groups and a functional monomer can be used to provide functions, for example, adjusting the viscosity upon coating, relaxing the stress in the cross-linked surface layer, decreasing the surface energy, and reducing the friction index, etc. Any known radical polymerizable monomers and oligomers can be used.

Specific examples of the monomer having one radical polymerizable functional group include, but are not limited to, monomers of 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and styrene.

Specific examples of the monomer having two radical polymerizable functional groups include, but are not limited to, 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopenthyl glycol diacrylate, bisphenol A-EO modified diacrylate, bisphenol F-EO modified diacrylate and neopenthyl glycol diacrylate.

Specific examples of the functional monomer include, but are not limited to, monomers in which a fluorine atom of, for example, octafluoro penthyl acrylate, 2-perfluorooctyl ethyl acrylate, 2-perfluorooctyl ethyl methacrylate and 2-perfluoroisononyl ethyl acrylate is substituted, and vinyl monomers, acrylates and methacrylates having polysiloxane groups, for example, acryloyl polydimethyl siloxane ethyl, methacryloyl polydimethyl siloxane ethyl, acryloyl polydimethyl siloxane propyl, acryloyl polydimethyl siloxane butyl and diacryloyl polydimethyl siloxane diethyl having 20 to 70 siloxane repeating units set forth in examined published Japanese patent application No. (hereinafter referred to as JPP) H05-60503 and H06-45770.

Specific examples of the radical polymerizable oligomer include, but are not limited to, epoxyacrylate based, urethane acrylate based, and polyester acrylate based oligomers.

When a monomer and/or oligomer having one or two radical polymerizable functional groups are contained in a large amount, the three dimensional cross-linked density of the cross-linked surface (protective) layer substantially decreases, which invites the deterioration of the anti-abrasion property. Therefore, the content of the monomer and oligomer is not greater than 50 parts by weight and preferably not greater than 30 parts by weight based on 100 parts by weight of the monomer having at least three radical polymerizable functional groups.

The surface layer for use in the present invention is formed by curing at least a monomer having at least three radical polymerizable functional groups without a charge transport structure and a radical polymerizable compound having a charge transport structure. To conduct the cross-linking reaction effectively, a polymerization initiator, for example, a thermal polymerization initiator or a photo polymerization initiator, can be added to the cross-linked surface layer, if desired.

Specific examples of the thermal polymerization initiator include, but are not limited to, peroxide-based initiators, for example, 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3, di-t-butyl peroxide, t-butylhydroperoxide, cumene hydroperoxide and lauroyl peroxide, and azo based initiators, for example, azobis isobutylnitrile, azobiscyclohexane carbonitrile, azobis methyl isobutyric acid, azobis isobutyl amidine hydrochloride salts, and 4,4'-azobis-4-cyano valeric acid.

Specific examples of the photo polymerization initiators include, but are not limited to, acetophenone based or ketal based photo polymerization initiators, for example, diethoxy acetopenone, 2,2-dimethoxy-1,2-diphenylethane-1-one, 1-hydroxy cyclohexyl phenylketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propane dione-2-(o-ethoxycarbonyl)oxime; benzoin ether based photo polymerization initiators, for example, benzoine, benzoine methyl ether, benzoin ethyl ether, benzoine isobutyl ether and benzoine isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triadine based compounds, and imidazole based compounds. In addition, compounds having photo polymerization promotion effect can be used alone or in combination with the photo polymerization initiators mentioned above. Specific examples thereof include, but are not limited to, triethanol amine, methyldiethanol amine, 4-dimethylamino ethyl benzoate, 4-dimethylamino isoamile benzoate, benzoic acid (2-dimethylamino) ethyl, and 4,4'-dimethylamino benzophenone.

These polymerization initiators can be used alone or in combination. The addition amount of the polymerization initiator is from 0.5 to 40 parts by weight and preferably from 1 to 20 parts by weight based on 100 parts by weight of the total weight of the radical polymerizable compound.

Furthermore, a liquid application for the cross-linked surface layer for use in the present invention can contain additives, for example, various kinds of plasticizing agents (to relax stress and improve adhesibility), leveling agents, and low molecular weight charge transport materials which are not radical polymerizable, if desired. Known additives can be used. Specific examples of the plasticizing agents include, but are not limited to, compounds, such as dibutyl phthalate and dioctyl phthalate, which are used for typical resins. The addition amount of the plasticizing agent is not greater than 20% by weight and more preferably not greater than 10% by weight based on all the solid portion of the liquid application. Specific examples of the leveling agents include, but are not limited to, silicone oils, such as dimethyl silicone oil, and methylphenyl silicone oil, and polymers or oligomers having a perfluoroalkyl group in its branch chain. The addition amount of the leveling agent is not greater than 3% by weight based on all the solid portion of the liquid of application.

Particulate Having Needle Form

The particulate having a needle form in the present invention is a particulate having an aspect ratio of not less than 2. Specific examples thereof include, but are not limited to, carbon nanotube, titanium oxide, zinc oxide, tin oxide, silicon oxide, zirconium oxide, potassium oxide, indium oxide, and aluminum oxide. Particularly, metal oxide particulates are preferred in terms of anti-abrasion property and electrostatic characteristics. Furthermore, in light of the stability of images, aluminum oxide is suitable.

The particulates are preferred to have a minor axis of not greater than 0.5 μm and a major axis of not greater than 10 μm. The aspect ratio is preferably from 2 to 500.

The evaluation of the form of particulates having a needle form is made by direct observation by an electron microscope, such as a scanning electron microscope (SEM) or a transmission electron microscope (TEM).

A specific observation example by a SEM is as follows: Fix particulate powder on an aluminum support with an electroconductive carbon double faced adhesive tape; Coat the powder with platinum-palladium to make a sample; Set the sample on the microscope stage of the SEM (S-4200, manufactured by Hitachi Ltd.); Observe the sample at an acceleration voltage of 5 kV with a magnification power of from 10,000 to 100,000; and evaluate the form of the observed image.

When the addition amount of particulates having a needle form in a surface layer is large, the anti-abrasion property is good. When the addition amount is too large, the residual voltage tends to rise and the transmission ratio of writing light through a protective layer decreases, resulting in the occurrence of side effect. Therefore, the addition amount is not greater than about 50% by weight and preferably not greater than about 30% by weight based on the total weight of the solid portion.

Furthermore, these particulates having a needle form can be subjected to surface treatment using at least one kind of surfactant. This is preferred in terms of dispersion property. Deterioration of the dispersion property of particulates having a needle form causes a rise of the residual voltage, degradation of transparency of the coated layer, deficiency of the coated layer and deterioration of anti-abrasion property. Therefore, this can develop into a large problem hindering high durability and quality images. As the surfactant, any known surfactant can be used. Surfactants that can maintain the insulation property of particulates having a needle form are preferred. Specific examples thereof include, but are not limited to, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like. These can be preferably used in combination to improve the dispersability of particulates having a needle form and to prevent formation of blurred images.

When treated with a silane coupling agent, blurred images tend to be produced. However, when a silane coupling agent is used in combination with one of the surfactants mentioned above, the effect of the silane coupling is possibly restrained. These materials can be used alone or in combination.

Formation of Cross-linked Surface Layer

The cross-linked surface layer for use in the present invention is formed by coating and curing a liquid application containing at least a monomer having at least three radical polymerizable functional groups without having a charge transport structure, a radical polymerizable compound having a charge transport structure and particulates having a needle form. When the monomer contained in a liquid application is liquid, it is possible to dissolve other components in the liquid application and coat the liquid application. A liquid application can be also diluted in a suitable solvent before coating, if desired. Specific examples of such solvents include, but are not limited to, an alcohol based solvent, such as methanol, ethanol, propanol and butanol; a ketone based solvent, such as acetone, methyl ethyl ketone, methyl isobutyl ketone, and cyclohexanone; an ester based solvent, such as ethyl acetate and butyl acetate; an ether based solution, such as tetrahydrofuran dioxane and propyl ether; a halogen based solvent, such as dichloromethane, dichloroethane, trichloroethane and chlorobenzene; an aromatic series based solvent, such as benzene, toluene and xylene; and a cellosolve based solvent, such as methyl cellosolve, ethyl cellosove and cellosolve acetate. These solvent scan be used alone or in combination. The dilution ratio by these solvents depends on the solubility and the coating method of a composition, and a desired layer thickness. A dip coating method, a spray coating method, a beat coating method, a ring coating method, etc., can be used for coating the liquid application.

In the present invention, subsequent to the application of the liquid application, the cross-linked surface layer is cured upon application of external energy, for example, heat, light and radiation. A method of applying heat energy can be used in which the cross-linked surface layer is heated from the application surface side or the substrate side using a gas, for example, air and nitrogen, vapor, or various kinds of heat media, infra-red radiation and electromagnetic waves. The heating temperature is preferably from 100° C. to 170° C. When the heating temperature is too low, the reaction speed is slow so that the curing reaction does not finish completely. When the heating temperature is too high, the curing reaction is not uniformly conducted. Thereby, the cross-linked surface layer is significantly distorted inside. To uniformly conduct the curing reaction, it is also effective to heat a cross-linked surface layer at a relatively low temperature, for example lower than 100° C., followed by heating at a relatively high temperature, for example, higher than 100° C., to complete the curing reaction. As light energy, a UV irradiation light source, such as a high pressure mercury lamp or a metal halide lamp, having an emission wavelength mainly in the ultraviolet area can be used. A visible light source can be selected according to the absorption wavelength of a radical polymerizable compound and a photopolymerization initiator. The irradiation light amount is preferably from 50 mW/cm$^2$ to 1,000 mW/cm$^2$. When the irradiation light amount is too small, it takes a long time to complete the curing reaction. When the irradiation light amount is too large, the reaction is not uniformly conducted and the degree of roughness of the cross-linked surface layer increases. As radiation ray energy, electron beam can be used. Among these forms of energies, thermal or light energy is suitably used in terms of easiness of reaction speed control and simplicity of a device.

The layer thickness of the cross-linked surface layer of the present invention is dependent on the layer structure of an image bearing member in which the cross-linked surface layer is used. The layer thickness is described in combination with the layer structure as follows.

The composition contained in the liquid application of a cross-linked surface layer can contain a binder resin as long as the smoothness, electric characteristics, durability of an image bearing member are not adversely affected. However, when polymer materials, such as a binder resin, are contained in a liquid application, the phase separation tends to occur due to bad compatibility between the polymer and polymers produced from the curing reaction of radical polymerizable compositions (a monomer having a radical polymerizable function group and a radical polymerizable compound having a charge transport structure), which leads to increasing the roughness of the surface of the cross-linked surface layer. Therefore, it is preferred not to use a binder resin.

The cross-linked surface layer for use in the present invention is preferred to have a bulky charge transport structure for maintaining the electric characteristics and to increase the cross-linking bond density for fortifying the strength. Upon curing after coating of a cross-linked surface layer, when extremely high energy is applied from outside and the reaction is rapidly conducted, the curing advances non-uniformly so that the irregularity of the cross-linked surface layer is high. It is preferred to use external energy, for example, thermal or optical energy, because it is possible to control the reaction speed by the heating condition, the irradiation condition of light and the amount of a polymerization initiator.

Below are example methods of making the cross-linked surface layer for use in the present invention. When an acrylate monomer having three acryloyloxy groups and a triaryl amine compound having an acryloyloxy group are used as a liquid of application, the content ratio of the acrylate monomer to the triaryl amine is 3/7 to 7/3 and a polymerization initiator is added in an amount of 3 to 20% by weight based on the total amount of the acrylate compound followed by an addition of a solvent to prepare the liquid of application. When a triaryl amine based donor and polycarbonate as a binder resin are used in a charge transport layer provided under the cross-linked surface layer and the surface thereof is formed by a spray coating method, it is preferred to use tetrahydrofuran, 2-butanone or ethyl acetate as the solvent mentioned above for the liquid application, the content of which is 3 to 10 times as much as the total amount of the acrylate compound.

The cross-linked surface layer manufactured by curing is preferred to be insoluble in an organic solvent. When a layer is not sufficiently cured, such a layer is soluble in an organic solvent and the cross-linking density is low. Thus, the mechanical strength thereof is weak.

Next, for example, the liquid application prepared as described above is applied with, for example, a spray, on an image bearing member in which an undercoating layer, a charge generating layer and a charge transport layer are accumulated on a substrate, such as an aluminum cylinder. Subsequent to natural drying or drying at a relatively low temperature (25 to 80° C.) for a short time (1 to 10 minutes), the liquid application is cured by UV ray irradiation or heat.

In the case of UV ray irradiation, a metal halide lamp, etc., is preferably used. The illuminance thereof is preferably from 50 to 1,000 mW/cm$^2$. For example, irradiation with UV light having an illuminance of 700 mW/cm$^2$ for about 20 seconds while rotating the cylinder is suitable to uniformly irradiate all the surface. The drum temperature is controlled not to be high than 50° C.

In the case of heat curing, the heating temperature is preferably from 100 to 170° C. For example, an air supply oven is used as a heating device and when the heating temperature is set at 150° C., the liquid application is heated for 20 minutes to 3 hours.

After the curing reaction, to reduce the amount of the remaining solvent, the liquid application is heated at 100 to 150° C. for 10 to 30 minutes. Thus, the image bearing member of the present invention is prepared.

Layer Structure of Image Bearing Member

The present invention is described below based on its layer structure.

Figure 3A:
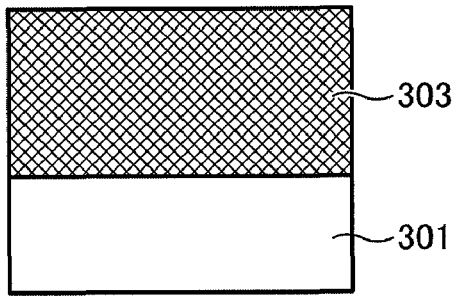
FIG. 3 is a diagram illustrating an example of the cross section of the image bearing member of the present invention.
Figure 3B:
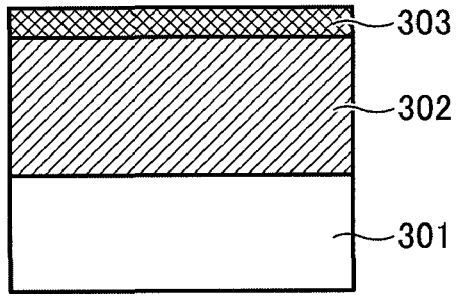

FIG. 3 is a cross section illustrating an example of the image bearing member of the present invention. The image bearing member is a single layered image bearing member having a photosensitive layer 302 having both functions of charge generating and charge transport. FIG. 3A is a diagram illustrating the case in which a cross-linked surface layer 303 is the photosensitive layer 302 and FIG. 3B is a diagram illustrating the case in which a cross-linked surface layer 303 occupies the surface portion of the photosensitive layer 302.

Figure 4A:
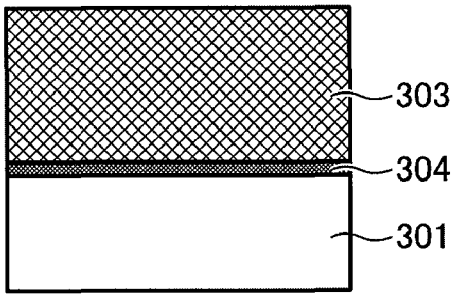
FIG. 4 is a diagram illustrating another example of the cross section of the image bearing member of the present invention.
Figure 4B:
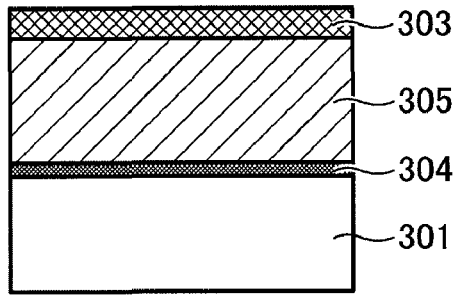

FIG. 4 is an image bearing member having a multi-layered structure of a charge generating layer 304 having a charge generating function and a charge transport layer 305 having a charge transport function. FIG. 3A is a diagram illustrating the case in which a cross-linked surface layer 303 is the charge transport layer 305 and FIG. 3B is a diagram illustrating the case in which a cross-linked surface layer 303 occupies the surface portion of the charge transport layer 305.

Electroconductive Substrate

Materials having a volume resistance of not greater than $10^{10}$ Ω·cm can be used as a material for the substrate 31. For example, there can be used plastic or paper having a film form or cylindrical form covered with a metal, such as aluminum, nickel, chrome, nichrome, copper, gold, silver, and platinum, or a metal oxide, such as tin oxide and indium oxide by depositing or sputtering. Also a board formed of aluminum, an aluminum alloy, nickel, and a stainless metal can be used. Further, a tube which is manufactured from the board mentioned above by a crafting technique, for example, extruding and extracting, and surface-treatment, such as cutting, super finishing and grinding, is also usable. In addition, an endless nickel belt and an endless stainless belt described in JOP S52-36016 can be used as the electroconductive substrate.

An electroconductive substrate can be formed by applying to the substrate mentioned above a liquid application in which electroconductive powder is dispersed in a suitable binder resin and can be used as the electroconductive substrate for use in the present invention.

Specific examples of such electroconductive powders include, but are not limited to, carbon black, acetylene black, metal powder, such as powders of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

Also, an electroconductive substrate formed by providing a heat contraction tube as an electroconductive layer on a suitable cylindrical substrate can be used as the electroconductive substrate in the present invention. The heat contraction tube can be formed of a material, such as polyvinyl chloride, polypropylene, polyester, polystyrene, polyvinylidene chloride, polyethylene, chloride rubber, and TEFLON® in which the electroconductive powder mentioned above is contained.

Photosensitive Layer

Next is a description about the photosensitive layer. The photosensitive layer can take a single layered structure or a multi-layered structure.

In the case of a multi-layered structure, the photosensitive layer is formed of a charge generating layer having a charge generating function and a charge transport layer having a charge transport function. In the case of a single layered structure, the photosensitive layer is a layer having both functions of charge generation and charge transport.

Described below are the photosensitive layer having a multi-layered structure and the photosensitive layer having a single-layered structure.

Multi-Layered Structure

Charge Generating Layer

The charge generating layer is a layer mainly formed of a charge generating material having a charge generating function. A binder resin can be used in combination, if desired. As the charge generating material, there are inorganic materials and organic materials.

Specific examples of the inorganic materials include, but are not limited to, crystal selenium, amorphous selenium, selenium-tellurium, selenium-tellurium-halogen, selenium-arsenic compounds and amorphous silicon. A suitable amorphous silicon is amorphous silicon in which a dangling bond is terminated by a hydrogen atom, or a halogen atom or a boron atom and/or a phosphorous atom are doped.

Any known material can be used as the organic materials. The specific examples thereof include, but are not limited to, phthalocyanine based pigments, such as metal phthalocyanine and non-metal phthalocyanine, azulenium salt pigments, methine squaric acid pigments, azo pigments having carbazole skeleton, azo pigments having triphenyl amine skeleton, azo pigments having dibenzothiophene skeleton, azo pigments having fluorenone skeleton, azo pigments having oxadiazole skeleton, azo pigments having bisstilbene skeleton, azo pigments having distyryl oxadiazole skeleton, azo pigments having distyryl carbazole skeleton, perylene based pigments, anthraquinone based or polycyclic quinone based pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

Specific examples of the optional binder resins for use in the charge generating layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles and polyacrylamides. These can be used alone or in combination.

Specific examples of the optional binder resins for use in the charge generating layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles and polyacrylamides. These can be used alone or in combination.

In addition to the binder resins mentioned above, charge transport polymers having a charge transport function can be used. For example, polymer materials such as polycarbonate resins, polyester resins, polyurethane resins, polyether resins, polysiloxane resins and acryl resins having an arylamine skeleton, a benzidine skeleton, a hydrazone skeleton, a carbazole skeleton, a stilbene skeleton and/or a pyrazoline skeleton can be used. Also, polymer materials having a polysilane skeleton can be used.

Specific examples of the former charge transport polymers include compounds described in JOPs H01-001728, H01-009964, H01-013061, H01-019049, H01-241559, H04-011627, H04-175337, H04-183719, H04-225014, H04-230767, H04-320420, H05-232727, H05-310904, H06-234836, H06-234837, H06-234838, H06-234839, H06-234840, H06-234840, H06-234841, H06-239049, H06-236050, H06-236051, H06-295077, H07-056374, H08-176293, H08-208820, H08-211640, H08-253568, H08-269183, H09-062019, H09043883, H09-71642, H09-87376, H09-104746, H09-110974, H09-110974, H09-110976, H09-157378, H09-221544, H09-227669, H09-221544, H09-227669, H09-235367, H09-241369, H09-268226, H09-272735, H09-272735, H09-302084, H09-302085 and H09-328539.

Specific examples of the latter charge transport polymers include polysilylene polymers described in JOPs S63-285552, H05-19497, H05-70595 and H10-73944.

The charge generating layer can contain a charge transport material having a low molecular weight.

There are two types of the charge transport materials which can be used for a charge generating layer. These are positive hole transport materials and electron transport materials.

Specific examples of such electron transport materials include, but are not limited to, electron acceptance materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives.

These electron transport materials can be used alone or in combination.

Specific examples of such positive hole transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These positive hole transport materials can be used alone or in combination.

As a method of forming a charge generating layer, it is possible to use a vacuum thin layer manufacturing method and a casting method from a solution dispersion system.

Specific examples of the vacuum thin layer manufacturing method include, but are not limited to, a vacuum deposition method, a glow discharging decomposition method, an ion plating method, a sputtering method, and a reactive sputtering method and a chemical vacuum deposition (CVD) method. Both inorganic materials and organic materials can be used for forming a charge transport layer.

When a casting method is used, if desired, it is possible to form a charge generating layer by applying a suitably diluted liquid dispersion obtained by dispersing the inorganic material or the organic material mentioned above in a solvent together with a binder resin using a dispersion device. Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butyl acetate. Specific examples of the dispersing device include, but are not limited to, a ball mill, an attritor, a sand mill, and a bead mill. In addition, if desired, a leveling agent, for example, dimethyl silicone oil and methylphenyl silicone oil, can be added to the liquid dispersion mentioned above. Furthermore, the application mentioned above is performed by a dip coating method, a spray coating method, a bead coating method and a ring coating method.

In the present invention, the thickness of the charge transport layer is preferably from 0.01 to 5 μm and more preferably from 0.05 to 2 μm.

Charge Transport Layer

The charge transport layer is a layer having a charge transport function and the cross-linked surface layer having a charge transport structure for use in the present invention is suitably used as the charge transport layer. When the cross-linked surface layer is the charge transport layer, the cross-linked surface layer is formed by coating a liquid application containing radical polymerizable compositions (a monomer having a radical polymerizable function group and a radical polymerizable compound having a charge transport structure) and particulates having a needle form followed by optional drying and starting the curing reaction thereof by external energy, as described above. The layer thickness of the cross-linked surface layer is from 10 to 30 μm and preferably from 10 to 25 μm. When the layer thickness is too thin, it is difficult to maintain a sufficient charging voltage. When the layer thickness is too thick, the cross-linked surface layer is easily detached from the layer provided thereunder by volume contraction during curing.

In addition, when the cross-linked surface layer is formed as the surface layer of a charge transport layer and the charge transport layer is a multi-layered structure, the underlayer portion of the charge transport layer is formed by dissolving or dispersing a charge transport material having a charge transport function and a binder resin in a suitable solvent, and applying and drying the resultant to a charge generating layer. The liquid application mentioned above of the radical polymerizable composition and particulates having a needle form is applied to the underlayer followed by curing for cross-linking by external energy.

The electron transport materials, the positive hole transport materials and charge transport polymer mentioned above in the description about the charge generating layer can be used as the charge transport material. As described above, by using a charge transport polymer, it is possible to reduce the solubility of the underlayer when a surface layer is coated, which is useful.

Specific examples of the binder resin include, but are not limited to, thermoplastic resins or thermocuring resins, such as polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenol resins, and alkyd resins.

The content of the charge transport material is from 20 to 300 parts by weight and preferably from 40 to 150 parts by weight based on 100 parts by weight of the binder resin. When a charge transport polymer is used, it is possible to use such a charge transport polymer alone or in combination with a binder resin.

As a solvent for use in application of the underlayer portion of a charge transport layer, the same as the solvents for the charge generating layer can be used. The solvent suitably dissolves a charge transport material and a binder resin. These solvents can be used alone or in combination. It is also possible to use the same method in the case of a charge generating layer for forming an underlayer of a charge transport layer.

In the present invention, a plasticizing agent and/or a leveling agent can be contained, if desired.

Specific examples of the plasticizing agent include, but are not limited to, dibutyl phthalate and dioctyl phthalate, which are used for typical resins. The addition amount of the plasticizing agent is preferably from 0 to 30 parts by weight based on 100 parts by weight of a binder resin.

Specific examples of the leveling agent include, but are not limited to, silicone oils, such as dimethyl silicone oil and methyl phenyl silicone oil, and polymers or oligomers having perfluoroalkyl groups in its side chain. The addition amount of the leveling agent is preferably from 0 to 1 parts by weight based on 100 parts by weight of a binder resin.

The layer thickness of the underlayer portion of a charge transport layer is suitably from about 5 to about 40 μm and preferably from about 10 to about 30 μm.

When the cross-linked surface layer is the surface portion of a charge transport layer, the cross-linked surface layer is formed by coating a liquid application containing radical polymerizable compositions (a monomer having a radical polymerizable function group and a radical polymerizable compound having a charge transport structure) followed by optional drying and starting the curing reaction thereof by external energy, as described above. The layer thickness of the cross-linked surface layer is from 1 to 20 μm and preferably from 2 to 10 μm. When the layer thickness is too thin, the layer thickness is non-uniform and the durability tends to vary. When the layer thickness is too thick, the layer thickness of the entire charge transport layer is excessively thick, resulting in deterioration of reproducibility of images due to diffusion of charges.

Single-Layered Photosensitive Layer

The single layered photosensitive layer is a layer having a charge generating function and a charge transport function. The cross-linked surface layer having a charge transport function for use in the present invention contains a charge generating material having a charge generating function and is suitable for a photosensitive layer having a single-layered structure. The cross-linked surface layer is formed by dispersing a charge generating material in a liquid application containing radical polymerizable compositions, coating the resultant on a charge generating layer followed by optional drying and starting the curing reaction thereof by external energy, as described above in the casting method of a charge generating layer. The charge generating material can be added to a liquid application for a cross-linked surface layer after the charge generating material is dispersed in a solvent in advance. The layer thickness of the cross-linked surface layer is from 10 to 30 μm and preferably from 10 to 25 μm. When the layer thickness is too thin, it is difficult to maintain a sufficient charging voltage. When the layer thickness is too thick, the layer is easily detached from an electroconductive substrate or an undercoating layer due to volume contraction during curing.

In addition, when the cross-linked surface layer is the surface portion of a photosensitive layer having a single layer structure, the underlayer portion of the photosensitive layer can be formed by dissolving and/or dispersing a charge generating material having a charge generating function, a charge transport material having a charge transport function and a binder resin in a suitable solvent followed by application and drying. Plasticizers and/or leveling agents can be optionally added. The same method of dispersing the charge transport material, the same charge generating materials, the same charge transport materials, the same plasticizers and the same leveling agents as those described above for the charge generating layer and the charge transport layer can be suitably used. As the binder resin, in addition to the binder resins mentioned in the description about the charge transport layer, the binder resin mentioned in the description about the charge generating layer can be mixed therewith. Furthermore, it is also possible to use charge transport polymers. These polymers have an advantage in that it is possible to reduce the commingling of underlayer photosensitive compositions to the cross-linked surface. The layer thickness of the underlayer of the photosensitive layer is suitably from about 5 to about 30 μm and preferably from about 10 to about 25 μm.

When the cross-linked surface layer is the surface portion of a photosensitive layer having a single layer structure, the cross-linked surface layer is formed by coating a liquid application containing radical polymerizable compositions and a charge generating material followed by optional drying and starting the curing reaction thereof by external energy, as described above. The layer thickness of the cross-linked surface layer is from 1 to 20 μm and preferably from 2 to 10 μm. When the layer thickness is too thin, the layer thickness is non-uniform and the durability tends to vary.

The charge generating material contained in a photosensitive layer having a single layer structure is preferably from 1 to 30% by weight based on the total amount of the entire photosensitive layer. The content of the binder resin contained in the underlayer portion of a photosensitive layer is from 20 to 80% by weight of the total weight thereof and the content of the charge transport material is from 10 to 70% by weight based thereon.

Intermediate Layer

With regard to the image bearing member of the present invention, when the cross-linked surface layer is the surface portion of the photosensitive layer, it is possible to provide an intermediate layer to prevent the underlayer compositions from commingling into the cross-linked surface layer and to improve the adhesiveness with an underlayer. This intermediate layer prevents inhibition of curing reaction and roughness of a cross-linked surface layer caused by commingling of underlayer compositions of a photosensitive layer to the uppermost surface layer containing radical polymerizable compositions. In addition, it is possible to improve the adhesiveness of the cross-linked surface layer and the photosensitive layer provided therebelow.

The intermediate layer is mainly formed of a binder resin. Specific examples of the binder resin include, but are not limited to, polyamide, alcohol soluble nylon, water soluble polyvinyl butyral, polyvinyl butyral and polyvinyl alcohol. As described above, the intermediate layer can be formed by a typical application method. The layer thickness of such an intermediate layer is suitably from about 0.05 to about 2 μm.

Undercoating Layer

In the image bearing member of the present invention, an undercoating layer can be provided between an electroconductive substrate and a photosensitive layer. Such an undercoating layer is mainly made of a resin. Considering that a photosensitive layer is formed on such an undercoating layer (i.e., resin) using a solvent, the resin is preferably hardly soluble in a typically used organic solvent. Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, to prevent moiré and reduce the residual voltage, it is possible to add to an undercoating layer fine powder pigments of metal oxide, such as titanium oxides, silica, alumina, zirconium oxides, tin oxides and indium oxides.

These undercoating layers can be formed by using a suitable solvent and a suitable coating method as described for the photosensitive layer. Silane coupling agents, titanium coupling agents and chromium coupling agents can be used in for the undercoating layer. Furthermore, an undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method.

The layer thickness of such an undercoating layer is suitably from 0 to 5 μm.

Addition of Anti-Oxidizing Agent

Furthermore, in the present invention, to improve the environmental resistance, in particular, to prevent the degradation of sensitivity and the rise in residual potential, an anti-oxidizing agent can be added to layers, for example, a cross-linked surface layer, a charge generating layer, a charge transport layer, an undercoating layer and an intermediate layer. Specific examples of the anti-oxidizing agent include, but are not limited to, phenol compounds, paraphenylene diamines, hydroquinones, organic sulfur compounds, and organic phosphorous compounds.

Specific examples of the phenol compound include, but are not limited to, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, and tocopherols.

Specific examples of the paraphenylene diamines include, but are not limited to, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Specific examples of the hydroquinones include, but are not limited to, 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Specific examples of the organic sulfur compounds include, but are not limited to, dilauryl-3,3'-thiodipropionate, distearyl-3,3'-thiodipropyonate, and ditetradecyl-3,3'-thiodipropyonate.

Specific examples of the organic phosphorous compounds include, but are not limited to, triphenylphosphine, tri(nonylphenyl)phosphine, tri(dinonylphenyl)phosphine, tricresylphosphine, and tri(2,4-dibutylphenoxy)phosphine.

These compounds are known as anti-oxidizing agents for rubbers, plastics, and oils, and commercial products thereof are readily available.

The addition amount of the anti-oxidizing agent is preferably 0.01 to 10 parts by weight based on the total weight of the layer to which the anti-oxidizing agent is added.

Image Forming Method and Image Forming Apparatus

The image forming method and the image forming apparatus of the present invention are described in detail with reference to the accompanying drawings.

The image forming method and the image forming apparatus of the present invention include, but are not limited to, at least processes of: charging an image bearing member having a smooth charge transport cross-linked surface layer; irradiating the image bearing member with light to form a latent electrostatic image; developing the latent image with toner; transferring the toner image to an image carrying body (transfer medium); fixing the toner image; and cleaning the surface of the image bearing member.

However, for example, in an image forming method in which a latent electrostatic image is directly transferred to a transfer medium, not all the processes mentioned above related to the image bearing member are included.

Figure 5:
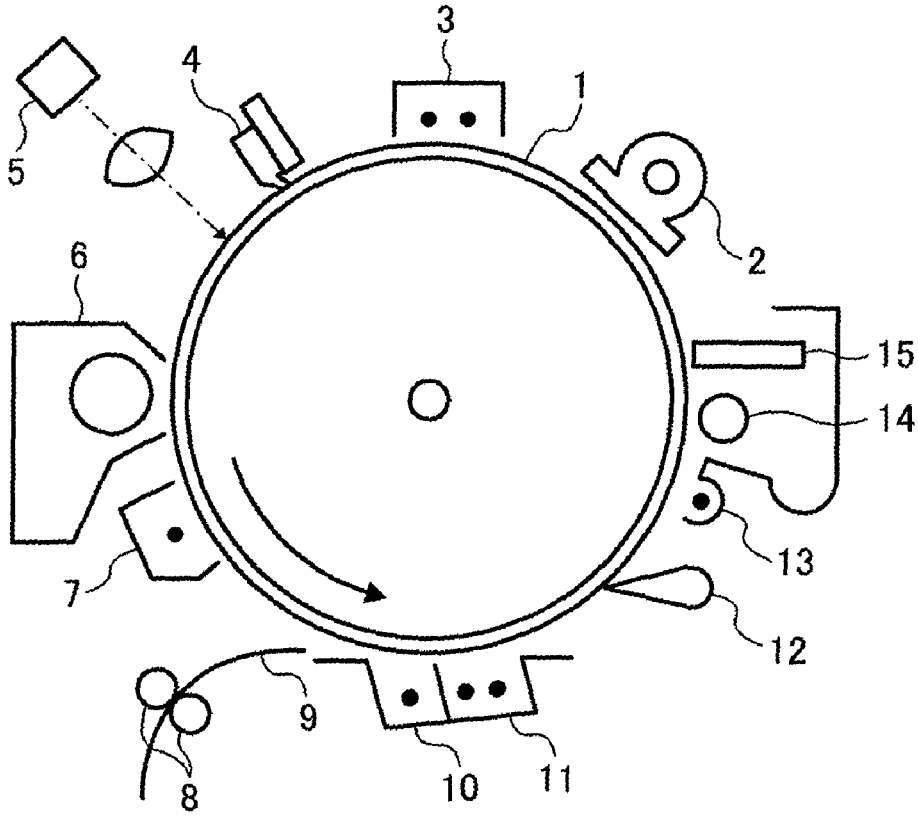
FIG. 5 is a schematic diagram illustrating an example of the image forming apparatus of the present invention.

FIG. 5 is a schematic diagram illustrating an example of an image forming apparatus. As a charging device that uniformly charges an image bearing member 1, a charger 3 is used. Specific examples of the charger 3 include, but are not limited to, a corotron device, a scorotron device, a solid discharging element, a needle electrode device, a roller charger, and an electroconductive brush device and any known method can be used.

Next, an image irradiation portion 5 is used to form a latent electrostatic image on the uniformly charged image bearing member 1. As the light source of the image irradiation portion 5, typical illuminating materials, for example, a fluorescent lamp, a tungsten lamp, a halogen lamp, a mercury lamp, a sodium lamp, a light emitting diode (LED), a semiconductor laser (LD), and electroluminescence (EL), can be used. To irradiate an image bearing member with light having only a particular wavelength, various kinds of optical filters, for example, a sharp cut filter, a band-pass filter, a near infrared filter, a dichroic filter, a coherent filter and a color conversion filter, can be used.

Next, a developing unit 6 is used for visualizing the latent electrostatic image formed on the image bearing member 1. As the developing method, there are a one-component developing method and a two-component development method using a dry toner, and a wet-developing method using a wet toner. When an image bearing member is positively (or negatively) charged and irradiated, a positive (or negative) latent electrostatic image is formed on the image bearing member. When the latent electrostatic image is developed with a negatively (or positively) charged toner (volt-detecting fine particles), a positive image is formed. When the latent electrostatic image is developed using a positively (or negatively) charged toner, a negative image is formed.

A transfer charging device 10 is used for transferring a toner image visualized on the image bearing member 1 to a transfer body 9. To more preferably performing the transferring, a pre-transfer charging device 7 can be used. It is possible to use an electrostatic transfer method using a transfer charging device or a bias roller; a mechanical transfer method, such as an adhesion transfer method or a pressure transfer method; and a magnetic transfer method. For the electrostatic transfer method, the charging device mentioned above can be used.

A separation charging device 11 and a separation pawl 12 are used to separate the transfer body 9 from the image bearing member 1. The charging device mentioned above can be used as the separation charging device 11. There are other separation methods tha can be used, such as electrostatic sucking inducing separation, side edge belt separation, front edge grip conveyance and curvature separation.

A fur brush 14 and/or a cleaning blade 15 are used for cleaning a toner remaining on the image bearing member 1 after transfer. A pre-cleaning charging device 13 can be used for efficiently performing cleaning. For the other cleaning methods, there are web methods and magnet brush methods. These methods can be employed alone or in combination.

A discharging unit can be optionally used for removing a latent image on the image bearing member 1. As the discharging unit, a discharging lamp 2 or a discharging device can be used. The irradiation light source and the charging device mentioned above can be used.

In addition, with regard to the processes that are performed not in the vicinity of the image bearing member 1, i.e., reading an original, sheet-feeding, fixing, paper-discharging, known devices and methods in the art can be used.

The image forming method and the image forming apparatus of the present invention use the image bearing member of the present invention in the image formation unit described above.

Figure 6:
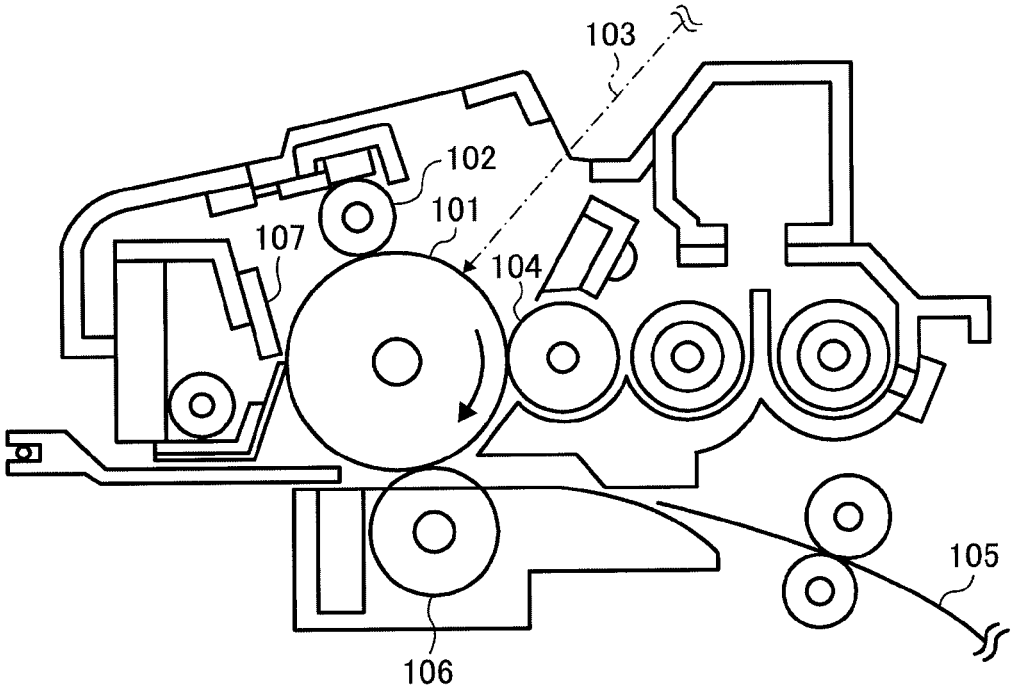
FIG. 6 is a diagram illustrating an example of the process cartridge for use in the image forming apparatus of the present invention.

The image formation unit may be fixed in and incorporated into copiers, facsimiles, and printers, or may be detachably incorporated into these devices in a form of a process cartridge. FIG. 6 is a diagram illustrating an example of the process cartridge.

The process cartridge for use in an image forming apparatus is a device (or component) that integrates an image bearing member 101 therein, includes at least one device selected from a charging device 102, a developing device 104, a transfer device 106, a cleaning device 107 and a discharging device (not shown) and is detachably mounted to the main body of an image forming apparatus.

The image forming process using the device exemplified in FIG. 6 will be described. While the image bearing member 101 rotates in the direction indicated by the arrow, a latent electrostatic image corresponding to the exposed image is formed on the surface of the image bearing member 101 through charging and irradiating the surface thereof by a charging device 102 and an irradiating device 103. This latent electrostatic image is developed with a toner by the developing device 104, and the toner image is transferred to a transferring body 105 by a transfer device 106. The surface of the image bearing member 101 after the image transfer is cleaned by the cleaning device 107 and discharged by a discharging device (not shown) to be ready for the next cycle.

According to the present invention, a process cartridge for use in an image forming apparatus is provided which includes an image bearing member having a polymer charge transport layer and a cross-linked surface layer integrated with at least one device selected from a charging device, a developing device, a cleaning device and a discharging device.

As seen in the description above, the image bearing member of the present invention can be used not only in an electrophotographic apparatus but also in an applied electrophotography field, such as a laser beam printer, a CRT printer, an LED printer, a liquid crystal printer and a laser printing.

Synthesis Example of Radical Polymerizable Compound Having Charge Transport Structure The compound having a charge transport structure in the present invention can be synthesized by the method described in JP 3164426. Specific examples are as follows:

(1) Synthesis of Hydroxy Group Substituted Triarylamine Compound (Chemical Structure B)

240 ml of sulfolane is added to 113.85 g (0.3 mol) of a methoxy group-substituted triarylamine compound (represented by the following chemical structure A), and 138 g (0.92 mol) of sodium iodide. The resultant is heated to 60° C. in nitrogen gas stream. 99 g (0.91 mol) of trimethylchlorosilane is dropped to the resultant solution in one hour. Thereafter, the solution is stirred for 4.5 hours at around 60° C. and the reaction is terminated. To the reaction liquid, approximately 1,500 ml of toluene is added, and the reaction liquid is cooled down to the room temperature followed by repetitive washing with water and a sodium carbonate aqueous solution. Then, the solvent is removed from the toluene solution, and the solution is purified by column chromatography (absorption medium: silica gel; developing solvent: toluene:ethyl acetate=20:1). Cyclohexane is added to the obtained cream-colored oil to precipitate crystals. 88.1 g (yield constant: 80.4%) of white-color crystals represented by the following chemical structure B is thus obtained.

Melting point: 64.0 to 66.0° C.

TABLE 1

| | C | H | N |
|---|---|---|---|
| Measured value | 85.06 | 6.41 | 3.73 |
| Calculated value | 85.44 | 6.34 | 3.83 |

Chemical Structure A

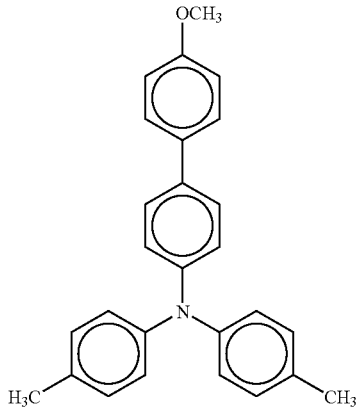

Chemical Structure B

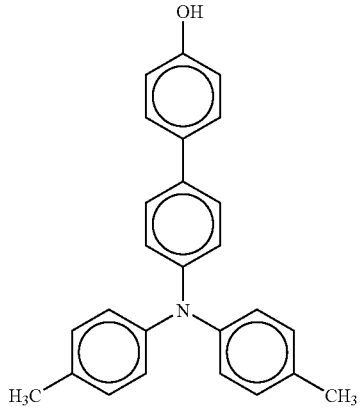

(2) Synthesis of Triarylamine Group-Substituted Acrylate Compound (Compound Example No. 54 Illustrated Above)

82.9 g (0.227 mol) of the hydroxy group-substituted triarylamine compound obtained in the (1) (Chemical structure B) is dissolved in 400 ml of tetrahydrofuran, and a sodium hydroxide solution (NaOH: 12.4 g, water: 100 ml) is dropped into the dissolved solution in a nitrogen gas stream. The solution is cooled down to 5° C., and 25.2 g (0.272 mol) of acrylic acid chloride is dropped thereto in 40 minutes. Thereafter, the solution is stirred for 3 hours at 5° C., and the reaction is terminated. The reaction liquid is poured to water and extracted using toluene. The extract is repetitively washed with a sodium hydrogen carbonate aqueous solution and water. Thereafter, the solvent is removed from the toluene solution, and the solution is purified by column chromatography (absorption medium: silica gel; developing solvent: toluene). Then, n-hexane is added to the obtained colorless oil to precipitate crystals. 80.73 g (yield constant: 84.8%) of white-color crystals of Compound Example No. 54 illustrated above is obtained.

Melting point: 117.5 to 119.0° C.

Element analytical value: (%)

TABLE 2

| | C | H | N |
|---|---|---|---|
| Measured value | 83.13 | 6.01 | 3.16 |
| Calculated value | 83.02 | 6.00 | 3.33 |

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Undercoating Layer

An undercoating layer is formed on an aluminum substrate having an outer diameter of 30 mm Φ by a dip coating method such that the layer thickness after drying is 3.5 μm.

Liquid Application for Undercoating Layer

| | |
|---|---|
| Alkyd resin (Beckozole 1307-60-EL, available from Dainippon Ink and Chemicals, Inc.) | 6 parts |
| Melamine resin (Super-beckamine, available from Dainippon Ink and Chemicals, Inc.) | 4 parts |
| Titanium oxide (CR-EL, manufactured by Ishihara Sangyo Kaisha Ltd.) | 40 parts |
| Methylethylketone | 50 parts |

Liquid Application for Charge Generating Layer

A charge generating layer having a layer thickness of 0.2 μm is formed by dip-coating a liquid application containing the bisazo pigment represented by the following chemical structure 4 on the undercoating layer followed by heating and drying.

Liquid Application for Charge Generating Layer

| | |
|---|---|
| Bis-azo pigment represented by the following chemical structure 4 | 2.5 parts |

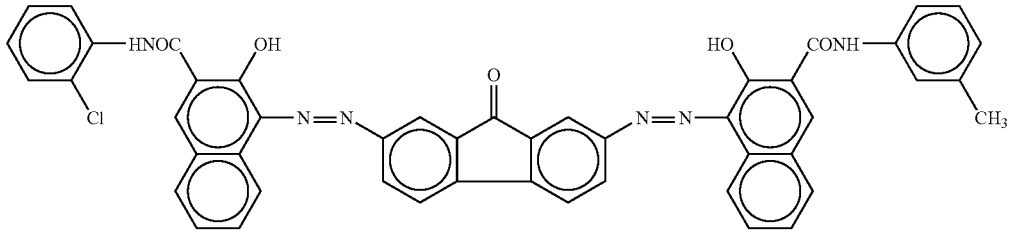

Chemical Structure 4

| | |
|---|---|
| Polyvinylbutyral (XYHL, manufactured by Union Carbide Corp.) | 0.5 parts |
| Cyclohexanon | 200 parts |
| Methylethylketone | 80 parts |

Charge Transport Layer

A charge transport layer having a layer thickness of 2.2 μm is formed by dip-coating a liquid application for a charge transport layer represented by the following structure on the charge generating layer followed by heating and drying.

Liquid Application for Charge Transport Layer

| | |
|---|---|
| Bisphenol Z type polycarbonate | 10 parts |
| Low-molecular charge transport material represented by the following chemical structure 5 | 10 parts |

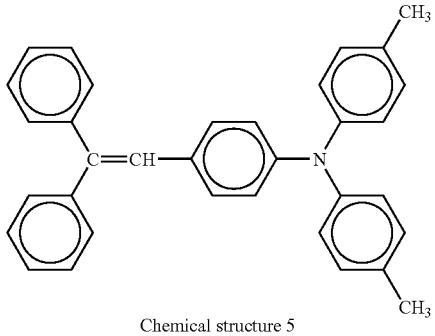

Chemical structure 5

| | |
|---|---|
| Tetrahydrofuran | 80 parts |
| Tetrahydrofuran solution of 1% silicone oil (KF50-100CS, manufactured by Shin-Etsu Chemical Co., Ltd.) | 0.2 parts |

Cross-Linked Surface Layer

The image bearing member of the present invention is obtained by spray-coating a liquid application for cross-linked surface layer having the following recipe on the charge transport layer and irradiating with light by a metal halide lamp under the condition of irradiation intensity of 700 mW/cm$^2$ (365 nm) and irradiation time of 240 seconds followed by drying at 130° C. for 30 minutes to form a cross-linked surface layer having a thickness of 5.0 μm.

Liquid Composition for Cross-Linked Surface Layer

| | |
|---|---|
| Monomer having at least three radical polymerizable functional groups without a charge transport structure Trimethylolpropantriacrylate (KAYARAD TMPTA, manufactured by Nippon Kayaku Co., Ltd.) Molecular weight: 296 Number of functional groups: trifunctional | 9 parts |

-continued

| | |
|---|---|
| Molecular weight/Number of functional groups = 99 | |
| Radical polymerizable compound having a charge transport structure Compound Example No. 54 illustrated above) | 9 parts |
| Photo-polymerization initiator | 2 parts |

-continued

| | |
|---|---|
| 1-hydroxy-cyclohexyl-phenyl-keton (IRGACURE 184, manufactured by Chiba Specialty Chemicals K.K.) | |
| titanium particulate having a needle form (ST-485SA15, manufactured by Titan Kogyo Co., Ltd.) (Aspect ratio: about 2 to 12) | 2 parts |
| Tetrahydrofuran | 100 parts |

Example 2

The image bearing member of Example 2 is manufactured in the same manner as in Example 1 except that a titanium particulate having a needle form (FTL-100, aspect ratio: about 13, manufactured by Ishihara Sangyo Kaisha Ltd.) is used instead as particulates having a needle form in the liquid application for cross-linked surface layer of Example 1.

Example 3

The image bearing member of Example 3 is manufactured in the same manner as in Example 1 except that an aluminum oxide particulate having a needle form (NANOCERAM fiber, aspect ratio: about 20 to 100, manufactured by Argonide co., Ltd.) is used instead as particulates having a needle form in the liquid application for cross-linked surface layer of Example 1.

Example 4

The image bearing member of Example 4 is manufactured in the same manner as in Example 2 except that the radical polymerizable compound having a charge transport structure in the liquid application for cross-linked surface layer of Example 2 is replaced with the compound of illustrated No. 182.

Example 5

The image bearing member of Example 5 is manufactured in the same manner as in Example 2 except that the radical polymerizable compound having a charge transport structure in the liquid application for cross-linked surface layer of Example 2 is replaced with the compound of illustrated No. 364.

Comparative Example 1

The image bearing member of Comparative Example 1 is manufactured in the same manner as in Example 1 except that the particulate having a needle form in the liquid application for cross-linked surface layer of Example 1 is not contained.

Comparative Example 2

The image bearing member of Comparative Example 2 is manufactured in the same manner as in Example 1 except that the particulates having a needle form in the liquid application for cross-linked surface layer of Example 1 is replaced with an aluminum oxide particulates having a spherical form (AA03, manufactured by Sumitomo Chemical Co., Ltd.)

Comparative Example 3

The image bearing member of Comparative Example 3 is manufactured in the same manner as in Example 1 except that the particulates having a needle form in the liquid application for cross-linked surface layer of Example 1 is replaced with a titanium oxide particulate having a spherical form (CR-97, manufactured by Ishihara Sangyo Kaisha Ltd.)

Comparative Example 4

The image bearing member of Comparative Example 4 is manufactured in the same manner as in Example 1 except that the particulates having a needle form in the liquid application for cross-linked surface layer of Example 1 is replaced with a fluorine particulate (Rublon L2, manufactured by Daikin Industries, Ltd.)

Comparative Example 5

The image bearing member of Comparative Example 5 is manufactured in the same manner as in Example 1 except that the liquid application for cross-linked surface layer of Example 1 is substituted by the liquid application having the following recipe:

Liquid Composition For Cross-Linked Surface Layer

| | |
|---|---|
| Monomer having at least three radical polymerizable functional groups without a charge transport structure<br>Trimethylolpropantriacrylate (KAYARAD TMPTA, manufactured by Nippon Kayaku Co., Ltd.)<br>Molecular weight: 296<br>Number of functional groups: trifunctional<br>Molecular weight/Number of functional groups = 99 | 9 parts |
| Radical polymerizable compound having a charge transport structure<br>Compound Example No. 54 illustrated above) | 9 parts |
| Photo-polymerization initiator<br>1-hydroxy-cyclohexyl-phenyl-keton (IRGACURE 184, manufactured by Chiba Specialty Chemicals K.K.) | 2 parts |
| Silicone oil (KF50, manufactured by Shin-Etsu Chemical Co., Ltd.) | 5 parts |
| Tetrahydrofuran | 120 parts |

Comparative Example 6

The image bearing member of Comparative Example 6 is manufactured in the same manner as in Example 1 except that the layer thickness of the charge transport layer is 27 μm and no cross-linked surface layer is provided.

Test by Using Actual Machine

The manufactured image bearing members are installed onto a multi-functional machine (imagio Neo C455, manufactured by Ricoh Co., Ltd.) using a polymerized (spherical) toner and are tested for a run length of 200,000. Evaluation is made on the abrasion property and images (about steaks when a white solid image is printed). The results are shown in tables 2 and 3.

Paper: My Paper A4, manufactured by NBS Ricoh Co., Ltd.

Used station: Black

Output image: 7% lattice image

Evaluation Method on Abrasion Property

The layer thickness is measured at 20 points on the image bearing member by an eddy-current thickness measuring device (Fischerscope MMS) to obtain the abrasion amount (average) of the layer thickness from start.

Evaluation Method on Image

Image evaluation is made for five A4 sheets of white solid image and the images are observed with naked eyes.

TABLE 2

| | Abrasion amount/μm | | |
|---|---|---|---|
| | 50,000$^{th}$ image | 100,000$^{th}$ image | 200,000$^{th}$ image |
| Example 1 | 0.64 | 1.29 | 2.43 |
| Example 2 | 0.58 | 1.17 | 2.20 |
| Example 3 | 0.67 | 1.35 | 2.55 |
| Example 4 | 0.71 | 1.43 | 2.70 |
| Example 5 | 0.74 | 1.49 | 2.81 |

TABLE 2-continued

| | Abrasion amount/μm | | |
|---|---|---|---|
| | 50,000th image | 100,000th image | 200,000th image |
| Comparative Example 1 | 1.24 | 2.49 | 4.71 |
| Comparative Example 2 | 0.91 | 1.83 | 3.46 |
| Comparative Example 3 | 0.95 | 1.91 | 3.61 |
| Comparative Example 4 | 1.32 | 2.65 | — |
| Comparative Example 5 | 1.51 | 3.04 | — |
| Comparative Example 6 | 5.12 | — | — |

TABLE 3

| | Abrasion amount/μm | | | |
|---|---|---|---|---|
| | Initial | 50,000th image | 100,000th image | 200,000th image |
| Example 1 | G | G | G | F |
| Example 2 | G | G | G | F |
| Example 3 | G | G | G | G |
| Example 4 | G | G | G | B |
| Example 5 | G | G | F | B |
| Comparative Example 1 | G | F | B | B |
| Comparative Example 2 | G | F | B | B |
| Comparative Example 3 | G | B | B | B |
| Comparative Example 4 | G | G | G | — |
| Comparative Example 5 | G | G | G | — |
| Comparative Example 6 | G | G | — | — |

Streaks on image:
G: Good
F: Locally observed
B: Observed entirely

Examples 1 to 3 are good about the anti-abrasion property and image characteristics. Examples 4 and 5 are image bearing members using a compound having two or three radical polymerizable functional groups with a charge transport structure. Cracking occurs locally in the surface of these image bearing members and the cleaning property is bad at 200,000th printing. In Comparative Example 1, since particulates are not contained in the surface layer, the anti-abrasion property is not good. In Comparative Examples 2 and 3, the anti-abrasion property is relatively improved because of particulates having a spherical form contained therein in comparison with the case in which such particulates are not added. However, the anti-abrasion property is not good in comparison with the case of particulates having a needle form. In Comparative Examples 1 to 3, the cleanability of the toner having a spherical form is not sufficiently good. In Comparative Examples 4 and 5, the cleanability of the toner having a spherical form is good but the anti-abrasion property thereof is not good.

Therefore, particulates having a needle form are dispersed in the surface layer of the photosensitive layer for use in the present invention and a cross-linked resin layer is made as the surface layer by curing at least a monomer having at least three radical polymerizable functional group without a charge transport structure and a radical polymerizable compound having a charge transport structure. The thus obtained image bearing member has a long life and good performance and can produce good images for an extended period of time. In addition, it is also found that the image formation process, the image forming apparatus and the process cartridge for use in the image forming apparatus using the image bearing member are of high performance and has a high reliability.

This document claims priority and contains subject matter related to Japanese Patent Applications Nos. 2006-309952 and 2007-259506, filed on Nov. 16, 2007, and Oct. 3, 2007, respectively, the entire contents of which are incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. An image bearing member comprising:

an electrostatic substrate;

a photosensitive layer located overlying the electrostatic substrate; and a surface layer provided on a surface of the photosensitive layer, wherein the surface layer is a cross-linking resin layer in which aluminum oxide particulates having a needle form are dispersed and which is formed by curing (i) a monomer having at least three radical polymerizable functional groups without a charge transport structure and (ii) a radical polymerizable compound having a charge transport structure.

2. The image bearing member according to claim 1, wherein the radical polymerizable compound having a charge transport structure has a single functional group.

3. The image bearing member according to claim 2, wherein the radical polymerizable compound having a charge transport structure and one functional group is at least one member selected from polymerizable compounds represented by the following chemical structures 1 and 2:

Chemical structure 1

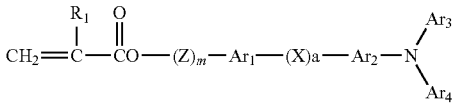

Chemical structure 2

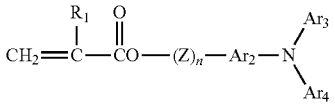

wherein $R_1$ represents hydrogen atom, a halogen atom, a substituted or non-substituted alkyl group, a substituted or non-substituted aralkyl group, an aryl group, cyano group, nitro group or a substituted or non-substituted alkoxy group, or —$COOR_7$ ($R_7$ represents hydrogen atom, a substituted or non-substituted alkyl group, a substituted or non-substituted aralkyl group, or a substituted or non-substituted aryl group); a halogenated carbonyl group or $CONR_8R_9$ ($R_8$ and $R_9$ each, independently, represent hydrogen atom, a halogen atom, a substituted or non-substituted alkyl group, a substituted or non-substituted aralkyl group, or a substituted or non-substituted aryl group); $Ar_1$ and $Ar_2$ each, independently, represent a substituted or unsubstituted arylene group; $Ar_3$ and $Ar_4$ each, independently, represent a substituted or unsubstituted aryl group; X represents a substituted or non-substituted alkylene group, a substituted or non-substituted cycloalkylene group, a substituted or non-substituted alkylene ether divalent group, oxygen atom, sulfur atom, or vinylene group; Z represents a substituted or non-substituted alkylene group, a substituted or non-substituted alkylene ether divalent group or an alkyleneoxy carbonyl divalent group; a represents 1 and m and n each, independently, represent 0 or an integer of from 1 to 3.

4. The image bearing member according to claim 2, wherein the radical polymerizable compound having a charge transport structure and a single functional group is at least one member selected from polymerizable compounds represented by the following chemical structure 3:

Chemical structure 3

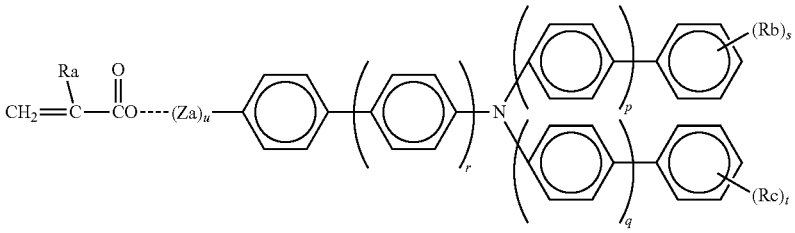

wherein u represents 1, r, p, q each, independently, represent 0 or 1, s and t each, independently, represent 0 or an integer of from 1 to 3, Ra represents hydrogen atom or methyl group, each of Rb and Rc independently represents an alkyl group having 1 to 6 carbon atoms, and Za represents methylene group, ethylene group, —$CH_2CH_2O$—, —$CHCH_3CH_2O$—, or —$C_6H_5CH_2CH_2$—.

5. The image bearing member according to claim 1, wherein the functional group of the monomer having at least three radical polymerizable functional groups without a charge transport structure is at least one of an acryloyloxy group and a methacryloyloxy group.

6. The image bearing member according to claim 1, wherein a functional group of the radical polymerizable compound having a charge transport structure is at least one of an acryloyloxy group and a methacryloyloxy group.

7. The image bearing member according to claim 1, wherein the structure of the radical polymerizable compound having a charge transport structure is a triaryl amine structure.

8. The image bearing member according to claim 1, wherein the surface layer is cured by heat or an optical energy irradiation device.

9. An image forming apparatus comprising:

the image bearing member of claim 1;

a charging device configured to charge the image bearing member forming a charged image bearing member;

an image irradiation device configured to form a latent electrostatic image on the charged image bearing member;

a developing device configured to develop the latent electrostatic image to form a developed image; and a transfer device configured to transfer the developed image to a transfer body.

10. A process cartridge comprising:

the image bearing member of claim 1; and at least one device selected from the group consisting of a charging device, a developing device, a transfer device, a cleaning device and a discharging device, wherein the process cartridge is detachably attached to a main body of an image forming apparatus.

* * * * *